US010562255B2

(12) United States Patent
Aganovic et al.

(10) Patent No.: US 10,562,255 B2
(45) **Date of Patent: *Feb. 18, 2020**

(54) MACHINE AND METHOD FOR FORMING REINFORCED POLYGONAL CONTAINERS FROM BLANKS

(71) Applicant: WestRock Shared Services, LLC, Norcross, VA (US)

(72) Inventors: Amer Aganovic, Orlando, FL (US); Thomas Dean Graham, Winter Garden, FL (US); Kenneth Charles Smith, Hiram, GA (US); John Hershcel Conley, Windemere, FL (US); Robert Bradley Teany, Clermont, FL (US); Gregory Scott Gulik, DeLand, FL (US); Paul Andrew Spurlock, Oviedo, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 253 days.

This patent is subject to a terminal disclaimer.

(21) Appl. No.: 15/676,313

(22) Filed: Aug. 14, 2017

(65) Prior Publication Data

US 2018/0009188 A1 Jan. 11, 2018

Related U.S. Application Data

(60) Division of application No. 14/062,711, filed on Oct. 24, 2013, now Pat. No. 9,764,526, which is a (Continued)

(51) Int. Cl.
*B31B 50/00* (2017.01)
*B31B 50/26* (2017.01)
(Continued)

(52) U.S. Cl.
CPC ..... *B31B 50/26* (2017.08); *B65D 5/003* (2013.01); *B65D 5/4295* (2013.01); (Continued)

(58) Field of Classification Search
CPC ..... B31B 50/26; B65D 5/003
(Continued)

(56) References Cited

U.S. PATENT DOCUMENTS 4,988,331 A * 1/1991 Boisseau ..... B31B 50/00 493/143
8,323,165 B2 * 12/2012 Atoui ..... B31B 50/00 493/175

(Continued)

*Primary Examiner* — Chelsea E Stinson
(74) *Attorney, Agent, or Firm* — WestRock IP Legal

(57) ABSTRACT

A machine for forming a container from a blank of sheet material is provided. The blank includes a reinforcing panel assembly for forming a reinforcing corner assembly. The machine includes a hopper station for storing the blank in a substantially flat configuration and a forming station for forming the blank into the container. The forming station includes an initial forming station that rotates a first portion of the reinforcing panel assembly with respect to a second portion of the reinforcing panel assembly, and a secondary forming station having male and female forming members with shapes corresponding to an interior shape and an exterior shape of the reinforcing corner assembly, respectively. The male and the female forming members are configured to form the reinforcing corner assembly by compressing together the first and second portions of the reinforcing panel assembly.

6 Claims, 37 Drawing Sheets

Related U.S. Application Data continuation of application No. 12/780,544, filed on May 14, 2010, now Pat. No. 8,579,778.

(51) Int. Cl.

| | |
|---|---|
| ***B65D 5/00*** | (2006.01) |
| ***B65D 5/42*** | (2006.01) |
| ***B65D 5/66*** | (2006.01) |
| *B31B 100/00* | (2017.01) |
| *B31B 50/28* | (2017.01) |
| *B31B 110/35* | (2017.01) |

(52) U.S. Cl.
CPC ..... *B65D 5/6644* (2013.01); *B31B 50/282* (2017.08); *B31B 2100/00* (2017.08); *B31B 2100/0024* (2017.08); *B31B 2110/35* (2017.08)

(58) Field of Classification Search
USPC ..... 493/128
See application file for complete search history.

(56) References Cited

U.S. PATENT DOCUMENTS

| | | | | |
|---|---|---|---|---|
| 8,579,778 | B2 * | 11/2013 | Aganovic | B65D 5/003 493/89 |
| 9,764,526 | B2 * | 9/2017 | Aganovic | B65D 5/003 |
| 9,908,304 | B2 * | 3/2018 | Aganovic | B65D 5/0015 |

* cited by examiner

MACHINE AND METHOD FOR FORMING REINFORCED POLYGONAL CONTAINERS FROM BLANKS

This application is a divisional application of U.S. patent application Ser. No. 14/062,711, filed Oct. 24, 2013, which is a continuation of U.S. patent application Ser. No. 12/780,544, filed May 14, 2010, now U.S. Pat. No. 8,579,778, the disclosures of which are hereby incorporated herein by reference in their entirety.

BACKGROUND OF THE INVENTION

The field of the invention relates generally to a reinforced polygonal container formed from a blank of sheet material and more particularly, to a machine for forming the reinforced polygonal container from the blank.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, it is difficult to form a container from a single sheet of material that includes multiple reinforcing panels along the corner and side walls. Accordingly, a need exists for a multi-sided reinforced container, also known as a mitered tray and/or a META Tray-8® (META Tray-8 is a registered trademark of Smurfit-Stone Container Corporation located in Chicago, Ill.), formed from a single blank that can be easily formed at high-speeds. Further, a need exists for a machine that can form a reinforced polygonal container from a blank of sheet material at a high-speed.

BRIEF DESCRIPTION OF THE INVENTION

In one aspect, a machine for forming a container from a blank of sheet material is provided. The blank includes at least one reinforcing panel assembly for forming a reinforcing corner assembly of the container. The machine includes a hopper station for storing the blank in a substantially flat configuration and a forming station for forming the blank into the container. The forming station includes an initial forming station configured to rotate a first portion of the at least one reinforcing panel assembly with respect to a second portion of the at least one reinforcing panel assembly, and a secondary forming station having a male forming member having a shape corresponding to an interior shape of the reinforcing corner assembly and a female forming member having a shape corresponding to an exterior shape of the reinforcing corner assembly. The male forming member and the female forming member are configured to form the reinforcing corner assembly by compressing together the first and second portions of the at least one reinforcing panel assembly.

In another aspect, a machine for forming a container from a blank of sheet material is provided. The blank includes at least one reinforcing panel assembly for forming a reinforcing corner assembly of the container. The at least one reinforcing panel assembly extends from a side edge of at least one end panel. The machine includes a hopper for storing the blank in a substantially flat configuration, a male forming member having a shape corresponding to an interior shape of the reinforcing corner assembly, and a female forming member having a shape corresponding to an exterior shape of the reinforcing corner assembly. The male forming member and the female forming member are configured to form the reinforcing corner assembly by compressing a first portion of the at least one reinforcing panel assembly to a second portion of the at least one reinforcing panel assembly. The machine further includes a transport system configured to transport the blank from the hopper to the male and female forming members.

In yet another aspect, a method of forming a container from a blank of sheet material using a machine is provided. The blank includes a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines. The reinforcing panel assembly extends from a first side edge of a first end panel of the two end panels. The machine includes a hopper station and a forming station. The method includes rotating the reinforcing panel assembly upwardly about a first fold line of the plurality of fold lines toward the first end panel as the blank is transported from the hopper station to the forming station, forming a reinforcing corner assembly from the reinforcing panel assembly by folding the plurality of reinforcing panels about the plurality of fold lines by compressing the plurality of reinforcing panels into face-to-face relationship using a male forming member and a female forming member within the forming station, rotating the side panels and the end panels to be substantially perpendicular to the bottom panel by directing the blank through a compression station within the forming station, and coupling reinforcing side panels of the reinforcing panel assembly to one of the side panels to form the container.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, reinforced container formed from a single sheet of material, and a method and machine for constructing the container. The container is sometimes referred to as a reinforced mitered tray or a reinforced eight-sided tray. The container may be constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Figure 1:
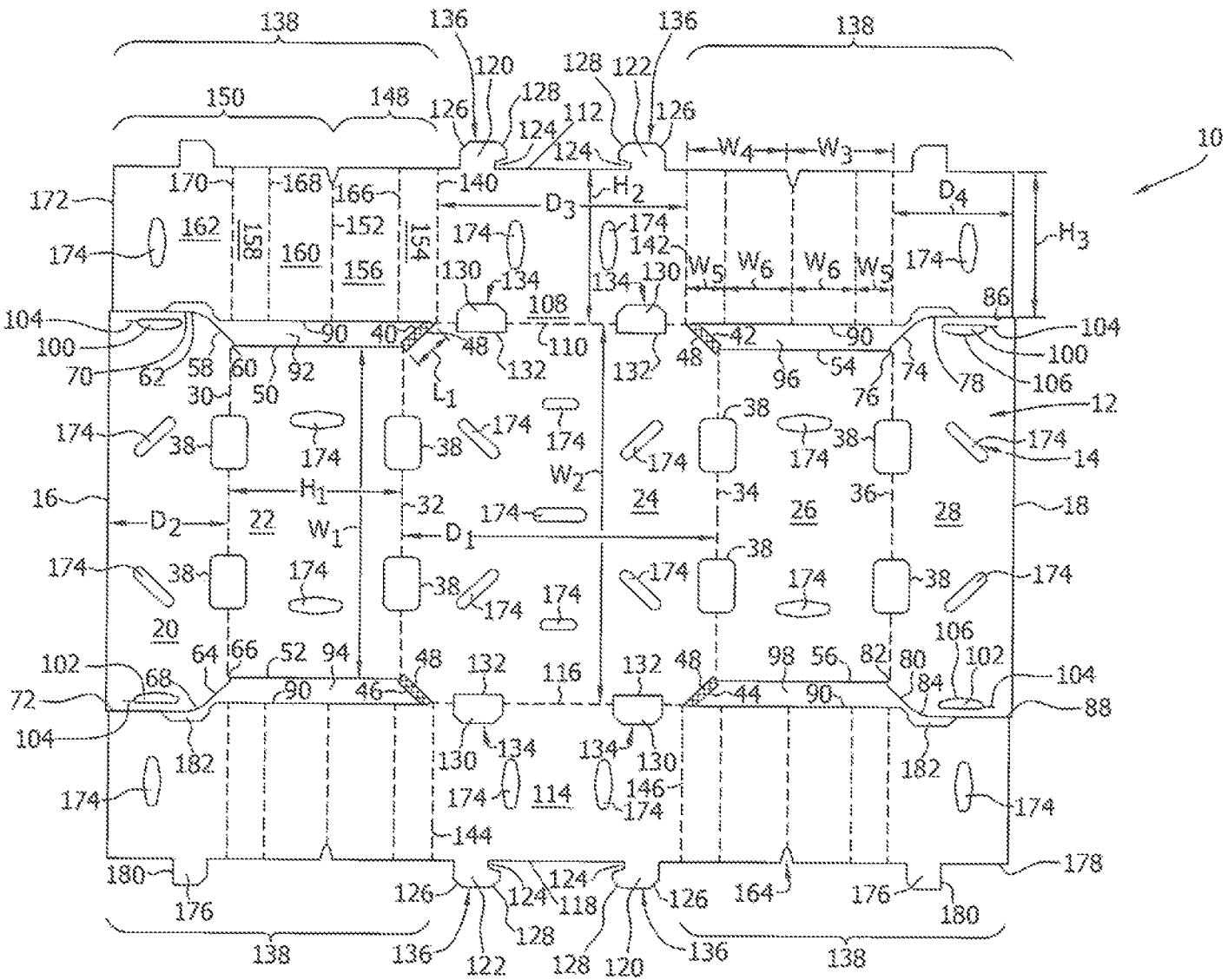
FIG. 1 is a top plan view of a blank of sheet material for constructing a container according to a first embodiment of the present invention.

Referring now to the drawings, and more specifically to FIG. 1, which is a top plan view of an example embodiment of a blank 10 of sheet material. A container 200 (shown in FIGS. 2-4) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first top panel 20, a first side panel 22, a bottom panel 24, a second side panel 26, and a second top panel 28 coupled together along preformed, generally parallel, fold lines 30, 32, 34, and 36, respectively.

More specifically, first top panel 20 extends from leading edge 16 to fold line 30, first side panel 22 extends from first top panel 20 along fold line 30, bottom panel 24 extends from first side panel 22 along fold line 32, second side panel 26 extends from bottom panel 24 along fold line 34, and second top panel 28 extends from second side panel 26 to trailing edge 18. Fold lines 30, 32, 34 and/or 36, as well as other fold lines and/or hinge lines described herein, may include any suitable line of weakening and/or line of separation known to those skilled in the art and guided by the teachings herein provided. When container 200 is formed from blank 10, fold line 32 defines a bottom edge of first side panel 22 and a first side edge of bottom panel 24, and fold line 34 defines a second side edge of bottom panel 24 and a bottom edge of second side panel 26. Further, when container 200 is formed from blank 10, fold line 30 defines a side edge of first top panel 20 and a top edge of first side panel 22, and fold line 36 defines a top edge of second side panel 26 and a side edge of second top panel 28. In the exemplary embodiment, vent openings 38 are defined along fold lines 30, 32, 34, and 36; however, it should be understood that blank 10 includes any suitable number of vent openings 38 along any suitable fold line. Further, vent openings 38 can have any suitable size and/or shape that enables blank 10 and/or container 200 to function as described herein.

First side panel 22 and second side panel 26 are substantially congruent and have a rectangular shape. Bottom panel 24 has an octagonal shape. More specifically, first side panel 22 and second side panel 26 have a width $W_1$. Bottom panel 24 has a width $W_2$, which is longer that width $W_1$. Alternatively, width $W_1$ is substantially equal to or longer than width $W_2$. Further, in the exemplary embodiment, side panels 22 and 26 have a first height $H_1$, and bottom panel 24 has a first depth $D_1$ that is larger than first height $H_1$. In an alternative embodiment, height $H_1$ is substantially equal to or larger than depth $D_1$. Alternatively, first side panel 22, second side panel 26, and/or bottom panel 24 have any suitable dimensions that enable blank 10 and/or container 200 to function as described herein.

In the exemplary embodiment, bottom panel 24 may be considered to be substantially rectangular in shape with four cut-off corners or angled edges 40, 42, 44, and 46 formed by cut lines. As such, the cut-off corner edges 40, 42, 44, and 46 of otherwise rectangular bottom panel 24 define an octagonal shape of bottom panel 24. Moreover, each angled corner edge 40, 42, 44, and 46 has a length $L_1$, and angled edges 40 and 44 and angled edges 42 and 46 are substantially parallel. Alternatively, bottom panel 24 has any suitable shape that enables container 200 to function as described herein. For example, bottom panel 24 may be in the shape of a rectangle having corners that are truncated by a segmented edge such that bottom panel 24 has more than eight sides. In another example, bottom panel 24 may be in the shape of a rectangle having corners that are truncated by an arcuate edge such that bottom panel 24 has four substantially straight sides and four arcuate sides. In the exemplary embodiment, each angled edge 40, 42, 44, and 46 includes a crushed area 48 that facilitates forming container 200 from blank 10. More specifically, crushed area 48 enables corner walls 210, 212, 214, and/or 216 (shown in FIG. 2) to be formed. Alternatively, blank 10 does not include crushed areas 48.

In the exemplary embodiment, first side panel 22 includes two free side edges 50 and 52, and second side panel 26 includes two free side edges 54 and 56. Side edges 50, 52, 54, and 56 are substantially parallel to each other. Alternatively, side edges 50, 52, 54, and/or 56 are other than substantially parallel. In the exemplary embodiment, each side edge 50, 52, 54, and 56 is connected to a respective angled edge 40, 42, 44, or 46. Each side edge 50, 52, 54, and 56 may be directly connected to a respective angled edge 40, 42, 44, or 46 or, as shown in FIG. 1, may be slightly offset from a respective angled edge 40, 42, 44, or 46 to facilitate forming container 200 from blank 10 by allowing clearance for a thickness of a panel that is directly or indirectly attached to first side panel 22 or second side panel 26.

First top panel 20 and second top panel 28 are substantially congruent and have a generally trapezoidal shape. More specifically, first top panel 20 includes an angled edge 58 extending from an intersection 60 of fold line 30 and free edge 50 toward an apex 62 and an angled edge 64 extending from an intersection 66 of fold line 30 and free edge 52 toward an apex 68. A free side edge 70 extends from apex 62 to leading edge 16, and a free side edge 72 extends from apex 68 to leading edge 16. Similarly, second top panel 28 includes an angled edge 74 extending from an intersection 76 of fold line 36 and free edge 54 toward an apex 78 and an angled edge 80 extending from an intersection 82 of fold line 36 and free edge 56 toward an apex 84. A free side edge 86 extends from apex 78 to trailing edge 18, and a free side edge 88 extends from apex 84 to trailing edge 18.

Angled edge 58, free edge 50, angled edge 40, at least a portion of free edge 70, and a bottom edge 90 define a cutout 92; angled edge 64, free edge 52, angled edge 46, at least a portion of free edge 72, and bottom edge 90 define cutout 94; angled edge 74, free edge 54, angled edge 42, at least a portion of free edge 86, and bottom edge 90 define cutout 96; and angled edge 80, free edge 56, angled edge 44, at least a portion of free edge 88, and bottom edge 90 define cutout 98. In addition, first and second top panels 20 and 28 have a depth $D_2$ that is smaller than half of depth $D_1$. In an alternative embodiment, depth $D_2$ is substantially equal to or larger than half of depth $D_1$. It should be understood that first side panel 22, second side panel 26, bottom panel 24, and/or top panels 20 and/or 28 may have any suitable dimensions that enable blank 10 to function as described herein.

In the exemplary embodiment, first top panel 20 includes a first locking slot 100 and a second locking slot 102 defined therethrough. Similarly, second top panel 28 includes locking slots 100 and 102. Each slot 100 and 102 is located, shaped, and sized to receive a stacking tab 204 (shown in FIG. 2) when container 200 is closed, as described in more detail below. In the exemplary embodiment, a slit 104 extends from each slot 100 and/or 102 to enable stacking tab 204 to be slid through slit 104 into a respective slot 100 or 102; however, it should be understood that any or all of slots 100 and/or 102 do not include slit 104. In the exemplary embodiment, each slot 100 and 102 is generally rectangularly shaped with one slightly arcuate edge 106, and slots 100 and 102 are substantially mirror images of each other.

A first end panel 108 extends from bottom panel 24 along a fold line 110 to a free edge 112, and a second end panel 114 extends from bottom panel 24 along a fold line 116 to a free edge 118. Fold line 110 defines a bottom edge of first end panel 108 and an end edge of bottom panel 24, and fold line 116 defines a bottom edge of second end panel 114 and an end edge of bottom panel 24. First and second end panels 108 and 114 are each generally rectangularly or square shaped. End panels 108 and 114 each have a depth $D_3$ that is shorter than depth $D_1$ such that end panels 108 and 114 are narrower than bottom panel 24. In the exemplary embodiment, end panels 108 and 114 each have a height $H_2$ such that height $H_2$ is substantially equal to height $H_1$. Alternatively, height $H_2$ is other than equal to height $H_1$. In the exemplary embodiment, fold line 110 extends between ends of angled corner edges 40 and 42, and fold line 116 extends between ends of angled corner edges 46 and 44.

Figure 4:
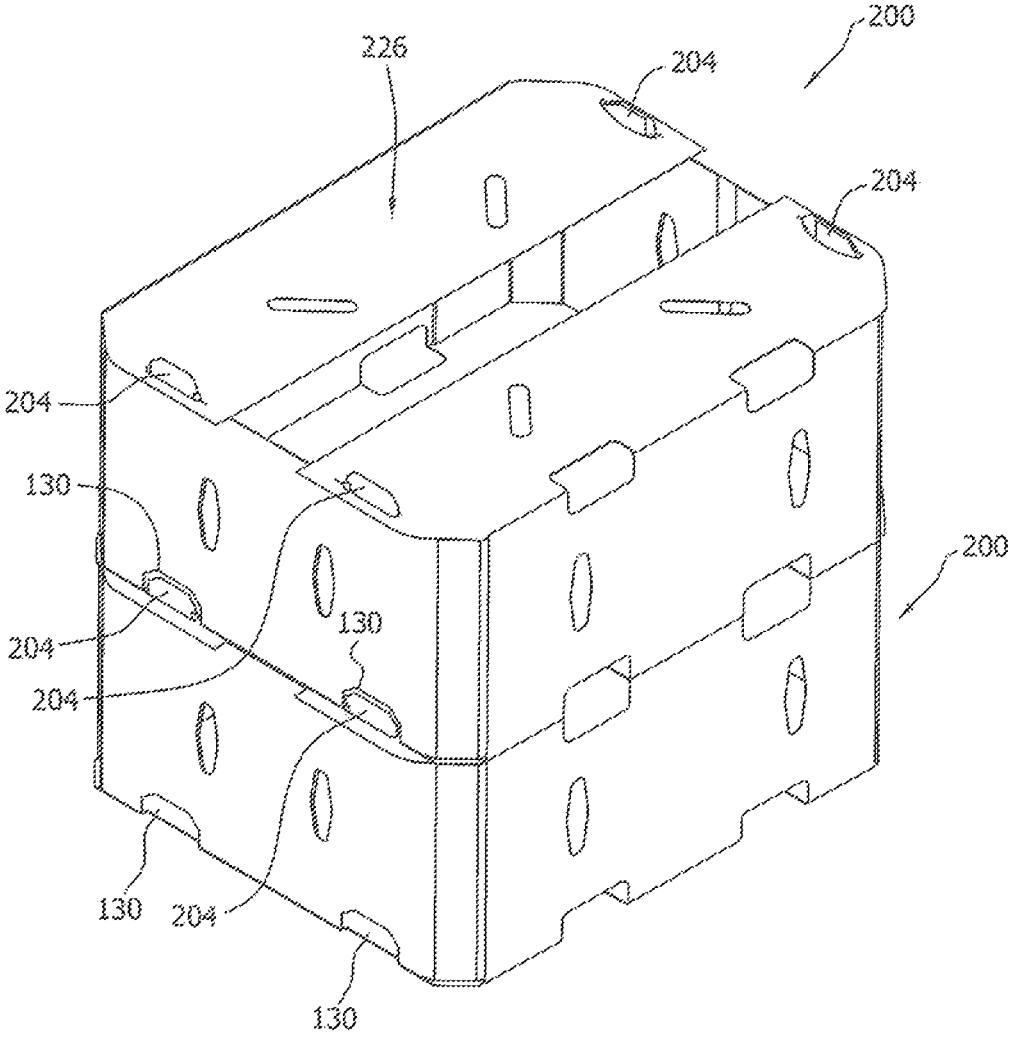
FIG. 4 is a perspective view of a plurality of the containers shown in FIG. 2 in a stacked configuration.

Each end panel 108 and 114 includes a pair of mirror image stacking extensions 120 and 122. More specifically, each stacking extension 120 and 122 forms a portion of stacking tab 204 when container 200 is formed from blank 10. Each stacking extension 120 and 122 defines a notch 124 and has angled upper corners 126 and 128. Notch 124 is sized to receive a portion of top panel 20 or 28 when container 200 is closed, as described in more detail below. Further, in the exemplary embodiment, each fold line 110 and 116 includes a pair of stacking slots 130 defined by cut lines 132. Cut lines 132 include an upper portion 134 that has a shape that corresponds to a shape of an upper edge 136 of stacking tabs 204. When containers 200 are stacked as shown in FIG. 4, stacking tabs 204 of a lower container 200 are received within stacking slots 130 of an upper container 200. When containers 200 are stacked, stacking tabs 204 do not extend into a cavity 224 of an upper container 200, but rather are flush within stacking slots 130, as shown in FIG. 4.

Referring again to FIG. 1, in the exemplary embodiment, a reinforcing panel assembly 138 extends from side edges of each end panel 108 and 114. Each side edge is defined by a respective fold line—140, 142, 144, or 146. Fold lines 140, 142, 144, and 146 are substantially parallel to each other. Alternatively, fold lines 140, 142, 144, and/or 146 are other than substantially parallel. In the exemplary embodiment, each reinforcing panel assembly 138 includes free bottom edge 90. Further, each reinforcing panel assembly 138 is substantially similar and includes an outer reinforcing panel assembly 148 and an inner reinforcing panel assembly 150 connected to each other along a fold line 152. Fold line 152 defines a side edge of outer reinforcing panel assembly 148 and a side edge of inner reinforcing panel assembly 150. Moreover, outer reinforcing panel assembly 148 includes a corner panel 154 and a first reinforcing side panel 156; and inner reinforcing panel assembly 150 includes an inner reinforcing corner panel 158, a second reinforcing side panel 160, and an inner end panel 162. Each reinforcing panel assembly 138 is configured to form a reinforcing corner assembly 202 (shown in FIG. 2) when container 200 is formed from blank 10. Further, first top panel 20 is separated from adjacent reinforcing panel assemblies 138 by side edges 70 and 72, and second top panel 28 is separated from adjacent reinforcing panel assemblies 138 by side edges 86 and 88.

Outer reinforcing panel assembly 148 extends from an end panel 108 or 114 along each of fold lines 140, 142, 144, and 146. Further, inner reinforcing panel assembly 150 extends from each outer reinforcing panel assembly 148 along fold line 152. A notch 164 is formed along fold line 152 between inner reinforcing panel assembly 150 and outer reinforcing panel assembly 148; although it should be understood that notch 164 can be omitted. In the exemplary embodiment, inner reinforcing corner panel 158 and second reinforcing side panel 160 have a width $W_3$, and outer reinforcing panel assembly 148 has a width $W_4$, which is substantially equal to width $W_3$. Further, in the exemplary embodiment, inner and outer reinforcing panel assemblies 150 and 148 have a height $H_3$ that is substantially similar to height $H_1$ of first side panel 22 and second side panel 26. In an alternative embodiment, height $H_3$ is other than equal to height $H_1$. In the exemplary embodiment, each outer reinforcing panel assembly 148 includes a fold line 166 that divides each outer reinforcing panel assembly 148 into corner panel 154 and first reinforcing side panel 156. Fold line 166 defines an edge of corner panel 154 and a side edge of first reinforcing side panel 156, and fold line 152 defines a side edge of first reinforcing side panel 156. In the exemplary embodiment, corner panel 154 and first reinforcing side panel 156 are substantially rectangular.

Further, each inner reinforcing panel assembly 150 includes fold lines 168 and 170 that divide each inner reinforcing panel assembly 150 into second reinforcing side panel 160, inner reinforcing corner panel 158, and inner end panel 162. More specifically, second reinforcing side panel 160 extends from first reinforcing side panel 156 along fold line 152, inner reinforcing corner panel 158 extends from second reinforcing side panel 160 along fold line 168, and inner end panel 162 extends from inner reinforcing corner panel 158 along fold line 170 to a free edge 172. Fold line 168 defines an edge of inner reinforcing corner panel 158 and a side edge of second reinforcing side panel 160, fold line 170 defines a side edge of inner reinforcing corner panel 158 and an edge of inner end panel 162, and fold line 152 defines a side edge of second reinforcing side panel 160. In the exemplary embodiment, corner panel 154 and inner reinforcing corner panel 158 are substantially congruent, and first and second reinforcing side panels 156 and 160 are substantially congruent. Further, free edge 172 is generally co-linear with leading edge 16 or trailing edge 18; however, free edge 172 can have any suitable position with respect to leading edge 16 and/or trailing edge 18 that enables blank 10 and/or container 200 to function as described herein.

Each corner panel 154 and each inner reinforcing corner panel 158 have a width $W_5$ that is substantially equal to length $L_1$. In addition, each first reinforcing side panel 156 and second reinforcing side panel 160 have a width $W_6$ that is larger than width $W_5$. In an alternative embodiment, width $W_6$ is smaller than or approximately equal to width $W_5$. Further, in the exemplary embodiment, each inner end panel 162 has a depth $D_4$ that is equal to approximately half of width $W_3$ of first and second end panels 108 and 114. When end panels 108 and/or 114 include vent holes 174, inner end panels 162 include corresponding vent holes 174 that are configured to align with vent holes 174 defined through end panels 108 and/or 114 when container 200 is formed from blank 10. In an alternative embodiment, depth $D_4$ is other than equal to approximately half of width $W_3$.

In the exemplary embodiment, inner end panel 162 includes a minor stacking extension 176 extending from a top edge 178 thereof. Minor stacking extension 176 has a shape that at least partially corresponds to the shape of stacking extension 120 or 122 such that minor stacking extension 176 aligns with a respective stacking extension 120 or 122 to form a stacking tab 204. In the exemplary embodiment, minor stacking extension 176 is substantially similarly shaped to a respective stacking extension 120 or 122, except minor stacking extension 176 includes a straight side edge 180 rather than forming notch 124. It should be understood that minor stacking extension 176 has any suitable shape and position that enables blank 10 and/or container 200 to function as described herein. Further, in the exemplary embodiment, inner end panel 162 includes a notch 182 defined in bottom edge 90. Notch 182 is shaped to correspond to at least a portion of stacking slot 130 defined in end panel 108 and/or 114. As such, when container 200 is formed from blank 10, inner end panel 162 does not obstruct stacking slot 130, and a lower stacking tab 204 can fit within an upper stacking slot 130.

Figure 2:
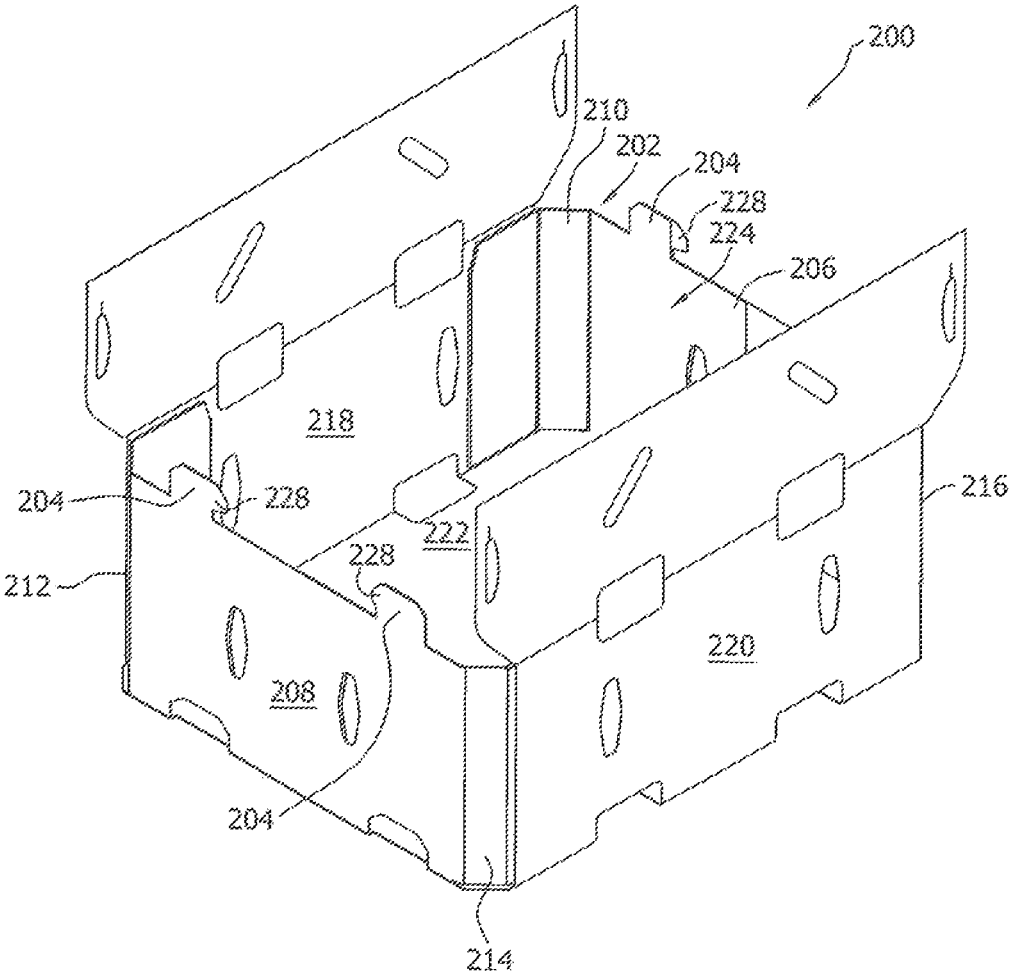
FIG. 2 is a perspective view of a container formed from the blank shown in FIG. 1 in an open configuration.
Figure 3:
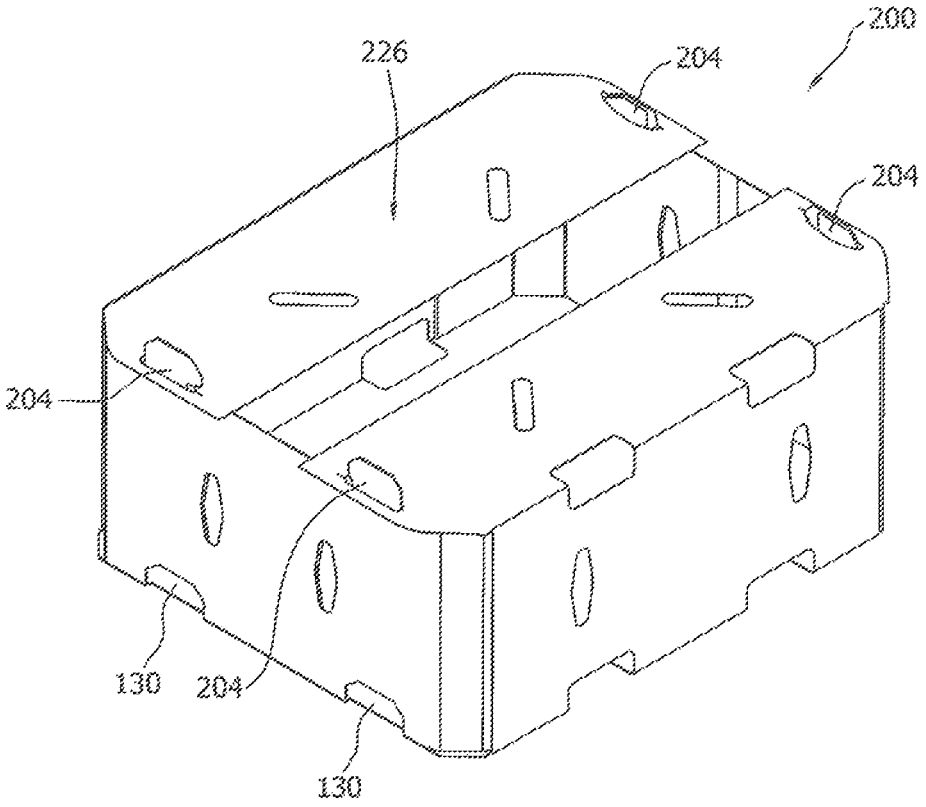
FIG. 3 is a perspective view of the container shown in FIG. 2 in a closed configuration.

FIG. 2 is a perspective view of container 200 that is formed from blank 10 (shown in FIG. 1). FIG. 3 is a perspective view of container 200 in a closed configuration. FIG. 4 is a perspective view of a plurality of containers 200 in a stacked configuration. Although container 200 is shown as being formed without a product to be contained therein, container 200 may also be formed having a product therein. Further, container 200 may include any suitable number of products of any suitable shape.

To construct container 200 from blank 10, in the exemplary embodiment, each inner reinforcing panel assembly 150 is folded about fold line 152 such that inner reinforcing panel assembly 150 and outer reinforcing panel assembly 148 are in an at least partially overlying relationship, and such that inner end panel 162 is in an at least partially overlying relationship with at least a portion of first or second end panel 108 or 114. More specifically, blank 10 is folded along fold line 152 such that corner panel 154 and inner reinforcing corner panel 158 are substantially aligned in an at least partially overlying relationship, first and second reinforcing side panels 156 and 160 are substantially aligned in an at least partially overlying relationship, and inner end panel 162 and at least a portion of first or second end panel 108 or 114 are substantially aligned in an at least partially overlying relationship. In the exemplary embodiment, inner end panel 162, a respective end panel 108 or 114, reinforcing side panels 156 and 160, and/or corner panels 154 and 158 are secured in the above-described relationships. For example, inner end panel 162 may be adhered to a respective end panel 108 or 114, reinforcing side panels 156 and 160 may be adhered together, and/or corner panels 154 and 158 may be adhered together.

Reinforcing panel assemblies 148 and 150 are rotated about fold lines 140, 142, 144, and 146 and fold lines 170. Further, reinforcing side panels 156 and 160 are rotated about fold lines 166 and 168 toward corner panels 154 and 158 before or after reinforcing panel assemblies 148 and 150 are rotated about fold lines 140, 142, 144, and 146 and fold lines 170. In the exemplary embodiment, reinforcing panel assemblies 148 and 150 and reinforcing side panels 156 and 160 are rotated such that reinforcing side panels 156 and 160 are substantially perpendicular to end panels 108 and 114. First and second end panels 108 and 114 are then rotated about fold lines 110 and 116, respectively, toward interior surface 12. A reinforcing corner assembly 202 is formed by corner panels 154 and 158, reinforcing side panels 156 and 160, and inner end panel 162. When reinforcing corner assemblies 202 are formed, minor stacking extension 176 aligns with a respective stacking extension 120 or 122 to form a stacking tab 204. First end panel 108 with a pair of inner end panels 162 forms a first end wall 206, and second end panel 114 with a pair of inner end panels 162 forms a second end wall 208. Each end wall 206 and 208 includes a pair of stacking tabs 204 extending from an upper edge thereof. Further, each pair of corner panels 154 and 158 forms one corner wall 210, 212, 214, or 216.

First side panel 22 is rotated about fold line 32 toward interior surface 12, and second side panel 26 is rotated about fold line 34 toward interior surface 12. More specifically, first side panel 22 and second side panel 26 are rotated to be substantially perpendicular to bottom panel 24, as shown in FIG. 2. Interior surface 12 of first side panel 22 is secured to exterior surface 14 of two adjacent first reinforcing side panels 156, and interior surface 12 of second side panel 26 is secured to exterior surface 14 of two adjacent first reinforcing side panels 156. In the exemplary embodiment, first side panel 22 and second side panel 26 are adhered to respective first reinforcing side panels 156. Alternatively, first side panel 22 and/or second side panel 26 are otherwise attached to respective first reinforcing side panels 156 using, for example, fasteners, a bonding material, such as glue or an adhesive, and/or any suitable method for attached the panels. In the exemplary embodiment, first side panel 22 and two pairs of reinforcing side panels 156 and 160 form a first side wall 218, and second side panel 26 and two pairs of reinforcing side panels 156 and 160 form a second side wall 220.

When container 200 is formed, interior surface 12 of side walls 218 and 220 is adjacent the side walls of the product. Further, height $H_1$ of side walls 218 and 220 is sized to correspond to a height of the products within container 200 such that height $H_1$ is substantially equal to or greater than the height of the products. Bottom panel 24 forms a bottom wall 222 of container 200, and bottom wall 222, side walls 218 and 220, end walls 206 and 208, and corner walls 210, 212, 214, and 216 define a cavity 224 of container 200. In the exemplary embodiment, bottom edges 90 of reinforcing corner assemblies 138 are substantially aligned with fold lines 32, 34, 110, and 116 and angled edges 40, 42, 44, and 46. In FIG. 2, container 200 has a configuration referred to herein as an "open configuration."

Referring to FIG. 3, to close container 200 and form a top wall 226, first top panel 20 is rotated about fold line 30 toward cavity 224 such that first top panel 20 is substantially perpendicular to first side panel 22 and substantially parallel to bottom panel 24. Further, second top panel 28 is rotated about fold line 36 toward cavity 224 such that second top panel 28 is substantially perpendicular to second side panel 26 and substantially parallel to bottom panel 24. As top panels 20 and 28 are rotated toward cavity 224, a stacking tab 204 is inserted through each locking slot 100 or 102. More specifically, a projection 228 of stacking tab 204 at least partially defined by notch 124 can be slid through slit 104 and then notch 124 can contact an edge of locking slot 100 or 102 once projection 228 is through slit 104 and/or locking slot 100 or 102.

Referring to FIG. 4, a plurality of closed containers 200 can be stacked one on the other, and stacking tabs 204 of a lower container 200 are received within stacking slots 130 of an upper container 200 to facilitate preventing movement of one container 200 with respect to the other container 200 while stacked.

The above-described method to construct container 200 from blank 10 may be performed using a machine, as described in more detail below. The machine performs the above-described method to continuously form container 200 from blank 10 as blank 10 is moved though the machine. In one embodiment, the machine includes at least one plow or finger to at least partially rotate at least one of panels 162, 158, 108, 114, 22, and 26 and/or further form container 200 using a mandrel to complete rotating these panels. Alternatively, a product is placed on interior surface 12 of bottom panel 24 and container 200 is formed about the product manually and/or automatically.

Figure 5:
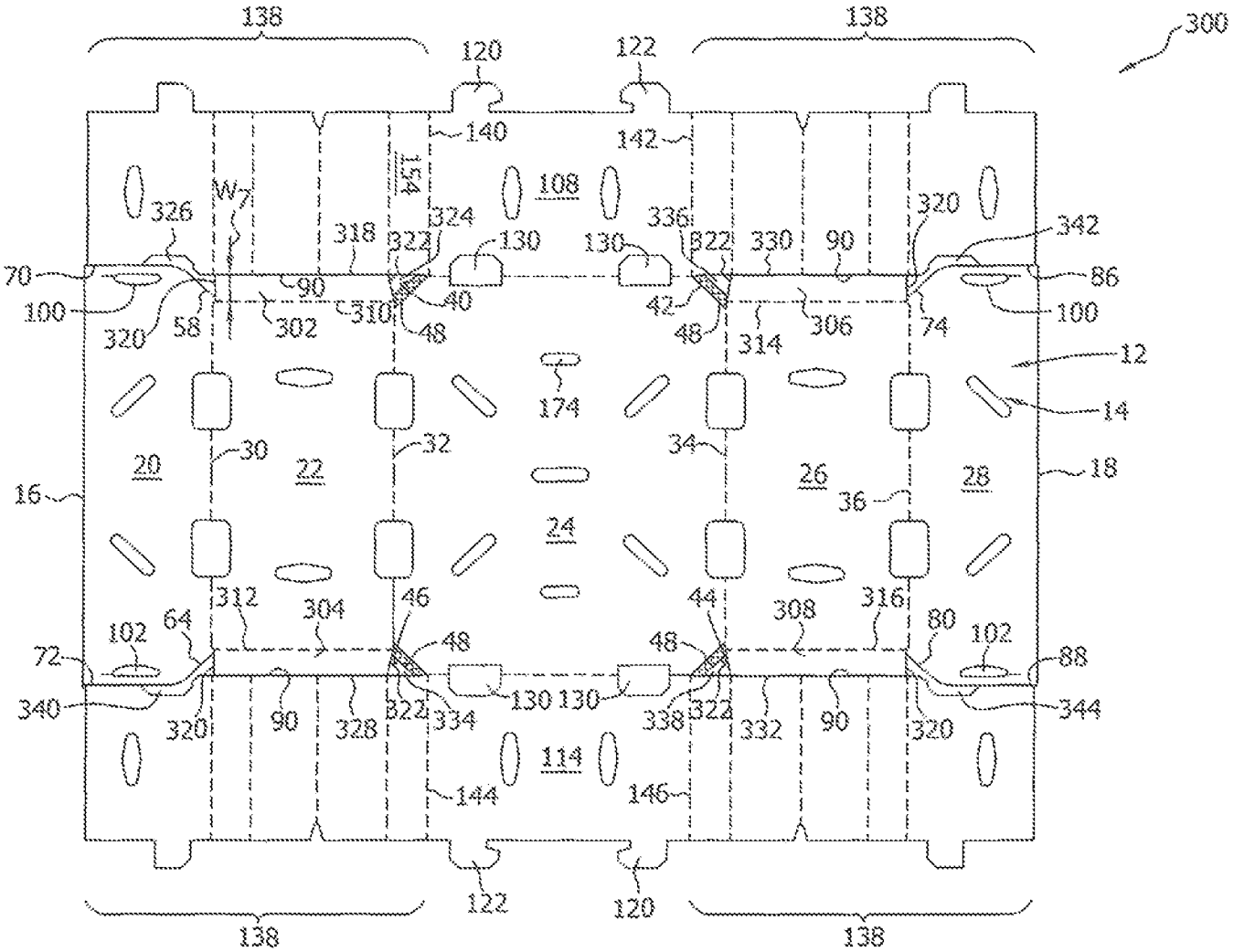
FIG. 5 is a top plan view of a blank of sheet material for constructing a container according to a first alternative embodiment of the present invention.

FIG. 5 is a top plan view of an example embodiment of a blank 300 of sheet material. Blank 300 is essentially similar to blank 10 (shown in FIG. 1) and, as such, similar components are labeled with similar references. More specifically, blank 300 includes outer reinforcing corner panels 302, 304, 306, and 308. Further, blank 300 includes fold lines 310, 312, 314, and 316 rather than free side edges 50, 52, 54, and 56.

In the exemplary embodiment, first outer reinforcing corner panel 302 extends from first side panel 22 along fold line 310 to a free edge 318. Fold line 310 and free edge 318 define end edges of first outer reinforcing corner panel 302, and fold line 310 defines an end edge of first side panel 22. First outer reinforcing corner panel 302 is substantially rectangular shaped having a top edge 320 and a bottom edge 322. Bottom edge 322, angled edge 40, and bottom edge 90 define a removable cutout 324, and top edge 320, edges 58 and 70, and bottom edge 90 define a removable cutout 326. Further, first outer reinforcing corner panel 302 has generally height $H_1$ such that first side panel 22 and first outer reinforcing corner panel 302 have a generally equal height. In the exemplary embodiment, first outer reinforcing corner panel 302 has a slightly tapered bottom edge 322 such that first outer reinforcing corner panel 302 is slightly shorter at free edge 318 than at fold line 310. Alternatively, outer reinforcing corner panel 302 has as substantially constant height without a tapered bottom edge 322. In the exemplary embodiment, top edge 320 is substantially collinear with fold line 30, which defines the top edge of first side panel 22, and bottom edge 322 is generally collinear with fold line 32. Further, first outer reinforcing corner panel 302 has a width $W_7$. Width $W_7$ is substantially equal to length $L_1$. Alternatively, width $W_7$ is less than length $L_1$.

Similarly, in the exemplary embodiment, second outer reinforcing corner panel 304 extends from first side panel 22 along fold line 312 to a free edge 328, third outer reinforcing corner panel 306 extends from second side panel 26 along fold line 314 to a free edge 330, and fourth outer reinforcing corner panel 308 extends from second side panel 26 along fold line 316 to a free edge 332. In the exemplary embodiment, second outer reinforcing corner panel 304, third outer reinforcing corner panel 306, and fourth outer reinforcing corner panel 308 are each substantially rectangular and have generally height $H_1$ with taper bottom edge 322. Alternatively, outer reinforcing corner panel 304, 306, and/or 308 has as substantially constant height without a tapered bottom edge 322. In the exemplary embodiment, top edge 320 of second outer reinforcing corner panel 304 is substantially collinear with fold line 30, bottom edge 322 of second outer reinforcing corner panel 304 is generally collinear with fold line 32, top edge 320 of third outer reinforcing corner panel 306 is substantially collinear with fold line 36, bottom edge 322 of third outer reinforcing corner panel 306 is generally collinear with fold line 34, top edge 320 of fourth outer reinforcing corner panel 308 is substantially collinear with fold line 36, and bottom edge 322 of fourth outer reinforcing corner panel 308 is generally collinear with fold line 34.

Further, bottom edge 322 of second outer reinforcing corner panel 304, angled edge 46, and bottom edge 90 define a removable cutout 334; bottom edge 322 of third outer reinforcing corner panel 306, angled edge 42, and bottom edge 90 define a removable cutout 336; and bottom edge 322 of fourth outer reinforcing corner panel 308, angled edge 44, and bottom edge 90 define a removable cutout 338. Similarly, top edge 320 of second outer reinforcing corner panel 304, edges 64 and 72, and bottom edge 90 define a removable cutout 340; top edge 320 of third outer reinforcing corner panel 306, edges 74 and 86, and bottom edge 90 define a removable cutout 342; and top edge 320 of fourth outer reinforcing corner panel 308, edges 80 and 88, and bottom edge 90 define a removable cutout 344.

Moreover, second outer reinforcing corner panel 304, third outer reinforcing corner panel 306, and fourth outer reinforcing corner panel 308 each have width $W_7$. Alternatively, outer reinforcing corner panels 302, 304, 306, and/or 308 may have any suitable dimensions that enable blank 10 to function as described herein. In the exemplary embodiment, outer reinforcing corner panels 304, 306, and 308 have substantially constant width $W_7$ from top edges 320 to bottom edges 322 such that outer reinforcing corner panels 304, 306, and 308 do not include cutoff corners and/or tapered top and/or bottom edges. Further, second, third, and fourth outer reinforcing corner panels 304, 306, and 308 are substantially congruent to first corner panel 302. Alternatively, corner panels 302, 304, 306, and/or 308 are other than congruent to each other.

Figure 6:
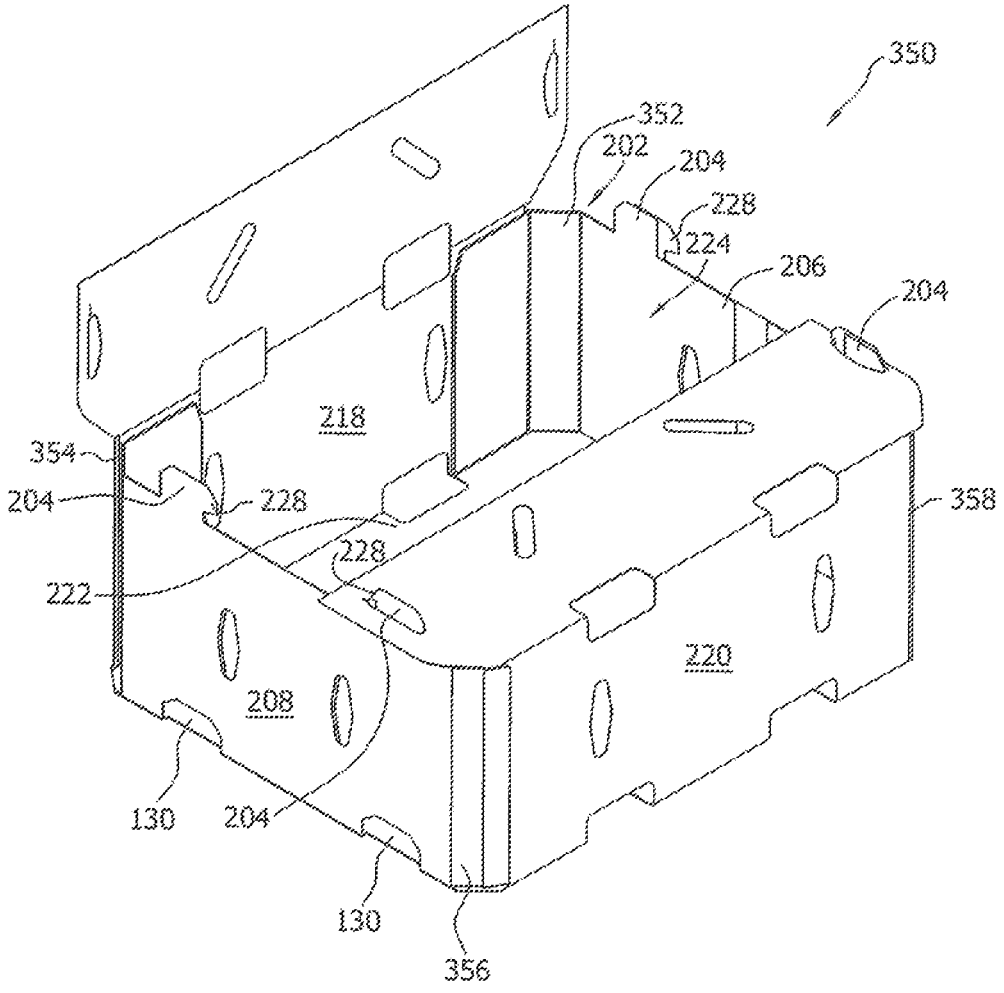
FIG. 6 is a perspective view of a container formed from the blank shown in FIG. 5.

FIG. 6 is a perspective view of container 350 that is formed from blank 300 (shown in FIG. 5). Container 350 is essentially similar to container 200 (shown in FIG. 2) and, as such, similar components are labeled with similar references. Although container 350 is shown as being formed without a product to be contained therein, container 350 may also be formed having a product therein. Further, container 350 may include any suitable number of products of any suitable shape.

To construct container 350 from blank 300 a method that is substantially similar to the method for forming container 200 from blank 10 is used. However, to construct container 350, first outer reinforcing corner panel 302 is rotated about fold line 310 toward interior surface 12 and secured to exterior surface 14 of corner panel 154 extending from fold line 140 of first end panel 108. More specifically, first outer reinforcing corner panel 302 is rotated such that first outer reinforcing corner panel 302 is oriented at oblique angle $\alpha 1$ to first side wall 218. Similarly, second outer reinforcing corner panel 304 is rotated about fold line 312 toward interior surface 12 and secured to exterior surface 14 of corner panel 154 extending from fold line 144 of second end panel 114. More specifically, second outer reinforcing corner panel 304 is rotated such that second outer reinforcing corner panel 304 is oriented at oblique angle $\beta 1$ to first side wall 218.

In the exemplary embodiment, free edge 318 of first outer reinforcing corner panel 302 is substantially aligned with fold line 140, and free edge 328 of second outer reinforcing corner panel 304 is substantially aligned with fold line 144. Alternatively, first outer reinforcing corner panel 302 and/or second outer reinforcing corner panel 304 only partially overlap corner panels 154 such that free edges 318 and/or 328 are offset from fold lines 140 and/or 144, respectively. First outer reinforcing corner panel 302 forms a portion of first corner wall 352, and second outer reinforcing corner panel 304 forms a portion of second corner wall 354.

Third outer reinforcing corner panel 306 is rotated about fold line 314 toward interior surface 12 and secured to exterior surface 14 of corner panel 154 extending from fold line 142 of first end panel 108. More specifically, third outer reinforcing corner panel 306 is rotated such that third outer reinforcing corner panel 306 is oriented at oblique angle $\gamma 1$ to second side wall 220. Similarly, fourth outer reinforcing corner panel 308 is rotated about fold line 316 toward interior surface 12 and secured to exterior surface 14 of corner panel 154 extending from fold line 146 of second end panel 114. More specifically, fourth outer reinforcing corner panel 308 is rotated such that fourth outer reinforcing corner panel 308 is oriented at oblique angle $\delta 1$ to second side wall 220. In the exemplary embodiment, free edge 330 of third outer reinforcing corner panel 306 is substantially aligned with fold line 142 of first end panel 108, and free edge 332 of fourth outer reinforcing corner panel 308 is substantially aligned with fold line 146 of second end panel 114. Alternatively, third outer reinforcing corner panel 306 and/or fourth outer reinforcing corner panel 308 only partially overlap corner panels 154 such that free edges 330 and/or 332 are offset from fold lines 142 and/or 146, respectively.

In the exemplary embodiment, third outer reinforcing corner panel 306 forms a portion of third corner wall 356, and fourth outer reinforcing corner panel 308 forms a portion of fourth corner wall 358. Although outer reinforcing corner panel 302, 304, 306, and 308 are described as being positioned against exterior surface 14 of corner panel 154, reinforcing corner panel 302, 304, 306, and/or 308 may be positioned within cavity 224 adjacent to exterior surface 14 of inner reinforcing corner panel 158, which defines an inner surface of the corner walls. Further, in the exemplary embodiment, crushed areas 48 facilitate formation of corner walls 352, 354, 356, and/or 358 by enabling outer reinforcing corner panels 302, 304, 306, and 308 to be rotated into position. Corner walls 352, 354, 356, and 358 each include three layers of panels, and corner walls 210, 212, 214, and 216 (shown in FIG. 2) each include two layers of panels.

Figure 7:
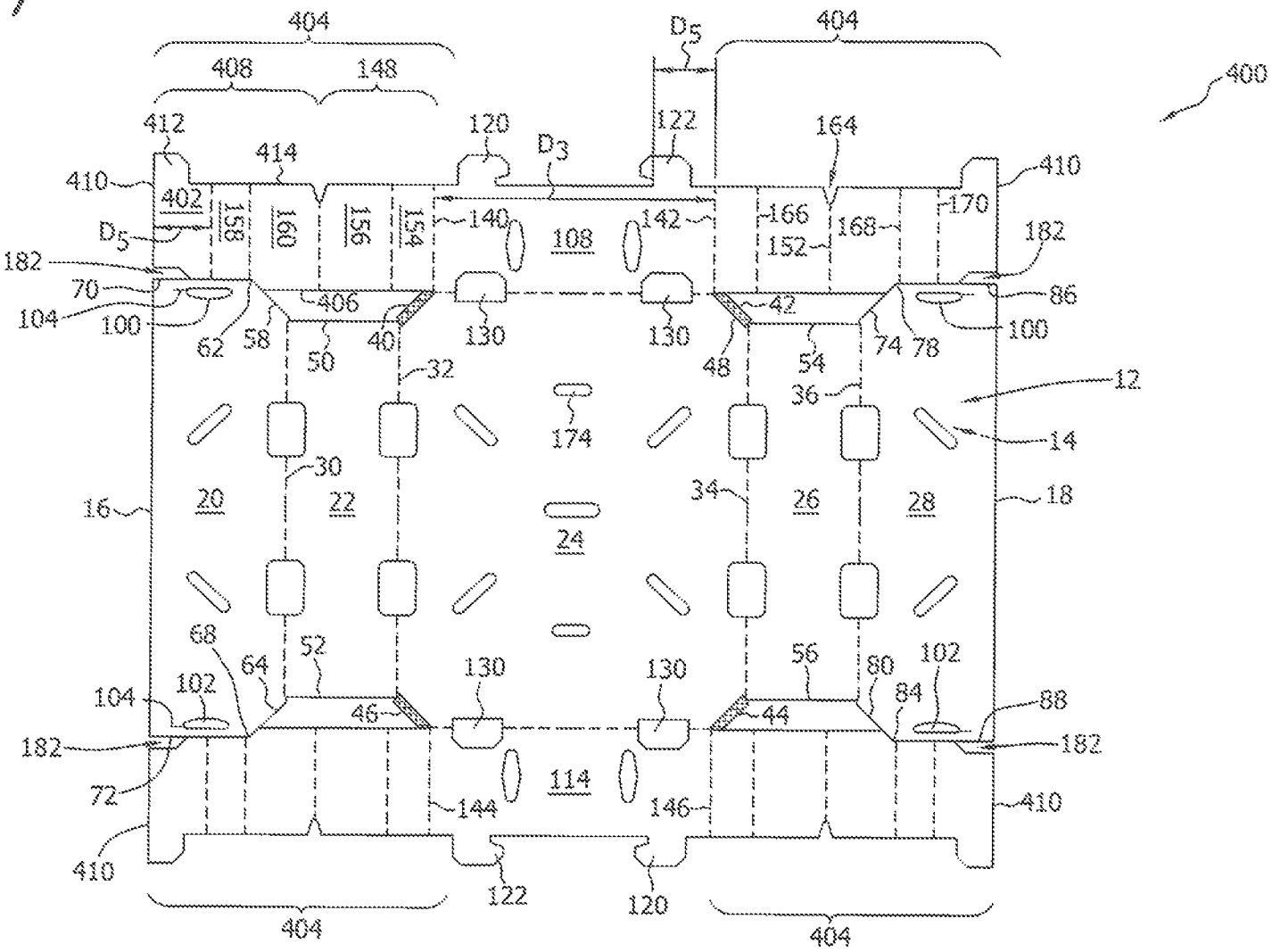
FIG. 7 is a top plan view of a blank of sheet material for constructing a container according to a second alternative embodiment of the present invention.

FIG. 7 is a top plan view of an example embodiment of a blank 400 of sheet material. Blank 400 is essentially similar to blank 10 (shown in FIG. 1) and, as such, similar components are labeled with similar references. In the exemplary embodiment, blank 400 is dimensioned differently than blank 10 such that inner end panels 402 have a depth $D_5$ that less than half of depth $D_3$ of end panels 108 and 114. As such, blank 400 includes reinforcing panel assembly 404 rather than reinforcing panel assembly 138 (shown in FIG. 1).

Reinforcing panel assembly 404 extends from side edges of each end panel 108 and 114 along fold lines 140, 142, 144, and 146. Each reinforcing panel assembly 404 includes a free bottom edge 406. Further, each reinforcing panel assembly 404 is substantially similar and includes outer reinforcing panel assembly 148 and an inner reinforcing panel assembly 408 connected to each other along fold line 152. Outer reinforcing panel assembly 148 includes corner panel 154 and first reinforcing side panel 156; and inner reinforcing panel assembly 408 includes inner reinforcing corner panel 158, second reinforcing side panel 160, and inner end panel 402. In the exemplary embodiment, each outer reinforcing panel assembly 148 includes fold line 166 that divides each outer reinforcing panel assembly 148 into corner panel 154 and first reinforcing side panel 156. Further, each inner reinforcing panel assembly 408 includes fold lines 168 and 170 that divide each inner reinforcing panel assembly 408 into second reinforcing side panel 160, inner reinforcing corner panel 158, and inner end panel 402. More specifically, second reinforcing side panel 160 extends from first reinforcing side panel 156 along fold line 152, inner reinforcing corner panel 158 extends from second reinforcing side panel 160 along fold line 168, and inner end panel 402 extends from inner reinforcing corner panel 158 along fold line 170 to a free edge 410.

Free edge 410 is generally co-linear with leading edge 16 or trailing edge 18; however, free edge 410 can have any suitable position with respect to leading edge 16 and/or trailing edge 18 that enables blank 400 and/or container 450 to function as described herein. In the exemplary embodiment, notch 182 is defined in inner end panel 402 along free edge 410 by bottom edge 406 and edge 70, 72, 86, or 88. Notch 182 is shaped to correspond to at least a portion of stacking slot 130 defined in end panel 108 and/or 114. As such, when a container 450 (shown in FIG. 8) is formed from blank 400, inner end panel 402 does not obstruct stacking slot 130, and a lower stacking tab 452 (shown in FIG. 8) can fit within an upper stacking slot 130.

In the exemplary embodiment, inner end panel 402 includes a minor stacking extension 412 extending from a top edge 414 thereof. Minor stacking extension 412 has a shape that at least partially corresponds to the shape of stacking extension 120 or 122 such that minor stacking extension 412 aligns with a respective stacking extension 120 or 122 to form a stacking tab 452. In the exemplary embodiment, minor stacking extension 412 is substantially similarly shaped to a respective stacking extension 120 or 122, except minor stacking extension 412 is defined by straight free edge 410. It should be understood that minor stacking extension 412 has any suitable shape and position that enables blank 400 and/or container 450 to function as described herein.

Each reinforcing panel assembly 404 is configured to form a reinforcing corner assembly 454 (shown in FIG. 8) when container 450 is formed from blank 400. Further, first top panel 20 is separated from adjacent reinforcing panel assemblies 404 by side edges 70 and 72, and second top panel 28 is separated from adjacent reinforcing panel assemblies 404 by side edges 86 and 88.

Figure 8:
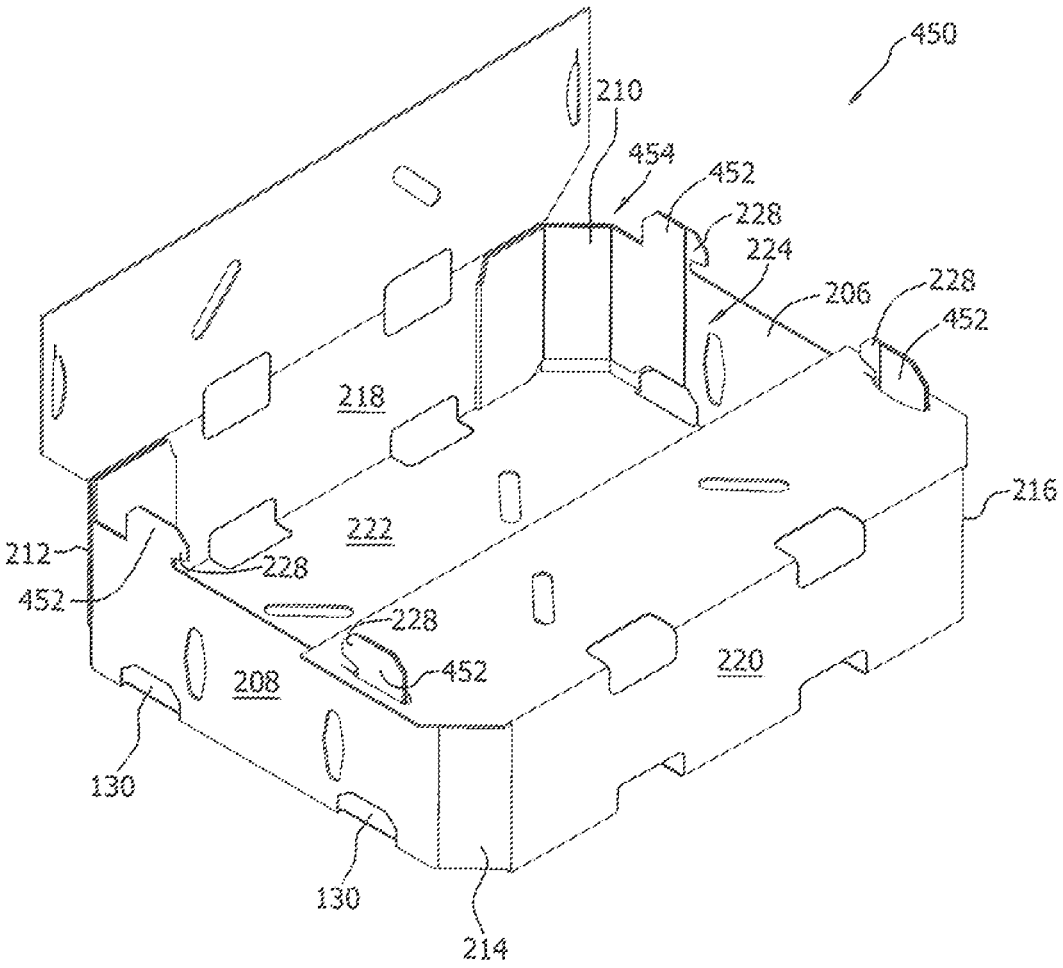
FIG. 8 is a perspective view of a container formed from the blank shown in FIG. 7.

FIG. 8 is a perspective view of container 450 that is formed from blank 400 (shown in FIG. 7). Container 450 is essentially similar to container 200 (shown in FIG. 2) and, as such, similar components are labeled with similar references. Although container 450 is shown as being formed without a product to be contained therein, container 450 may also be formed having a product therein. Further, container 450 may include any suitable number of products of any suitable shape. To construct container 450 from blank 400 a method that is substantially similar to the method for forming container 200 from blank 10 is used.

Figure 9:
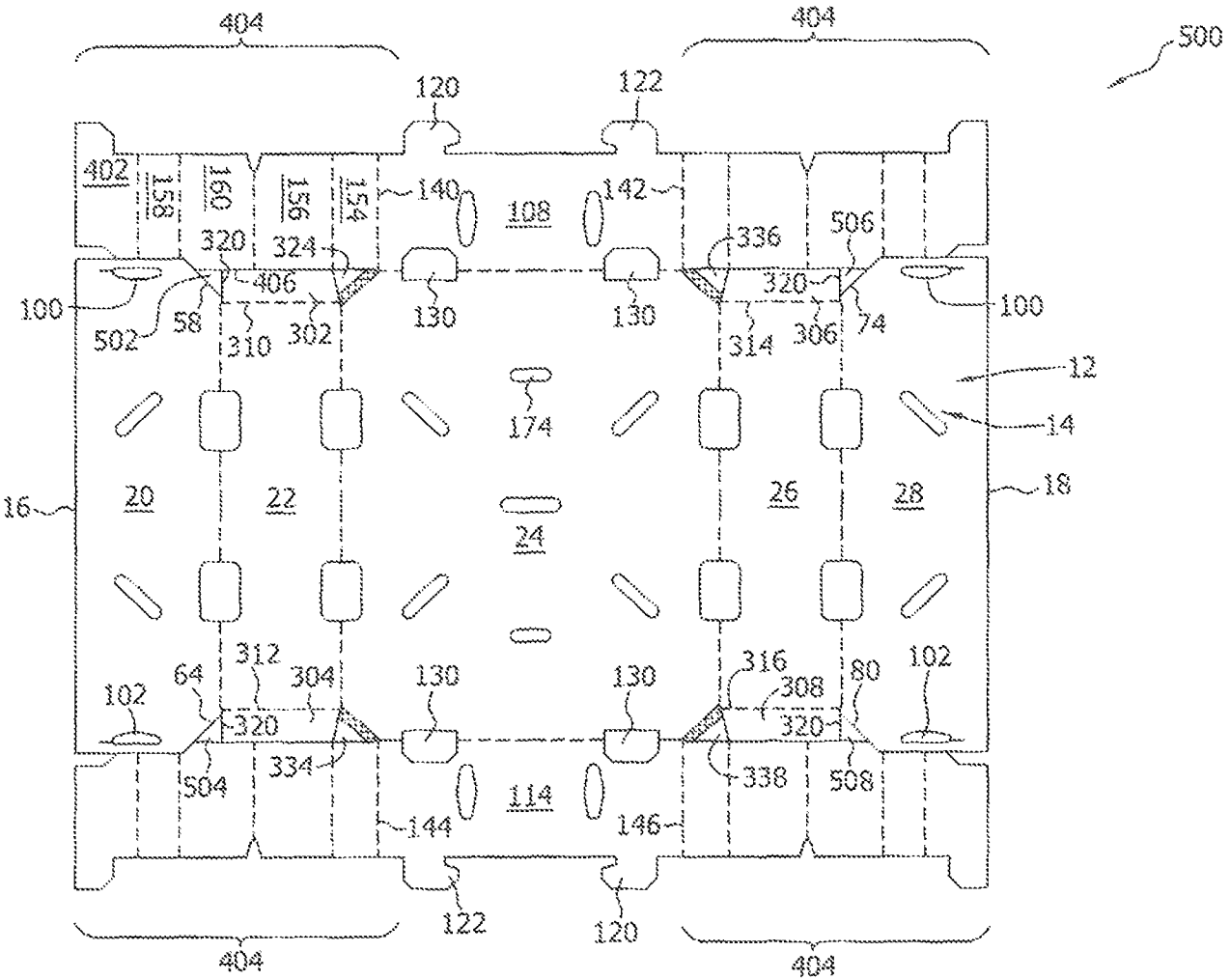
FIG. 9 is a top plan view of a blank of sheet material for constructing a container according to a third alternative embodiment of the present invention.

FIG. 9 is a top plan view of an example embodiment of a blank 500 of sheet material. Blank 500 is essentially similar to blank 300 (shown in FIG. 5) and blank 400 (shown in FIG. 7) and, as such, similar components are labeled with similar references. More specifically, blank 500 is similar to blank 400 and includes outer reinforcing corner panels 302, 304, 306, and 308, as shown and described with respect to FIG. 5. Further, blank 500 includes fold lines 310, 312, 314, and 316 rather than free side edges 50, 52, 54, and 56 (shown in FIG. 7), as shown and described with respect to FIG. 3.

In the exemplary embodiment, in addition to cutouts 324, 334, 336, and 338, blank 500 includes cutouts 502, 504, 506, and 508. More specifically, angled edge 58, top edge 320, and bottom edge 406 define a first cutout 502; angled edge 64, top edge 320, and bottom edge 406 define a second cutout 504; angled edge 74, top edge 320, and bottom edge 406 define a third cutout 506; and angled edge 80, top edge 320, and bottom edge 406 define a fourth cutout 508.

Figure 10:
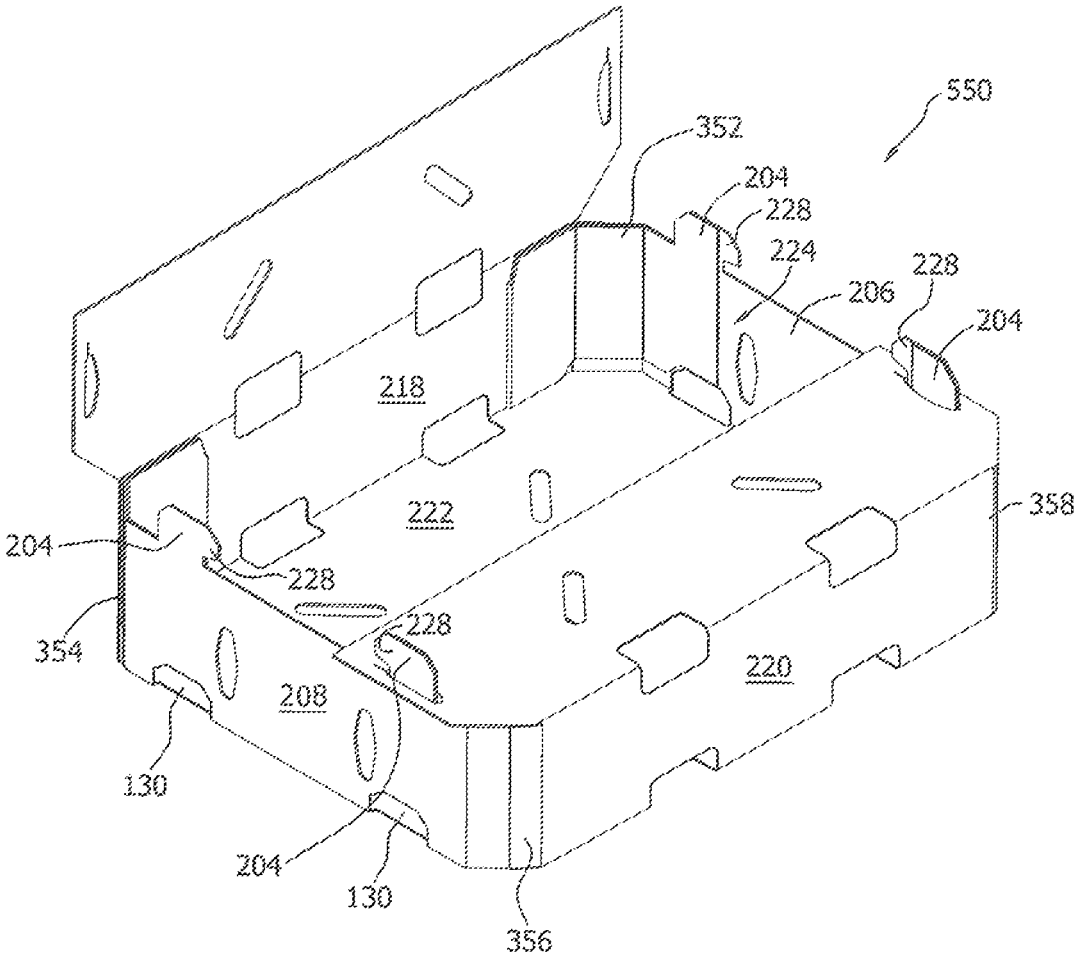
FIG. 10 is a perspective view of a container that is partially formed from the blank shown in FIG. 9.

FIG. 10 is a perspective view of a container 550 that is partially formed from blank 500 (shown in FIG. 9). Container 550 is essentially similar to container 350 (shown in FIG. 6) and container 450 (shown in FIG. 8) and, as such, similar components are labeled with similar references. Although container 550 is shown as being formed without a product to be contained therein, container 550 may also be formed having a product therein. Further, container 550 may include any suitable number of products of any suitable shape. To construct container 550 from blank 500 a method that is substantially similar to the method for forming container 350 from blank 300 and forming container 450 from blank 400 is used.

Figure 11:
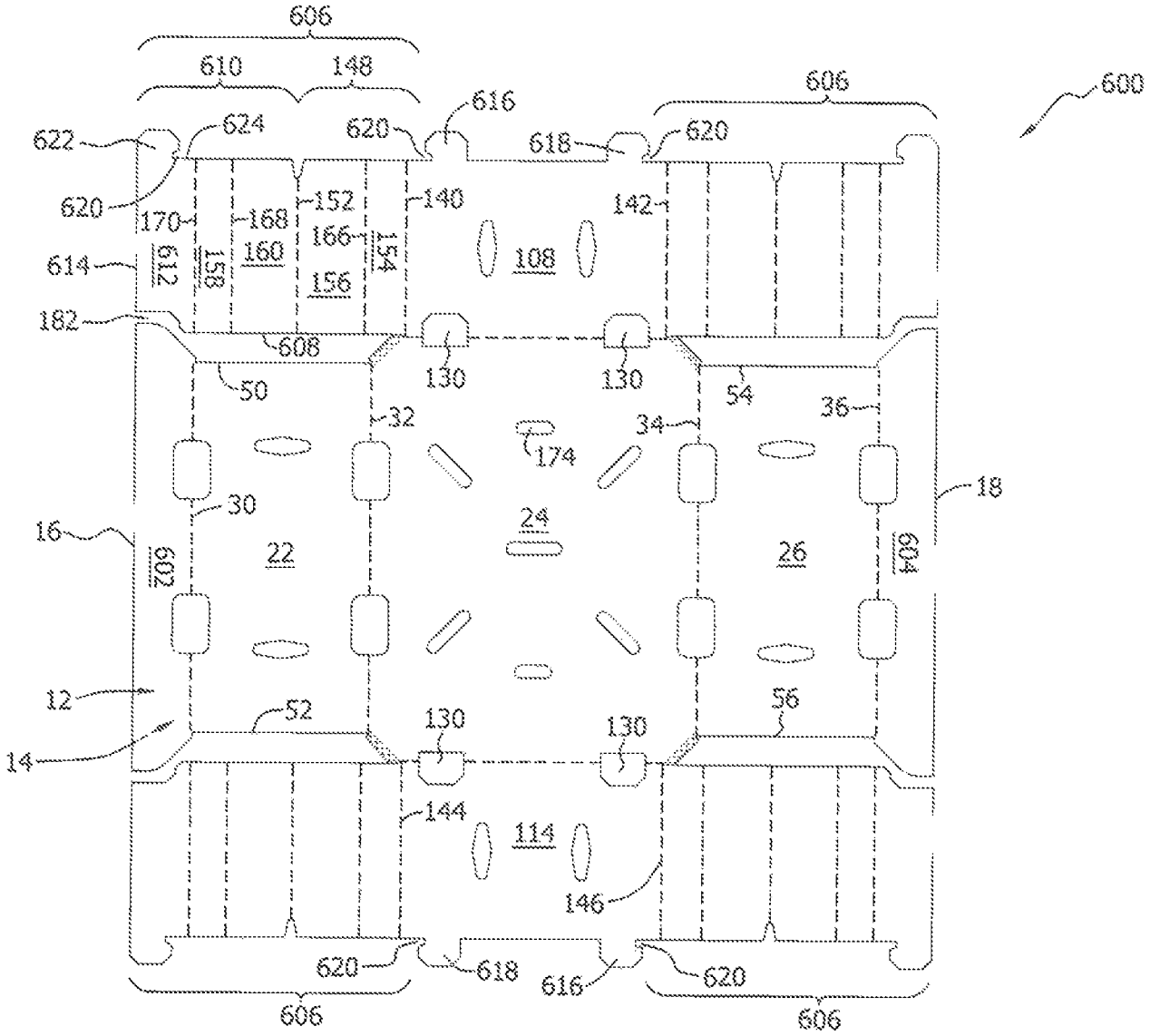
FIG. 11 is a top plan view of a blank of sheet material for constructing a container according to a fourth alternative embodiment of the present invention.

FIG. 11 is a top plan view of a blank 600 of sheet material for constructing a container according to a fourth alternative embodiment of the present invention. Blank 600 is essentially similar to blank 10 (shown in FIG. 1) and, as such, similar components are labeled with similar references. In the exemplary embodiment, blank 600 includes top shoulder panels 602 and 604 rather than top panels 20 and 28 (shown in FIG. 1). As such, blank 600 includes reinforcing panel assemblies 606 rather than reinforcing panel assemblies 138 (shown in FIG. 1).

A reinforcing panel assembly 606 extends from side edges of each end panel 108 and 114 along fold lines 140, 142, 144, and 146. Each reinforcing panel assembly 606 includes a free bottom edge 608. Further, each reinforcing panel assembly 606 is substantially similar and includes outer reinforcing panel assembly 148 and an inner reinforcing panel assembly 610 connected to each other along fold line 152. Outer reinforcing panel assembly 148 includes corner panel 154 and first reinforcing side panel 156; and inner reinforcing panel assembly 610 includes inner reinforcing corner panel 158, second reinforcing side panel 160, and inner end panel 612. In the exemplary embodiment, each outer reinforcing panel assembly 148 includes fold line 166 that divides each outer reinforcing panel assembly 148 into corner panel 154 and first reinforcing side panel 156. Further, each inner reinforcing panel assembly 610 includes fold lines 168 and 170 that divide each inner reinforcing panel assembly 610 into second reinforcing side panel 160, inner reinforcing corner panel 158, and inner end panel 612. More specifically, second reinforcing side panel 160 extends from first reinforcing side panel 156 along fold line 152, inner reinforcing corner panel 158 extends from second reinforcing side panel 160 along fold line 168, and inner end panel 612 extends from inner reinforcing corner panel 158 along fold line 170 to a free edge 614.

Free edge 614 is generally co-linear with leading edge 16 or trailing edge 18; however, free edge 614 can have any suitable position with respect to leading edge 16 and/or trailing edge 18 that enables blank 600 and/or container 650 (shown in FIG. 12) to function as described herein. In the exemplary embodiment, notch 182 is defined in inner end panel 612 along bottom edge 608. Notch 182 is shaped to correspond to at least a portion of stacking slot 130 defined in end panel 108 and/or 114. As such, when container 650 is formed from blank 600, inner end panel 612 does not obstruct stacking slot 130, and a lower stacking tab 652 (shown in FIG. 12) can fit within an upper stacking slot 130.

In the exemplary embodiment, end panels 108 and 114 each include first stacking extensions 616 and 618 that are mirror images of stacking extensions 120 and 122 (shown in FIG. 1). More specifically, each first stacking extension 616 and 618 includes a notch 620 defined nearer a fold line 140, 142, 144, or 146 than a center of end panel 108 and/or 114. Further, in the exemplary embodiment, inner end panel 612 includes a second stacking extension 622 extending from a top edge 624 thereof. Second stacking extension 622 has a shape that corresponds to the shape of first stacking extension 616 or 618 such that second stacking extension 622 aligns with a respective first stacking extension 616 or 618 to form a stacking tab 652. In the exemplary embodiment, second stacking extension 622 is substantially similarly shaped to a respective first stacking extension 616 or 618 and includes notch 620. It should be understood that second stacking extension 622 has any suitable shape and position that enables blank 600 and/or container 650 to function as described herein.

Figure 12:
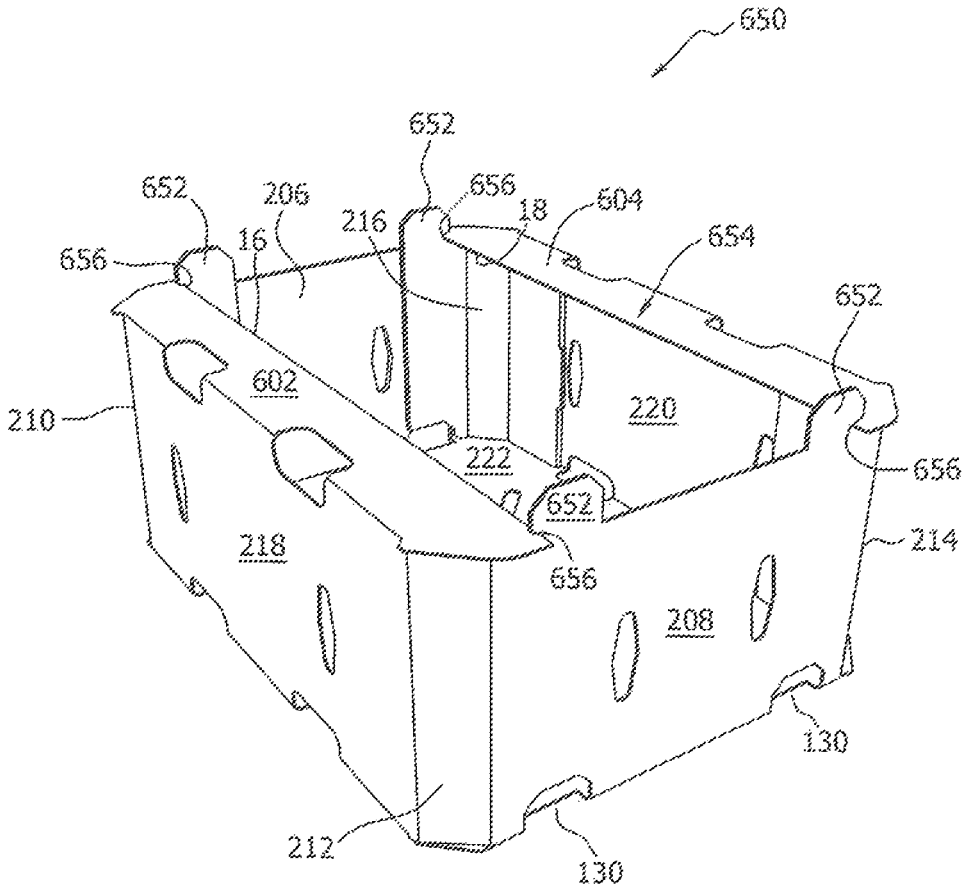
FIG. 12 is a perspective view of a container that is formed from the blank shown in FIG. 11.

FIG. 12 is a perspective view of container 650 that is formed from blank 600 (shown in FIG. 11) and is in a closed position. Container 650 is essentially similar to container 200 (shown in FIG. 2) and, as such, similar components are labeled with similar references. Container 650 may include any suitable number of products of any suitable shape. To construct container 650 from blank 600 a method that is substantially similar to the method for forming container 200 from blank 10 is used, except for forming a top wall 654. More specifically, top wall 654 is formed by rotating top shoulder panels 602 and 604 about respective fold lines 30 and 36. Leading edge 16 or trailing edge 18 is inserted into a notch 656 defined by each stacking tab 652. Notches 656 secure top shoulder panels 602 and 604 in position to form top wall 654.

Figure 13:
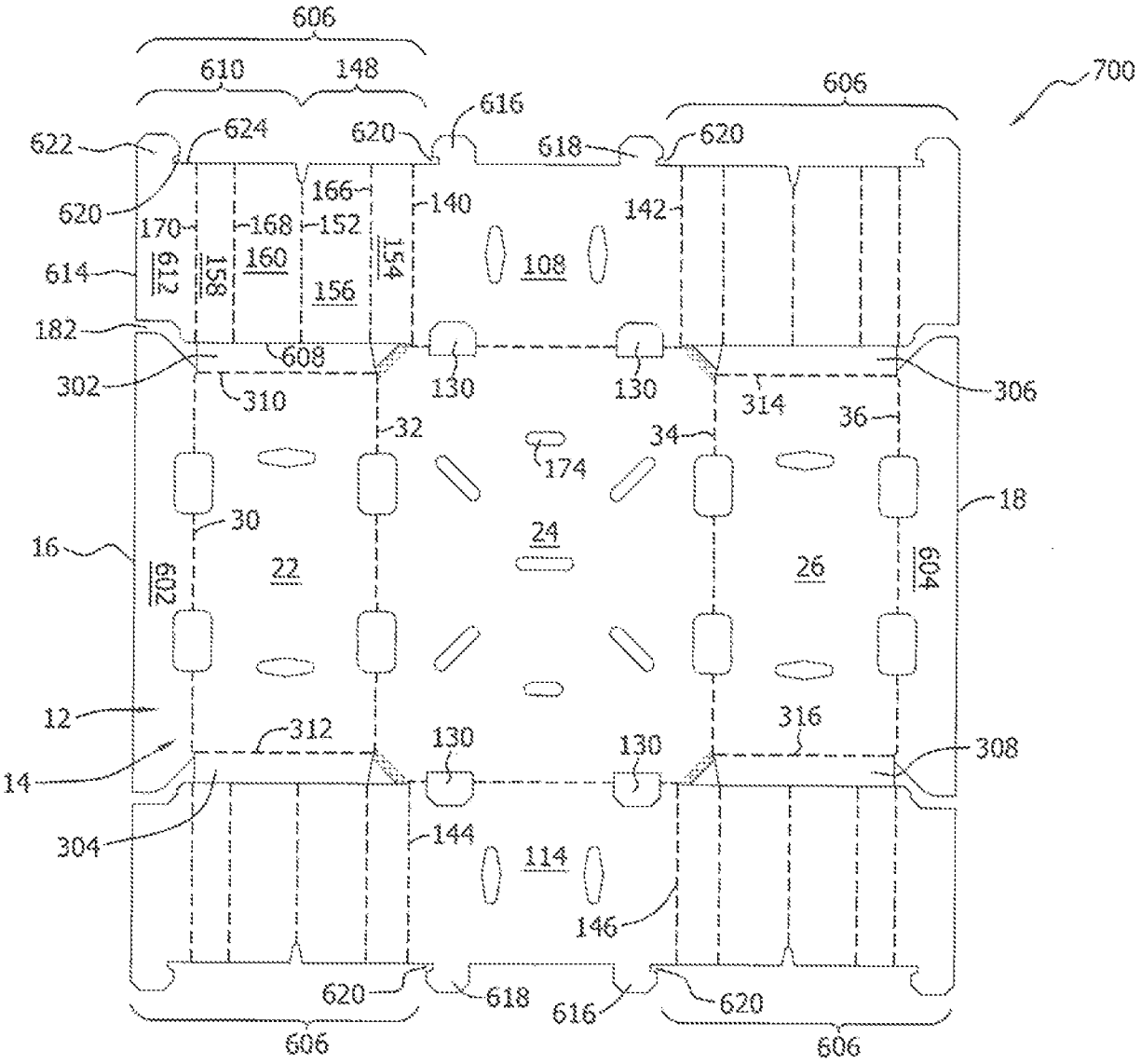
FIG. 13 is a top plan view of a blank of sheet material for constructing a container according to a fifth alternative embodiment of the present invention.

FIG. 13 is a top plan view of an example embodiment of a blank 700 of sheet material. Blank 700 is essentially similar to blank 300 (shown in FIG. 5) and blank 600 (shown in FIG. 11) and, as such, similar components are labeled with similar references. More specifically, blank 700 is similar to blank 600 and includes outer reinforcing corner panels 302, 304, 306, and 308, as shown and described with respect to FIG. 5. Further, blank 700 includes fold lines 310, 312, 314, and 316 rather than free side edges 50, 52, 54, and 56 (shown in FIG. 11), as shown and described with respect to FIG. 3.

Figure 14:
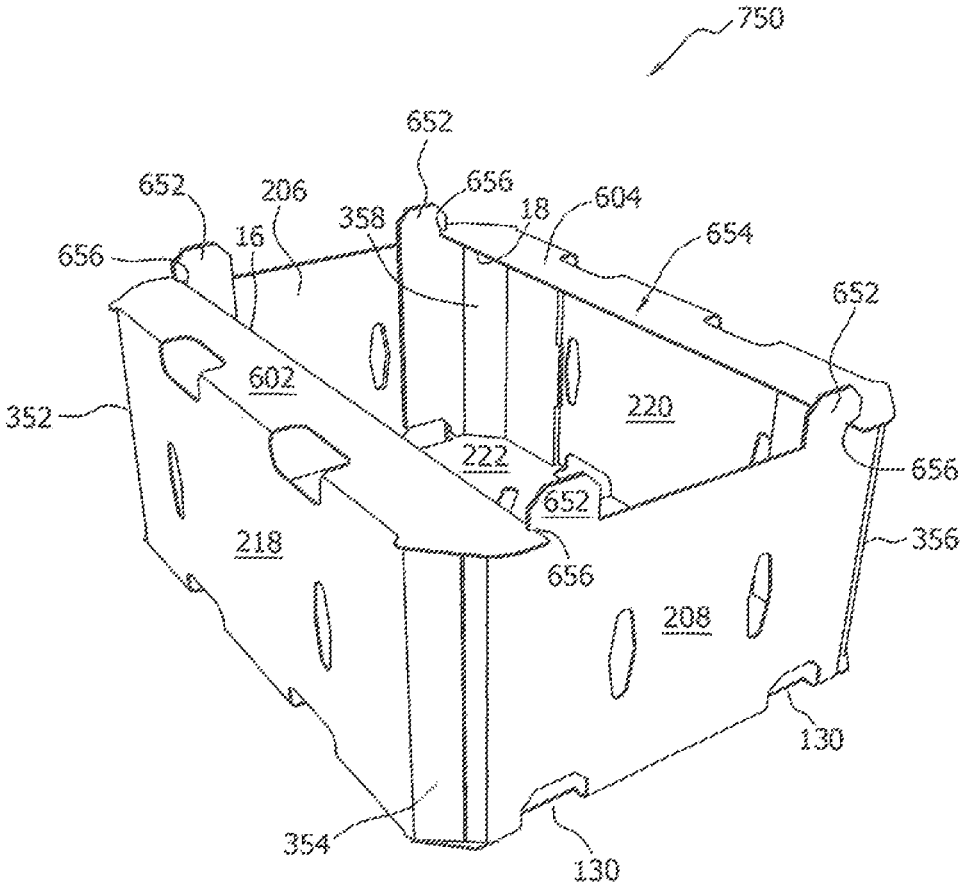
FIG. 14 is a perspective view of a container that is formed from the blank shown in FIG. 13.

FIG. 14 is a perspective view of a container 750 that is formed from blank 700 (shown in FIG. 13). Container 750 is essentially similar to container 350 (shown in FIG. 6) and container 650 (shown in FIG. 12) and, as such, similar components are labeled with similar references. Although container 750 is shown as being formed without a product to be contained therein, container 750 may also be formed having a product therein. Further, container 750 may include any suitable number of products of any suitable shape. To construct container 750 from blank 700 a method that is substantially similar to the method for forming container 350 from blank 300 and forming container 650 from blank 600 is used.

Figure 15:
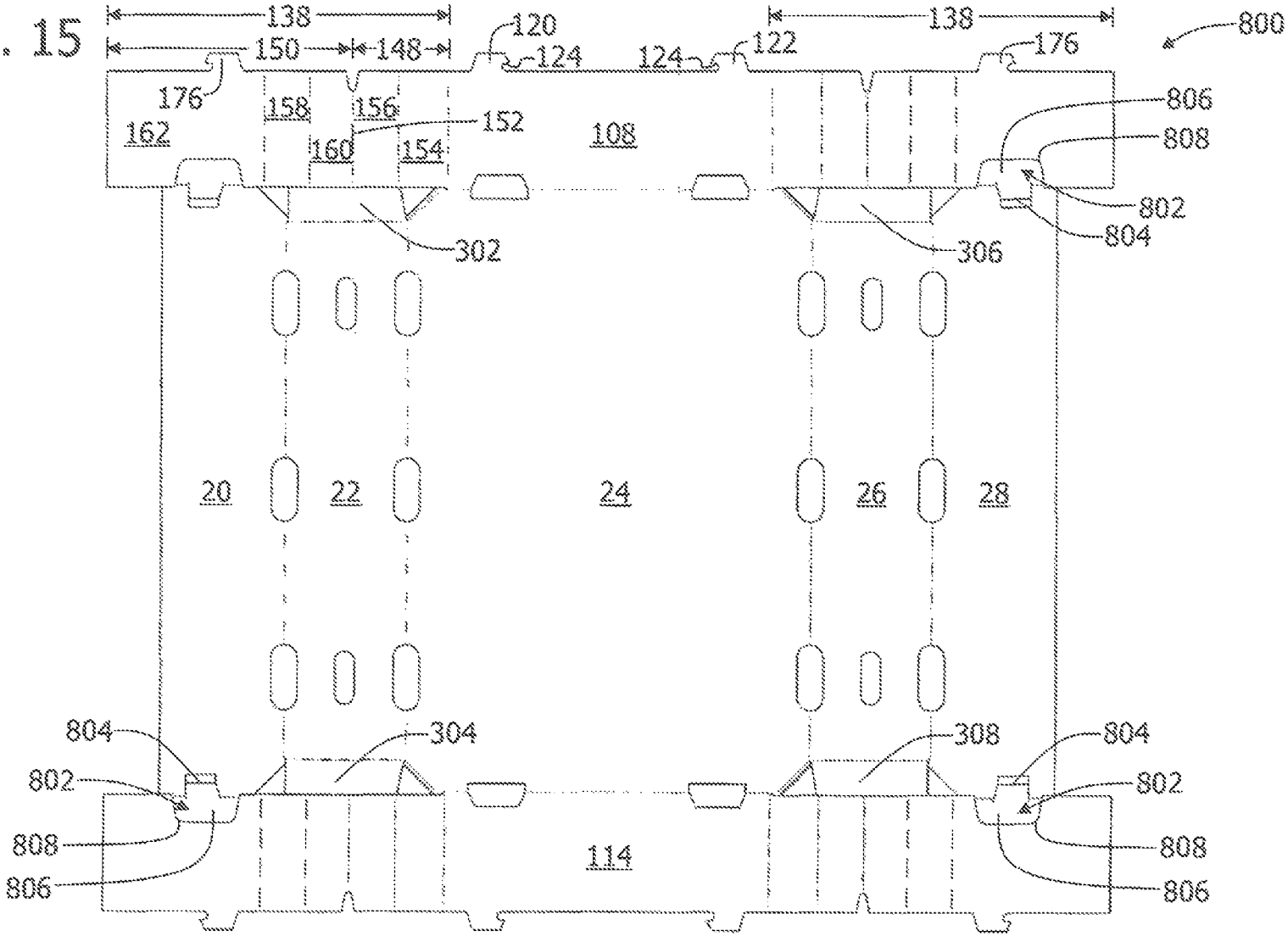
FIG. 15 is a top plan view of a blank of sheet material for constructing a container according to a sixth alternative embodiment of the present invention.

FIG. 15 is a top plan view of an example embodiment of a blank 800 of sheet material. Blank 800 is essentially similar to blank 300 (shown in FIG. 5) and, as such, similar components are labeled with similar references. More specifically, blank 800 includes outer reinforcing corner panels 302, 304, 306, and 308. Further, blank 800 includes fold lines 310, 312, 314, and 316. However, in an alternative embodiment (not shown), blank 800 may not include outer reinforcing corner panels 302, 304, 306, and 308.

In the exemplary embodiment, a reinforcing panel assembly 138 extends from side edges of each end panel 108 and 114. Each reinforcing panel assembly 138 is substantially similar and includes an outer reinforcing panel assembly 148 and an inner reinforcing panel assembly 150 connected to each other along a fold line 152. Fold line 152 defines a side edge of outer reinforcing panel assembly 148 and a side edge of inner reinforcing panel assembly 150. Moreover, outer reinforcing panel assembly 148 includes a corner panel 154 and a first reinforcing side panel 156; and inner reinforcing panel assembly 150 includes an inner reinforcing corner panel 158, a second reinforcing side panel 160, and an inner end panel 162. Each reinforcing panel assembly 138 is configured to form a reinforcing corner assembly.

Each end panel 108 and 114 includes a pair of mirror image stacking extensions 120 and 122. Each stacking extension 120 and 122 defines a notch 124. Notch 124 is sized to receive a portion of top panel 20 or 28 when container 850 (shown in FIG. 16) is closed, as described in more detail below. Further, in the exemplary embodiment, bottom panel 24 includes stacking slots configured to receive the stacking tabs of an adjacent container when the containers are stacked as shown in FIG. 4.

In the exemplary embodiment, inner end panel 162 includes a minor stacking extension 176 extending from a top edge 178 thereof. Minor stacking extension 176 has a shape that corresponds to the shape of stacking extension 120 or 122 such that minor stacking extension 176 aligns with a respective stacking extension 120 or 122 to form a stacking tab 204 when inner reinforcing panel assembly 150 is folded onto outer reinforcing panel assembly 148 and end panel 108 or 114. In the exemplary embodiment, minor stacking extension 176 is substantially similarly shaped to a respective stacking extension 120 or 122 and includes a similar notch.

In the exemplary embodiment, first top panel 20 and second top panel 28 each include a pair of locking assemblies 802 positioned at each end of the top panels. Each locking assembly 802 includes a locking slot 804 and a rotatable locking panel 806. Locking panels 806 are partially defined by a cut-line 808 that borders inner end panel 162. Thus, each inner end panel 162 includes a removed portion, which partially defines locking panel 806 and corresponds with stacking slot 130 to further facilitate stacking of multiple containers. In operation, after side walls 218, 220 and end walls 206, 208 are formed with the reinforcing corner assemblies, top panels 20 and 28 are rotated downwardly to a position that is substantially parallel to bottom panel 24. Locking panels 806 are rotated downwardly such that locking panels 806 are adjacent to (i.e., in a face-to-face relationship) an external surface of end panels 108 or 114. By rotating locking panels 806 downwardly, each locking slot 804 is increased in size and receives stacking tab 204. Each stacking tab 204, with the help of notches 124, is configured to receive a portion of top panel 20 or 28 when container 850 is closed. Thus, stacking tabs 204 are used to help hold or lock top panels 20 and 28 in the closed position. In addition, when stacking tabs 204 are inserted into locking slots 804, stacking tabs 204 are adjacent to locking panels 806 such that locking panels 806 are held in the rotated position. In the rotated position, each locking panel 806 is adjacent to an external surface of end panel 108 or 114, and is adjacent to respective stacking tab 204. The respective stacking tab 204 maintains or holds locking panel 806 in the rotated position.

Figure 16:
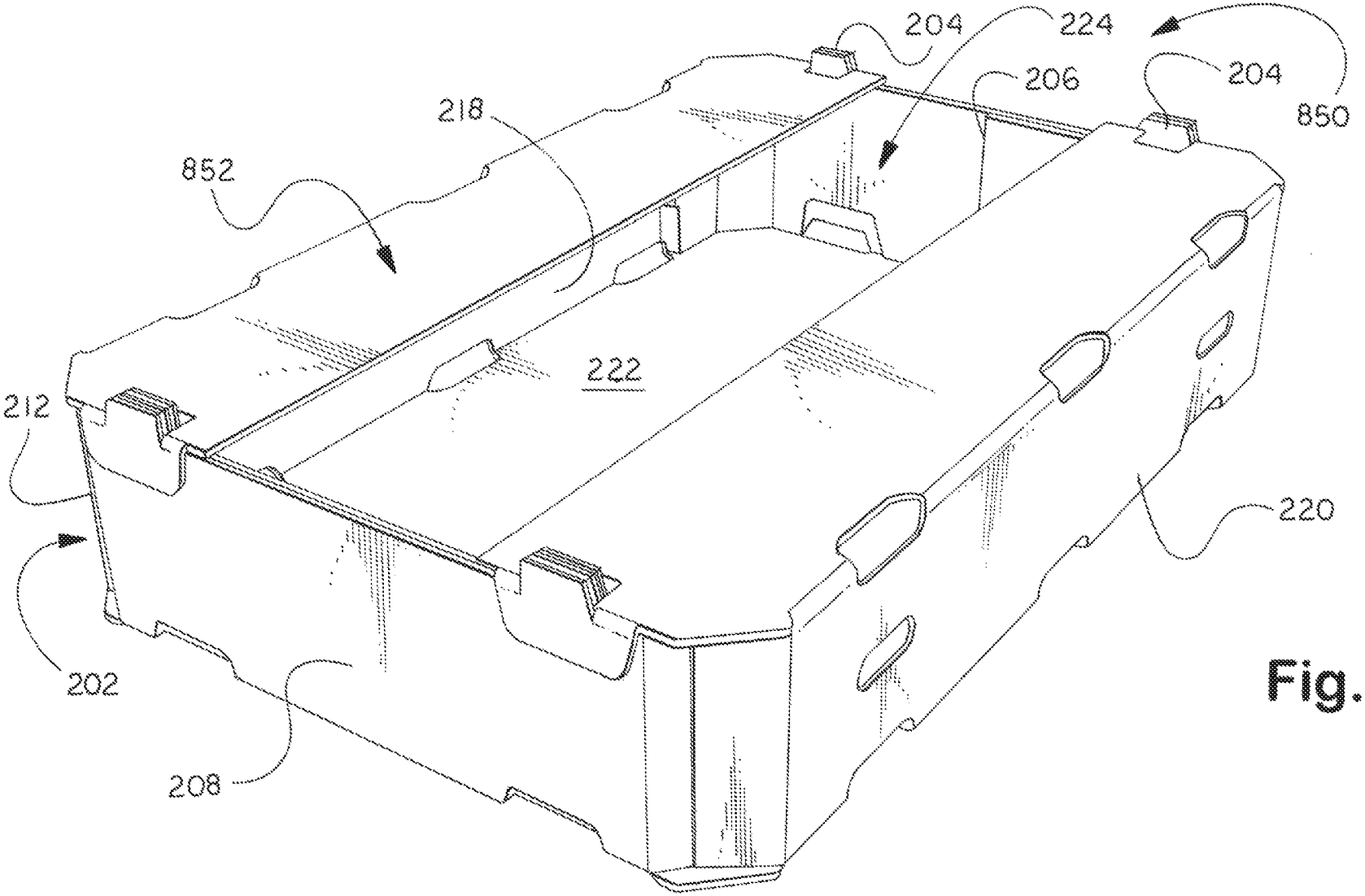
FIG. 16 is a perspective view of a container that is formed from the blank shown in FIG. 15.

FIG. 16 is a perspective view of container 850 that is formed from blank 800 (shown in FIG. 15). Container 850 is essentially similar to container 350 (shown in FIG. 6) and, as such, similar components are labeled with similar references. Although container 850 is shown as being formed without a product being contained therein, container 850 may also be formed having a product therein. Further, container 850 may include any suitable number of products of any suitable shape.

To construct container 850 from blank 800 a method that is substantially similar to the method for forming container 350 from blank 300 is used. For example, reinforcing corner assembly 202 is formed by corner panels 154 and 158, reinforcing side panels 156 and 160, and inner end panel 162. When reinforcing corner assemblies 202 are formed, minor stacking extension 176 aligns with a respective stacking extension 120 or 122 to form a stacking tab 204. First end panel 108 with a pair of inner end panels 162 forms a first end wall 206, and second end panel 114 with a pair of inner end panels 162 forms a second end wall 208. Each end wall 206 and 208 includes a pair of stacking tabs 204 extending from an upper edge thereof. Further, each pair of corner panels 154 and 158 forms one corner wall 210, 212, 214, or 216.

First side panel 22 is rotated about fold line 32 toward interior surface 12, and second side panel 26 is rotated about fold line 34 toward interior surface 12. More specifically, first side panel 22 and second side panel 26 are rotated to be substantially perpendicular to bottom panel 24. Interior surface 12 of first side panel 22 is secured to exterior surface 14 of two adjacent first reinforcing side panels 156, and interior surface 12 of second side panel 26 is secured to exterior surface 14 of two adjacent first reinforcing side panels 156. In the exemplary embodiment, first side panel 22 and second side panel 26 are adhered to respective first reinforcing side panels 156. In the exemplary embodiment, first side panel 22 and two pairs of reinforcing side panels 156 and 160 form a first side wall 218, and second side panel 26 and two pairs of reinforcing side panels 156 and 160 form a second side wall 220. Bottom panel 24 forms a bottom wall 222 of container 850, and bottom wall 222, side walls 218 and 220, end walls 206 and 208, and corner walls 210, 212, 214, and 216 define a cavity 224 of container 850.

To close container 850 and form a top wall 852, first top panel 20 is rotated about fold line 30 toward cavity 224 such that first top panel 20 is substantially perpendicular to first side panel 22 and substantially parallel to bottom panel 24. Further, second top panel 28 is rotated about fold line 36 toward cavity 224 such that second top panel 28 is substantially perpendicular to second side panel 26 and substantially parallel to bottom panel 24. With respect to blank 800, top panels 20 and 28 include locking assemblies 802.

As top panels 20 and 28 are rotated toward cavity 224, rotatable locking panels 806 are rotated downwardly to increase the size of each locking slot 804 such that a stacking tab 204 can be inserted into each locking slot 804. Stacking tabs 204 are configured to receive at least a portion of top panel 20 or 28 to hold top panel 20 or 28 in the closed position.

When locking panels 806 are rotated downwardly, locking panels 806 are adjacent to (i.e., in a face-to-face relationship) an external surface of end walls 206 or 208. In addition, when stacking tabs 204 are inserted into locking slots 804, stacking tabs 204 are adjacent to locking panels 806 such that locking panels 806 are held in the rotated position. The respective stacking tab 204 maintains or holds locking panel 806 in the rotated position.

Figure 17:
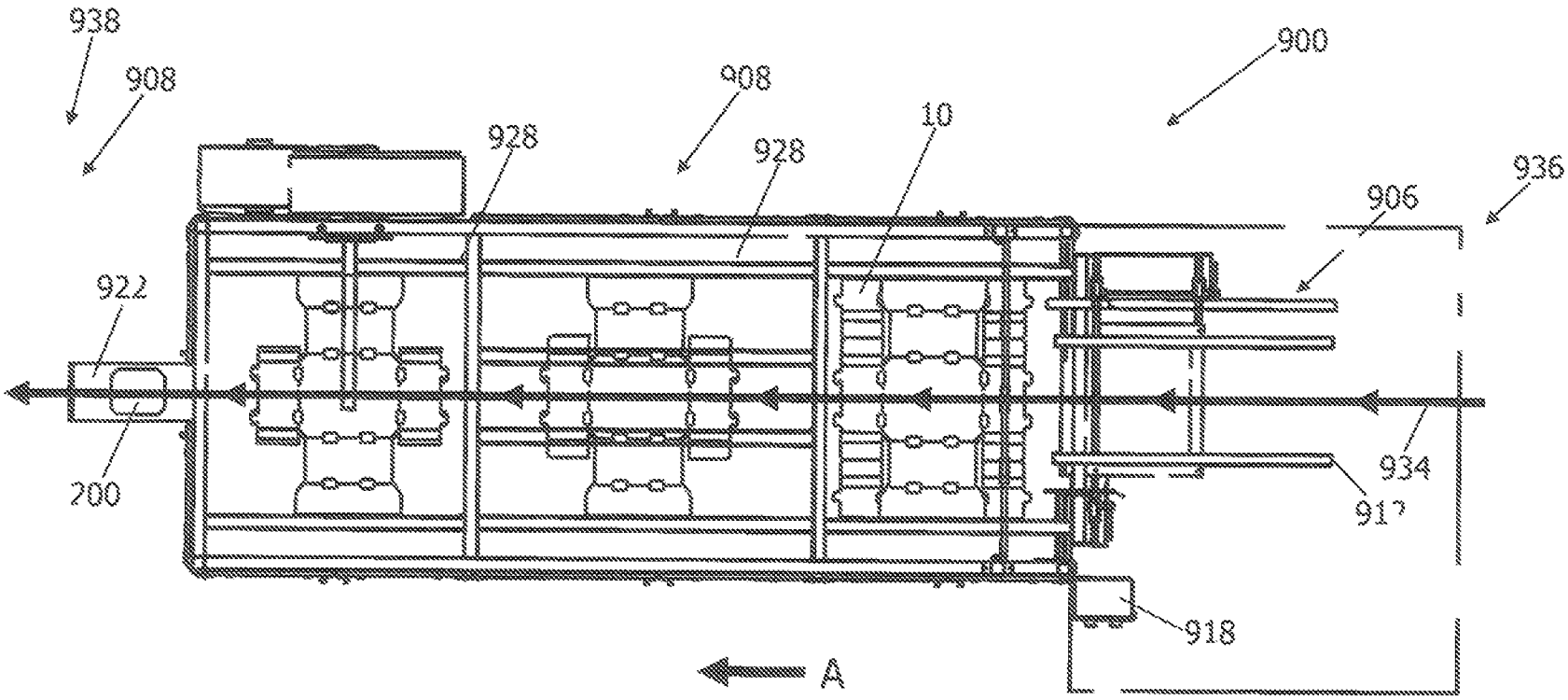
FIG. 17 is a top view of a machine for forming a container from a blank.
Figure 18:
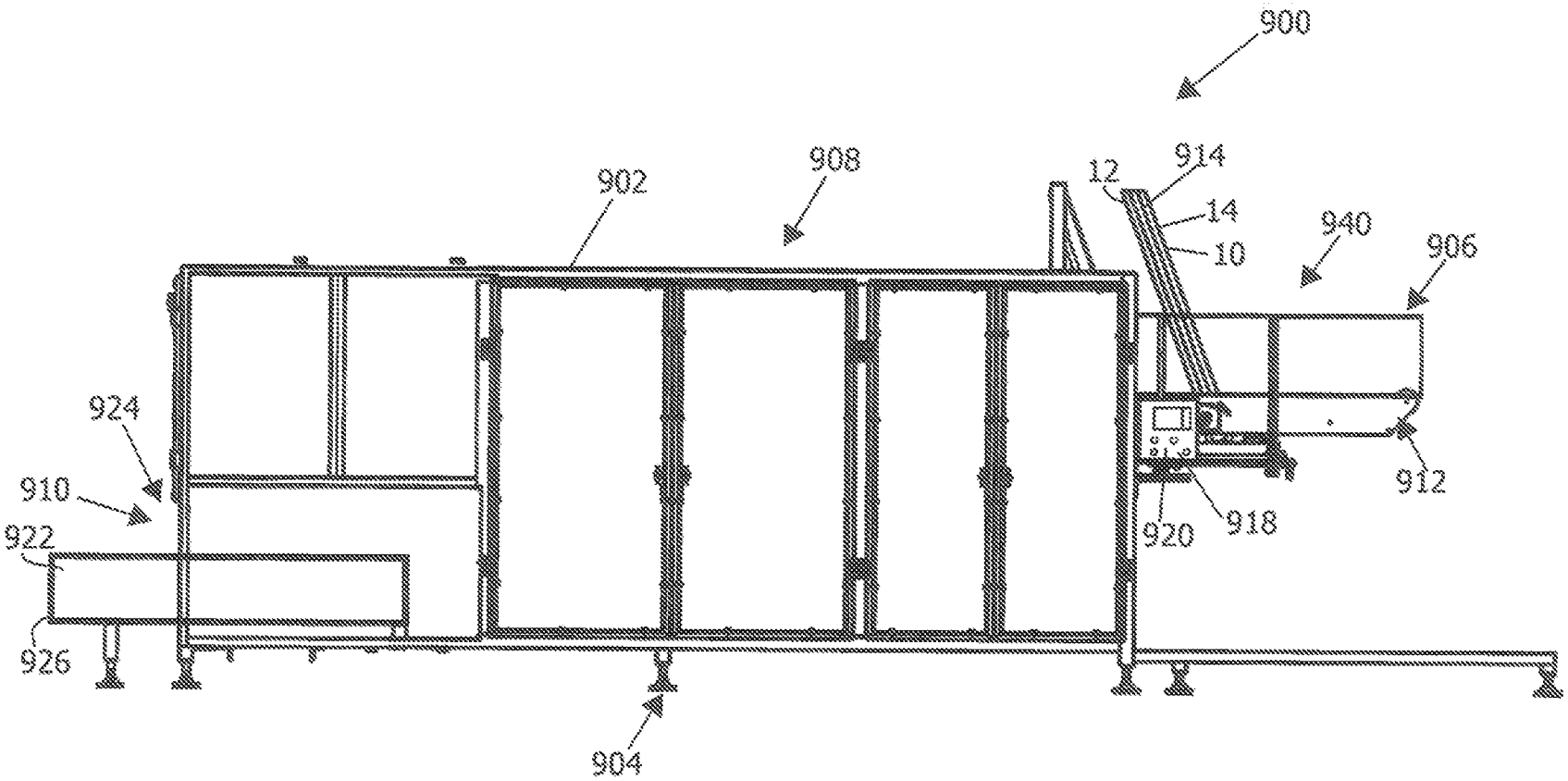
FIG. 18 is a side view of the machine shown in FIG. 17.

FIG. 17 is a top view of a machine 900 for forming a container from a blank. FIG. 18 is a side view of machine 900. Blank 10 and container 200 are illustrated as being formed using machine 900; however, it will be understood that any of the above-described blanks can be formed into a respective container using machine 900. As used herein, the terms "downward," "down," and variations thereof refer to a direction from a top 902 of machine 900 toward a surface or floor 904 on which machine 900 is supported, and the terms "upward," "up," and variations thereof refer to a direction from floor 904 on which machine 900 is supported toward top 902 of machine 900. Further, as used herein, "operational control communication" refers to a link, such as a conductor, a wire, and/or a data link, between two or more components of machine 900 that enables signals, electric currents, and/or commands to be communicated between the two or more components. The link is configured to enable one component to control an operation of another component of machine 900 using the communicated signals, electric currents, and/or commands.

In the exemplary embodiment, machine 900 includes a hopper station 906, a forming station 908, and an ejection station 910. More specifically, hopper station 906, forming station 908, and ejection station 910 are connected by a transport system 912, such as any suitable conveyor(s) and/or motorized device(s) configured to move blank 10 and/or container 200 through machine 900. In the exemplary embodiment, hopper station 906 is configured to store a stack 914 of blanks 10 in a substantially vertical orientation. More specifically, blanks 10 are stored with interior surface 12 facing in a downstream direction A of the machine 900 and exterior surface 14 facing away from the downstream direction A, or in an upstream direction.

Forming station 908 is generally aligned with and downstream of hopper station 906 and includes any suitable number and/or configuration of components, such as plows, arms, actuators, plungers and/or other devices for forming container 200 from blank 10. In the exemplary embodiment, components of forming station 908 are in communication with a control system 918. Control system 918 is configured to control and/or monitor components of forming station 908 to form container 200 from blank 10. In the exemplary embodiment, control system 918 includes computer-readable instructions for performing the methods described herein. In one embodiment, an operator can select which blank 10, 300, 400, 500, 600, 700, and/or 800 (shown in FIGS. 1, 5, 7, 9, 11, 13, and 15) is being manipulated by machine 900 using control system 918, and control system 918 performs the corresponding method using the components of forming station 908. Control system 918 is also configured to automatically adjust positions of arms, plows, and/or other devices described herein that are used for forming container 200. Thus, when a user selects a container for forming, machine 900 will automatically adjust its forming elements for the various containers.

In the exemplary embodiment, control system 918 is shown as being centralized within machine 900, however control system 918 may be a distributed system throughout machine 900, within a building housing machine 900, and/or at a remote control center. Control system 918 includes a processor 920 configured to perform the methods and/or steps described herein. Further, many of the other components described herein include a processor. As used herein, the term "processor" is not limited to integrated circuits referred to in the art as a processor, but broadly refers to a controller, a microcontroller, a microcomputer, a programmable logic controller (PLC), an application specific integrated circuit, and other programmable circuits, and these terms are used interchangeably herein. It should be understood that a processor and/or control system can also include memory, input channels, and/or output channels.

In the embodiments described herein, memory may include, without limitation, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, input channels may include, without limitation, sensors and/or computer peripherals associated with an operator interface, such as a mouse and a keyboard. Further, in the exemplary embodiment, output channels may include, without limitation, a control device, an operator interface monitor, and/or a display.

Processors described herein process information transmitted from a plurality of electrical and electronic devices that may include, without limitation, sensors, actuators, compressors, control systems, and/or monitoring devices. Such processors may be physically located in, for example, a control system, a sensor, a monitoring device, a desktop computer, a laptop computer, a PLC cabinet, and/or a distributed control system (DCS) cabinet. RAM and storage devices store and transfer information and instructions to be executed by the processor(s). RAM and storage devices can also be used to store and provide temporary variables, static (i.e., non-changing) information and instructions, or other intermediate information to the processors during execution of instructions by the processor(s). Instructions that are executed may include, without limitation, machine control commands. The execution of sequences of instructions is not limited to any specific combination of hardware circuitry and software instructions.

In the exemplary embodiment, ejection station 910 is configured to eject container 200 from forming station 908. More specifically, in the exemplary embodiment, ejection station 910 includes an exit conveyor 922 for conveying formed containers from an exit 924 of forming station 908 to an end 926 of exit conveyor 922. Exit conveyor 922 is part of transport system 912.

During operation of machine 900 to form container 200 from blank 10, stack 914 of blanks 10 is placed within hopper station 906. Transport system 912 removes one blank 10 from stack 914 and transfers blank 10 to forming station 908. Transport system 912 transfers blank 10 through the components of forming station 908. The components of forming station 908 perform the method for forming container 200 from blank 10. Within forming station 908, blank 10 is folded into a partially formed container 928. Partially formed container 928 is formed into container 200 within forming station 908, and a subsequent blank 10 is transferred from hopper station 906 into forming station 908. As such, containers 200 are formed continuously by machine 900. After container 200 is formed in forming station 908, transport system 912 transfers container 200 to ejection station 910 for ejection from machine 900.

Figure 19:
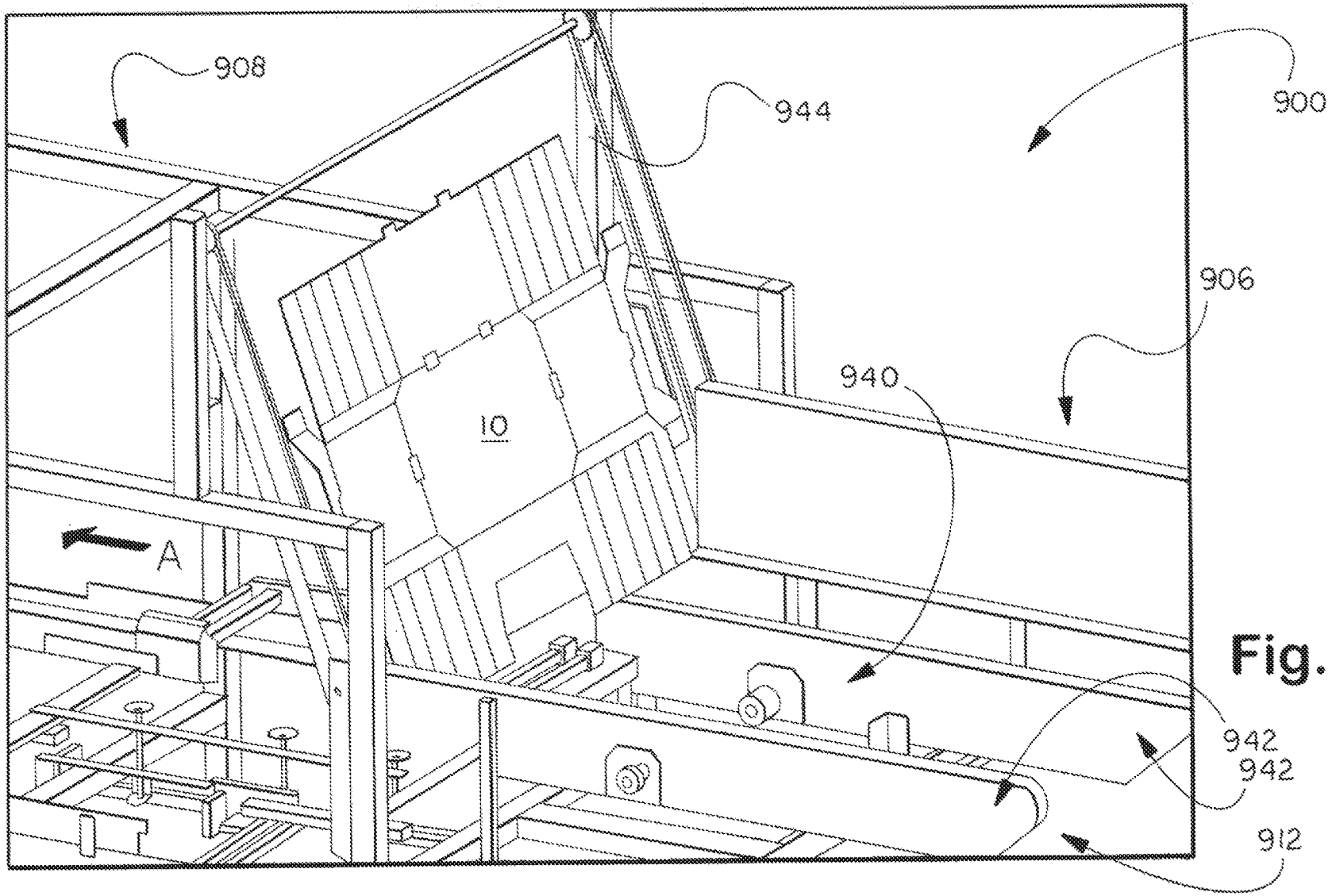
FIG. 19 is a perspective view of a hopper station of the machine shown in FIGS. 17 and 18.
Figure 20:
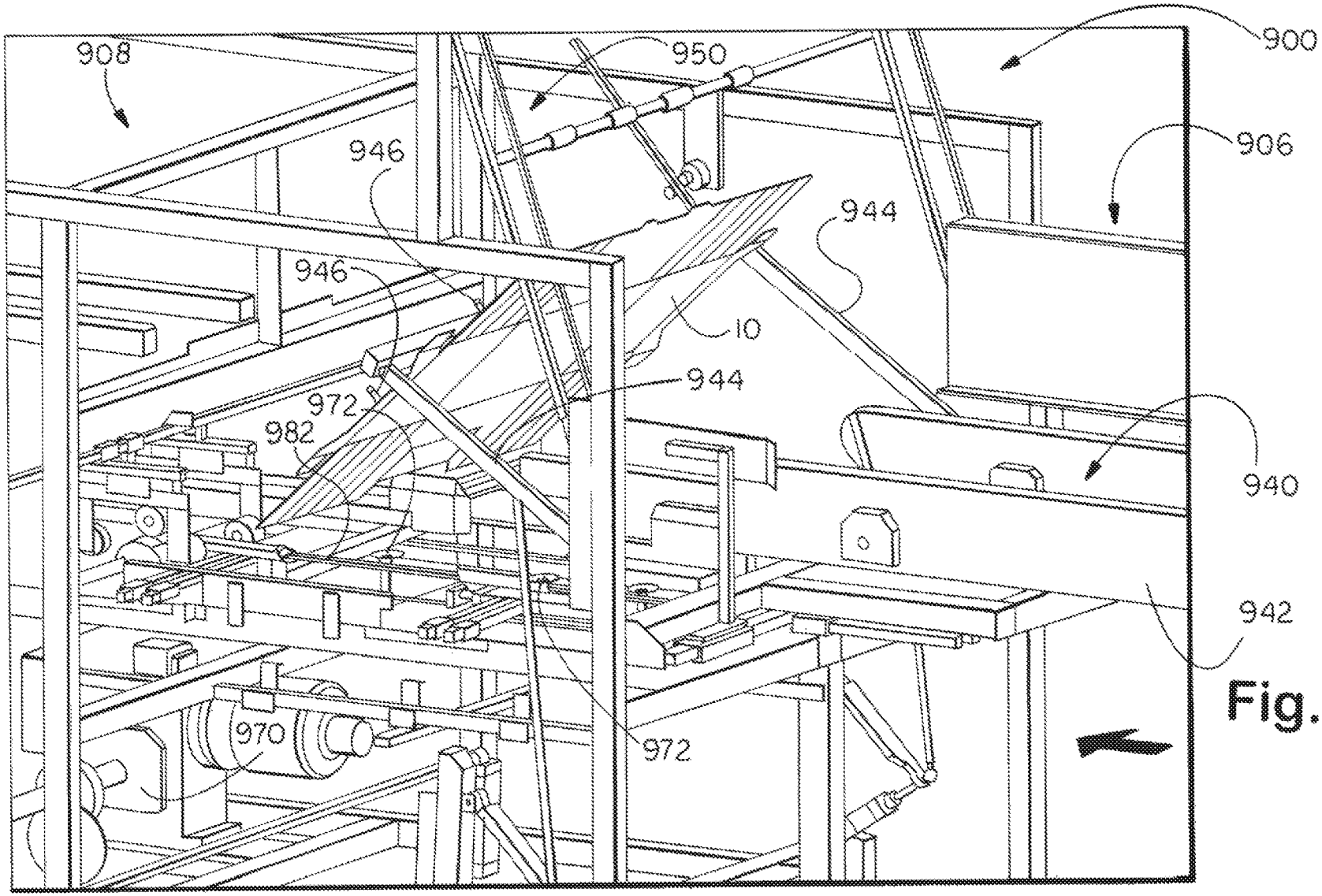
FIG. 20 is another perspective view of the hopper station shown in FIG. 19.
Figure 21:
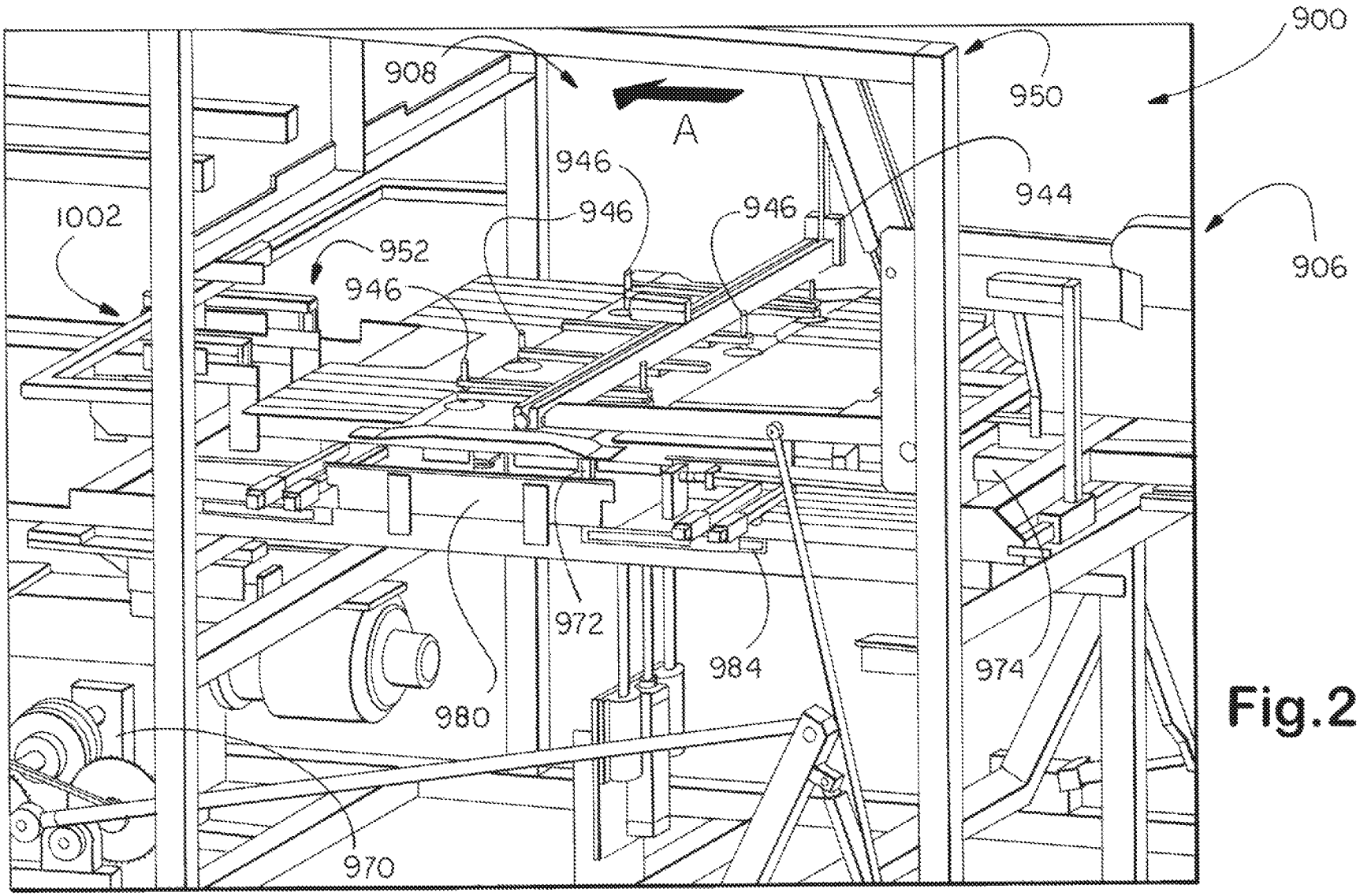
FIG. 21 is a partial perspective view of a forming station of the machine shown in FIGS. 17 and 18.

FIGS. 19-37 show perspective views of machine 900. Arrow A shows a direction of movement of blank 10 and/or container 200 through machine 900. Further, the head of arrow A indicates a "downstream" or "forward" direction and the tail of arrow A indicates an "upstream" or "backward" direction. The term "front" as used herein with respect to movement through machine 900 refers the downstream end of blank 10, and the term "rear" as used herein with respect to movement through machine 900 refers the upstream end of blank 10. FIG. 19 shows a perspective view of hopper station 906 having a generally vertically oriented blank 10 therein. FIG. 20 shows a perspective view of hopper station 906 and forming station 908 wherein blank 10 is being transported from hopper station 906 to station 908 using transport system 912. FIG. 21 shows a perspective view of forming station 908 with blank 10 being placed into a substantially horizontal position by transport system 912.

Figure 22:
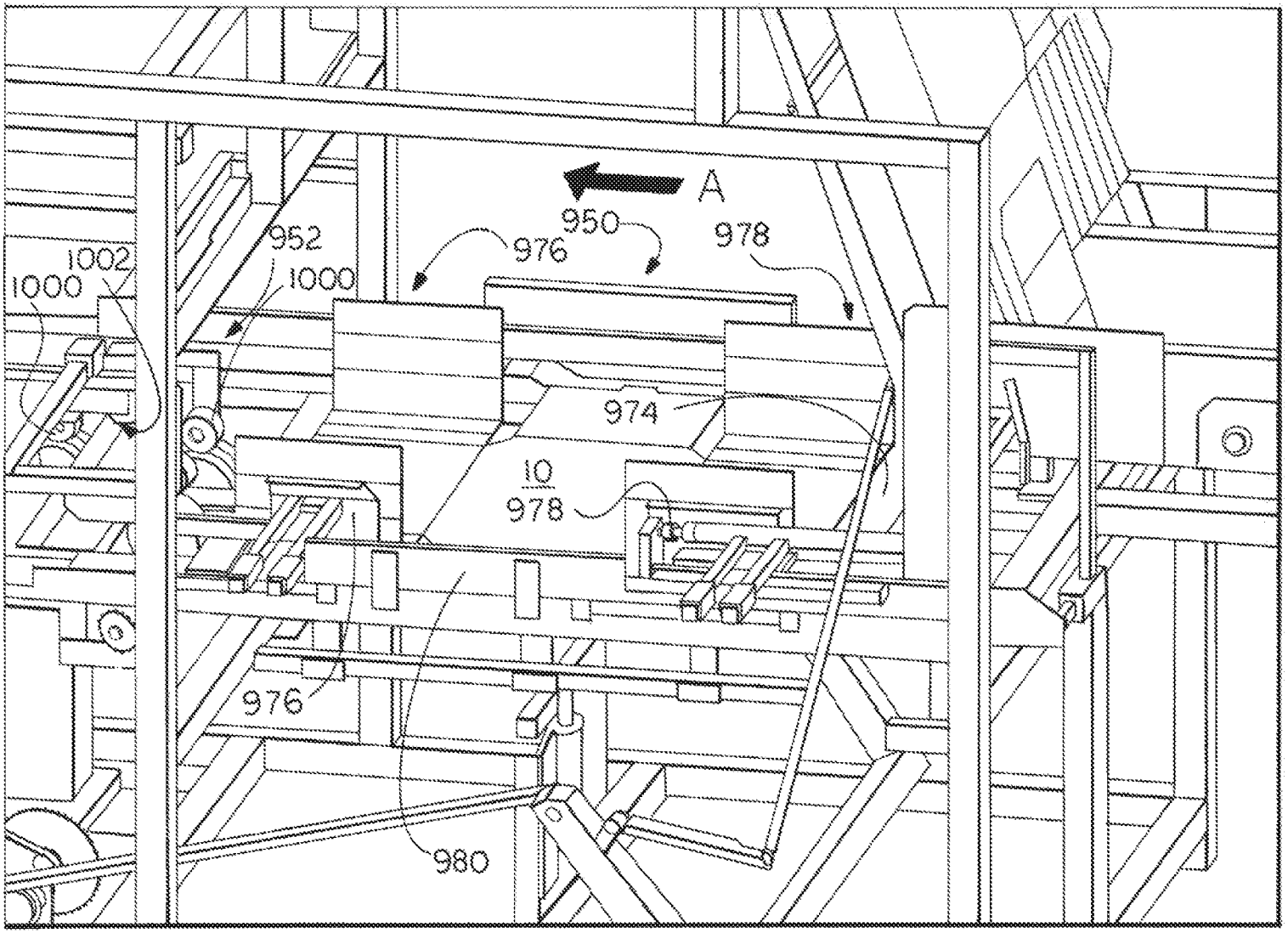
FIG. 22 is a perspective view of an initial forming station of the forming station shown in FIG. 21.
Figure 23:
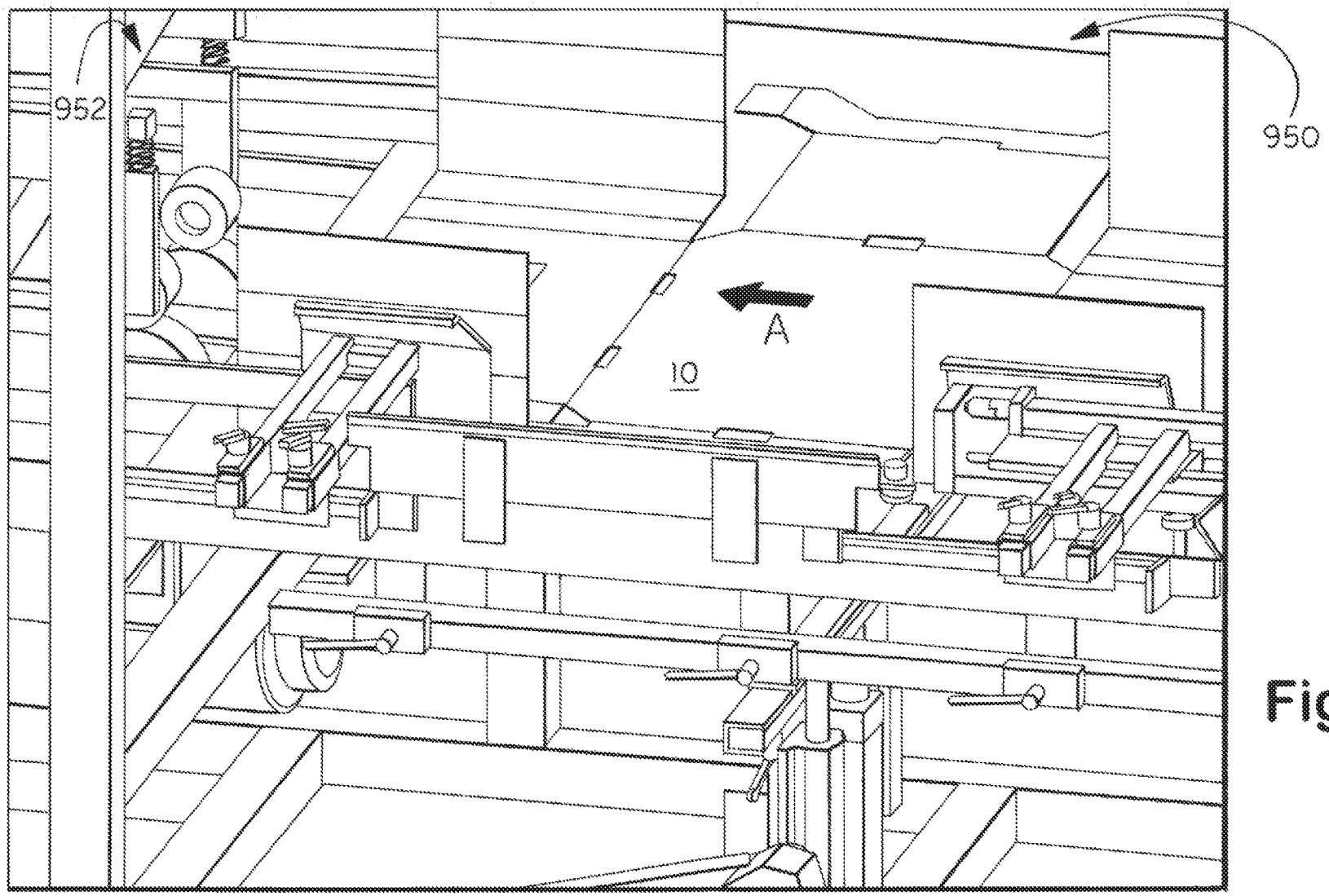
FIG. 23 is another perspective view of the initial forming station shown in FIG. 22.
Figure 24:
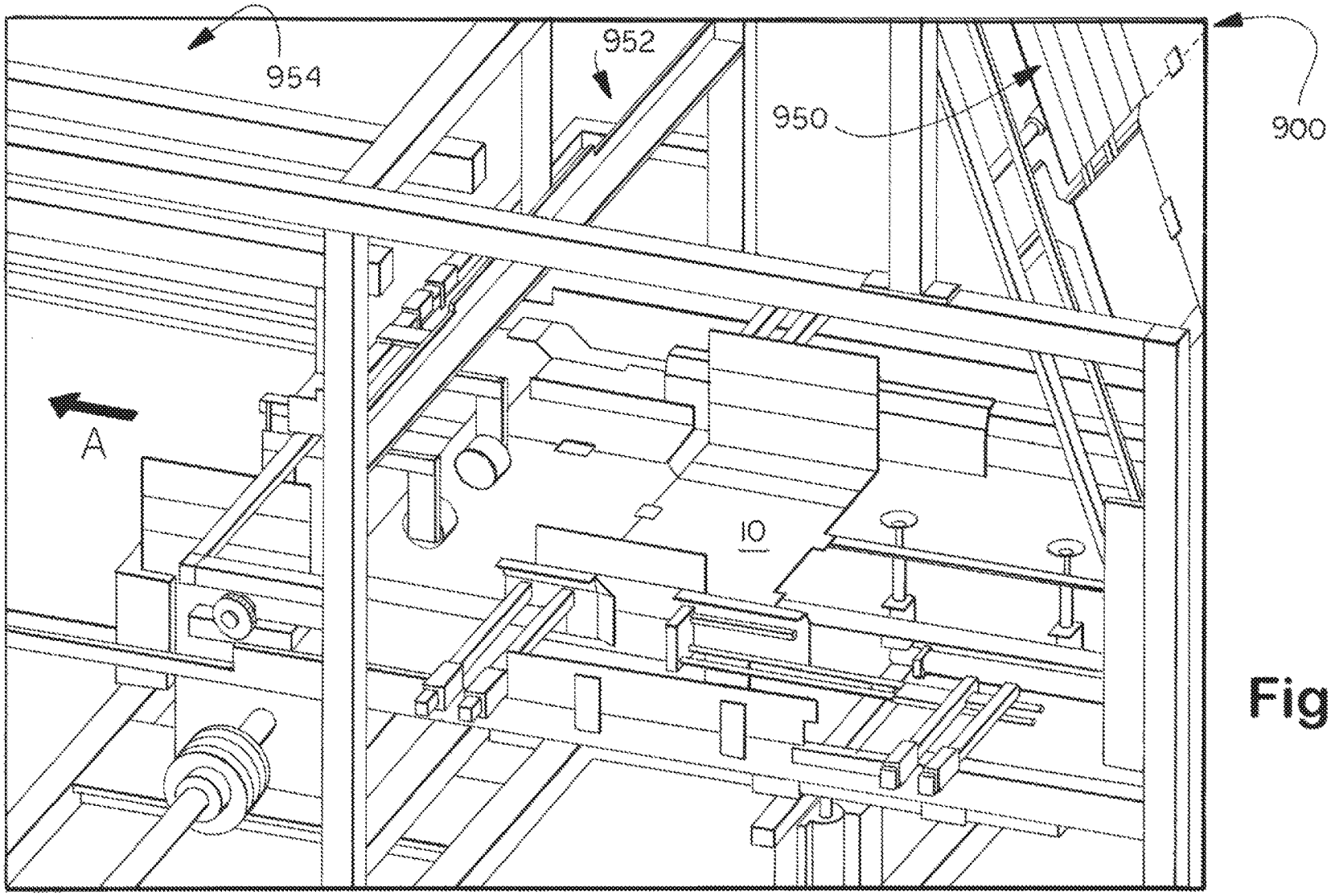
FIG. 24 is a perspective view of the forming station shown in FIG. 21.

FIG. 22 shows a perspective view of forming station 908 with blank 10 being placed onto transport system 912 with inner reinforcing panel assemblies 150 rotated substantially perpendicular to the remainder of blank 10. FIG. 23 shows a more close-up view of forming station 908 with blank 10 placed onto transport system 912 with inner reinforcing panel assemblies 150 rotated substantially perpendicular to the remainder of blank 10. FIG. 24 shows a perspective view of blank 10 being transported from an initial forming station of forming station 908 though a first gluing station to a secondary forming station of forming station 908 with inner reinforcing panel assemblies 150 rotated substantially perpendicular to the remainder of blank 10.

Figure 25:
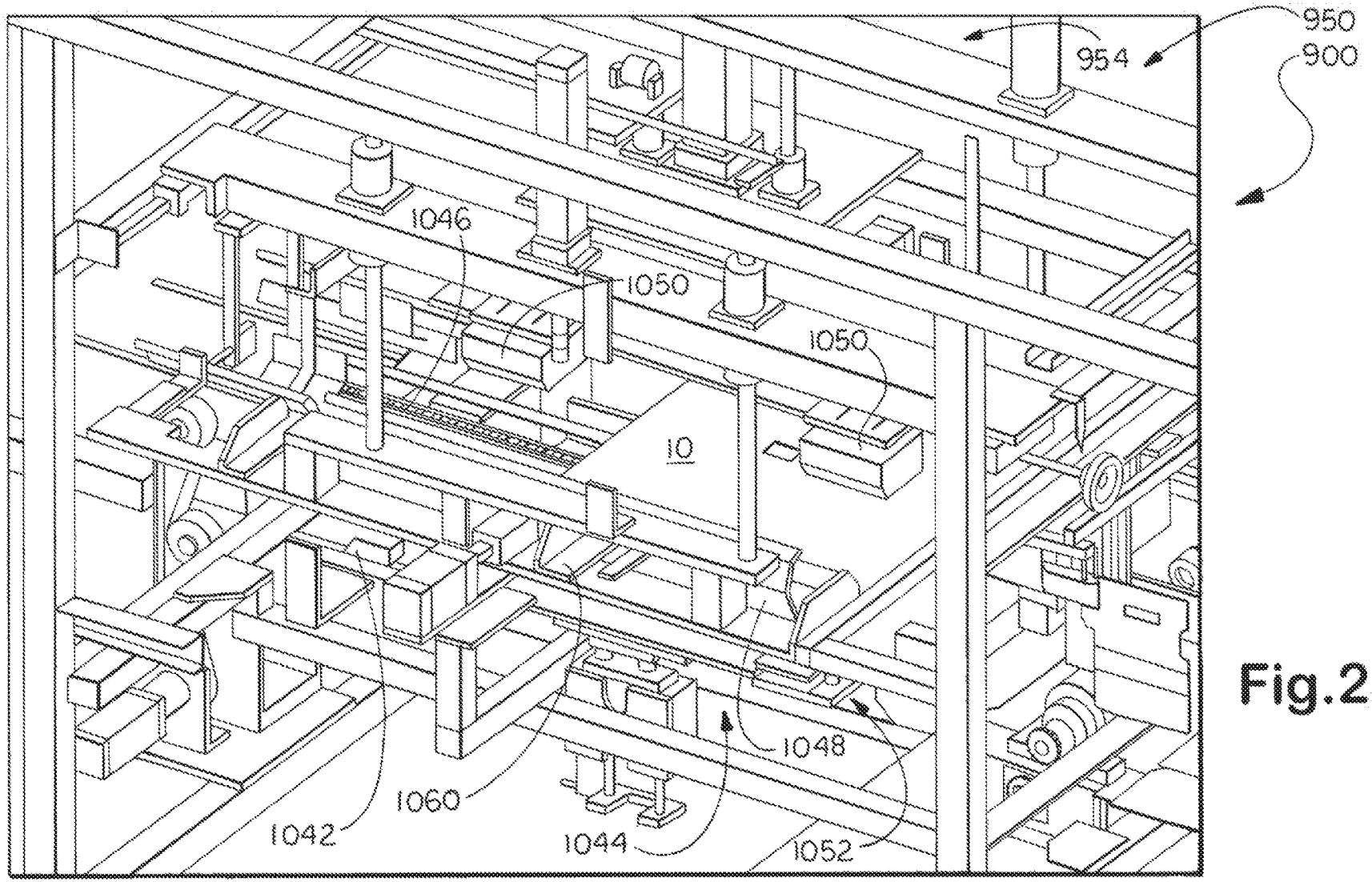
FIG. 25 is a perspective view of a secondary forming station of the forming station shown in FIG. 21.
Figure 26:
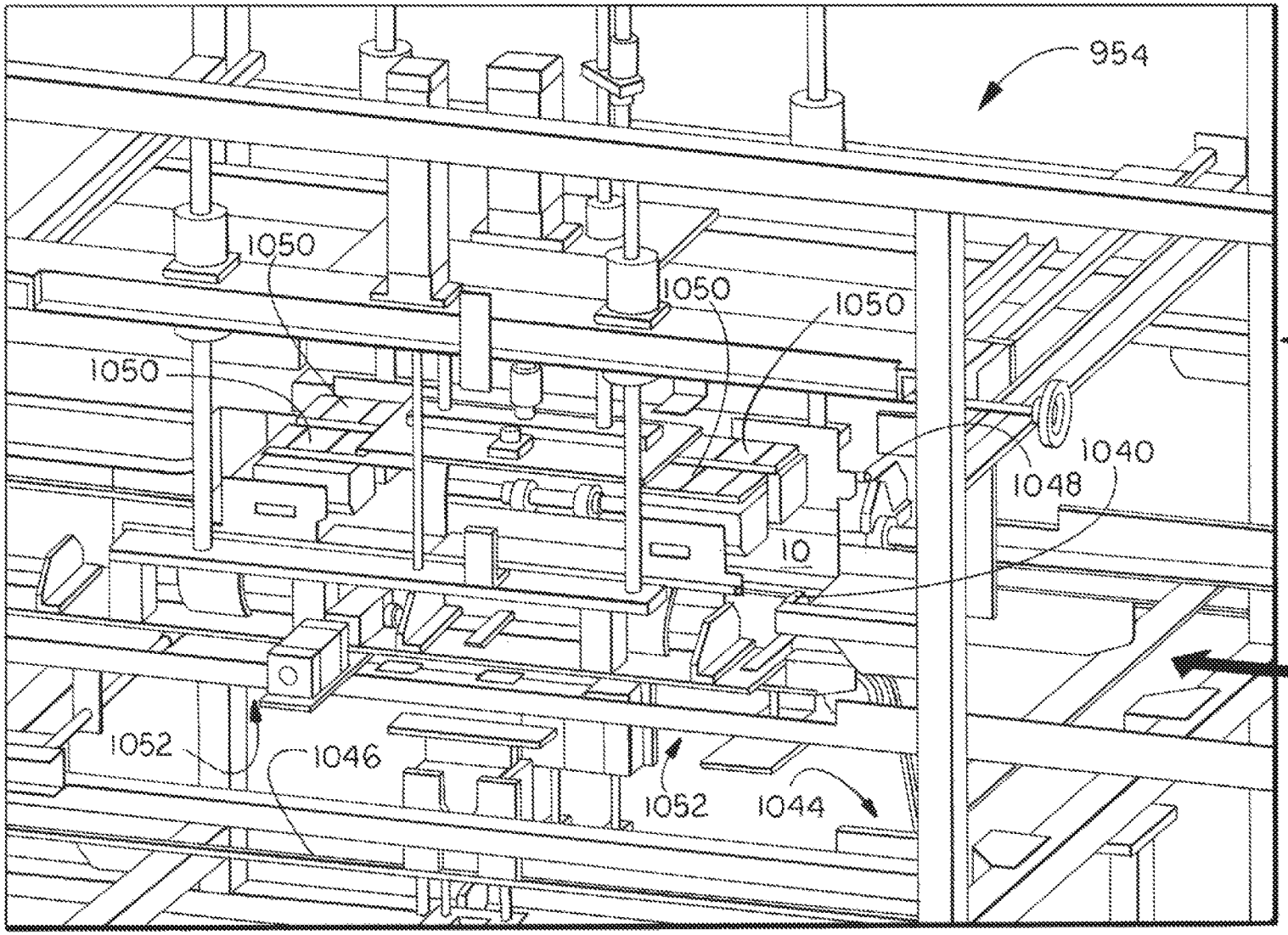
FIG. 26 is a perspective view of the secondary forming station of the forming station shown in FIG. 25.
Figure 27:
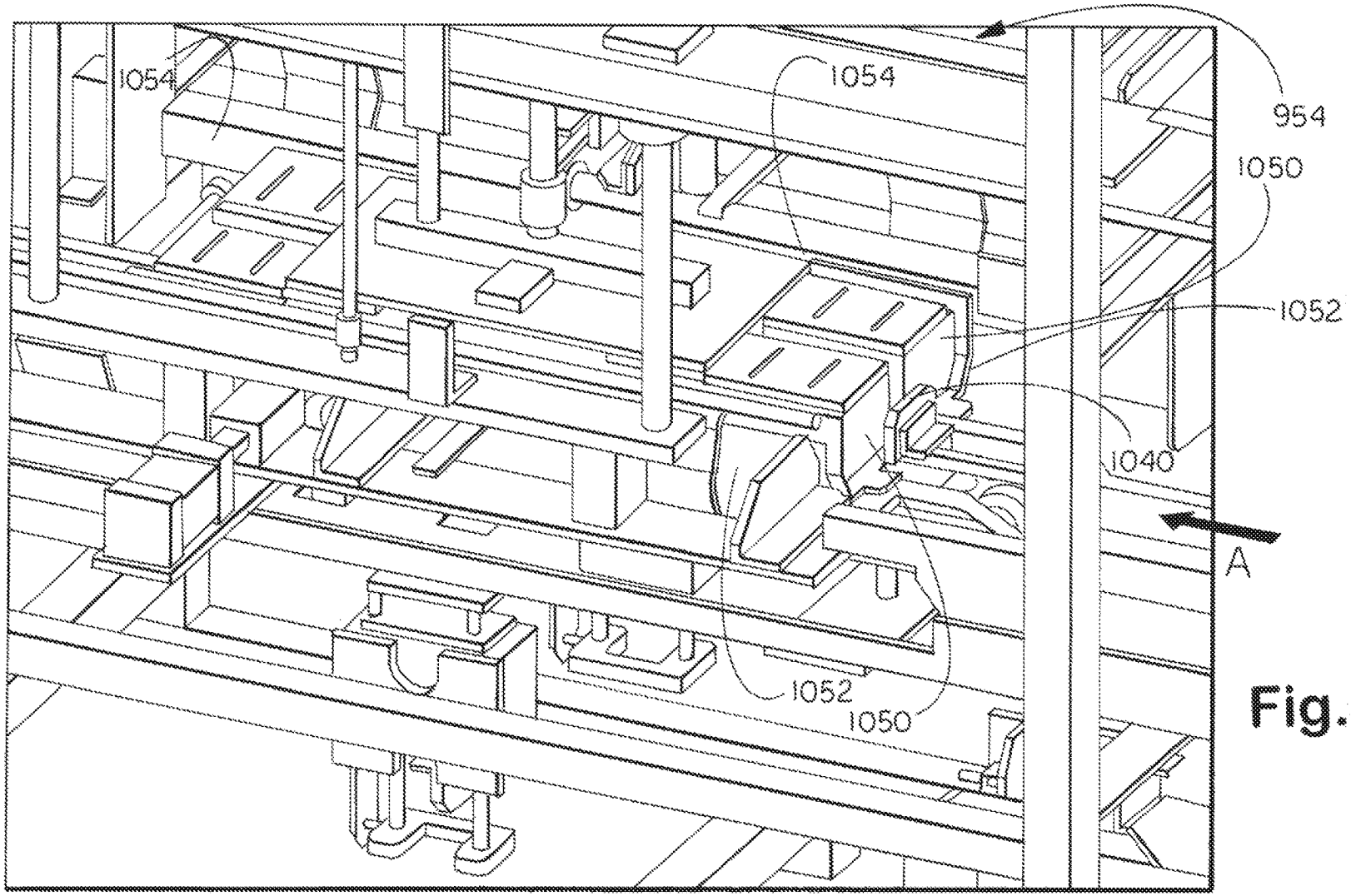
FIG. 27 is another perspective view of the secondary forming station shown in FIG. 25.
Figure 28:
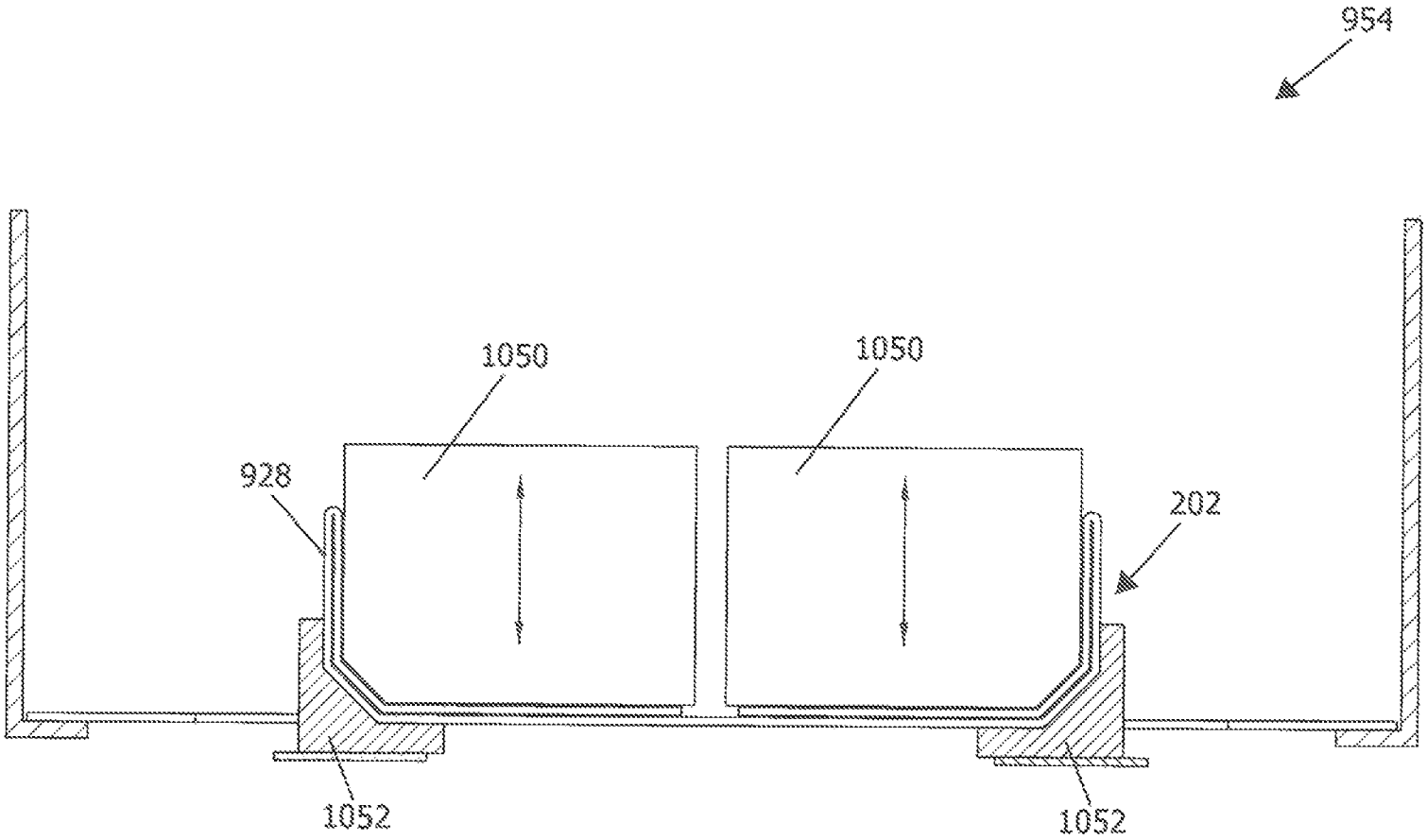
FIG. 28 is a schematic cross-sectional view of the secondary forming station shown in FIG. 27.
Figure 29:
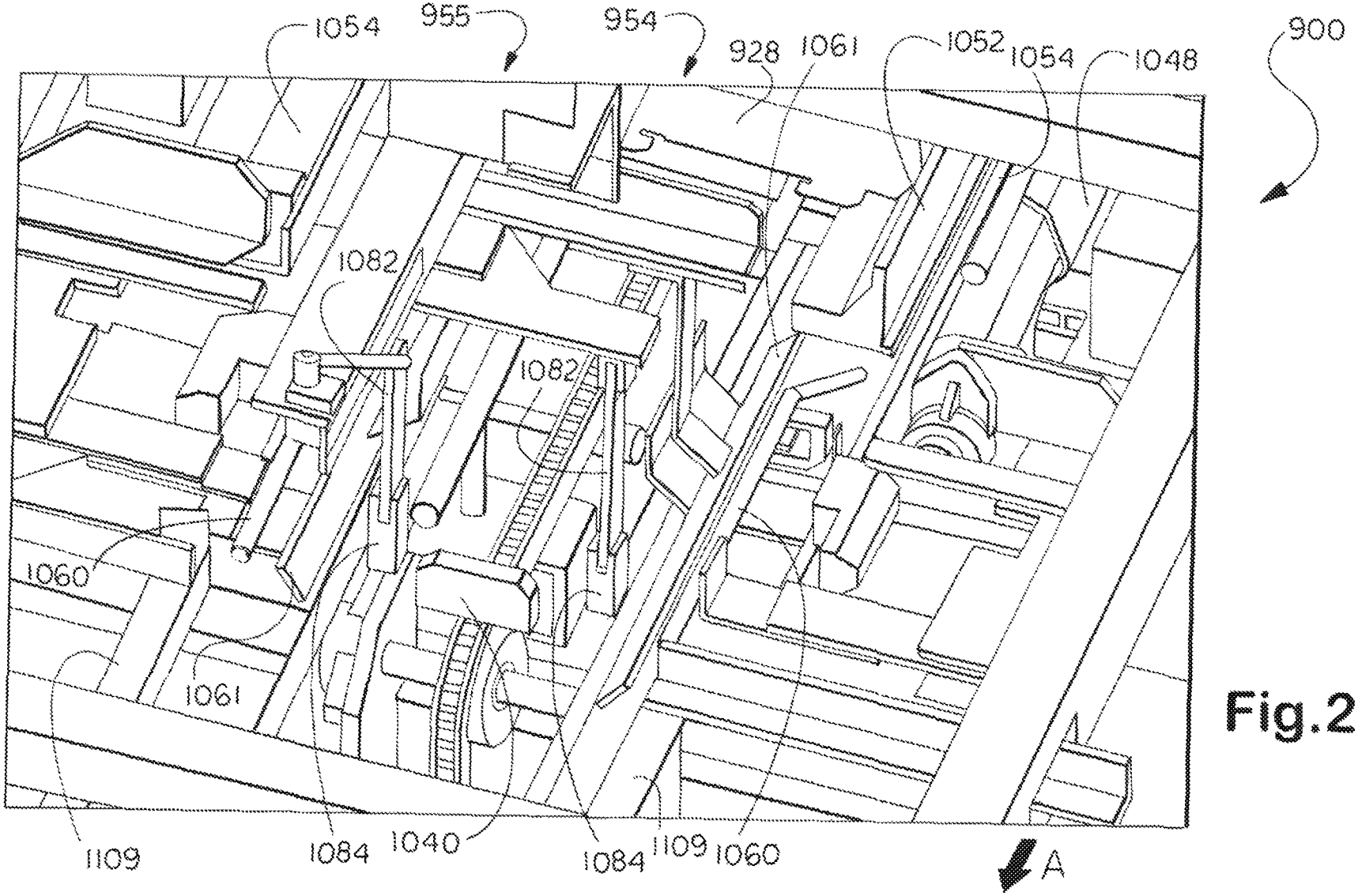
FIG. 29 is a perspective view of the secondary forming station shown in FIG. 25.
Figure 30:
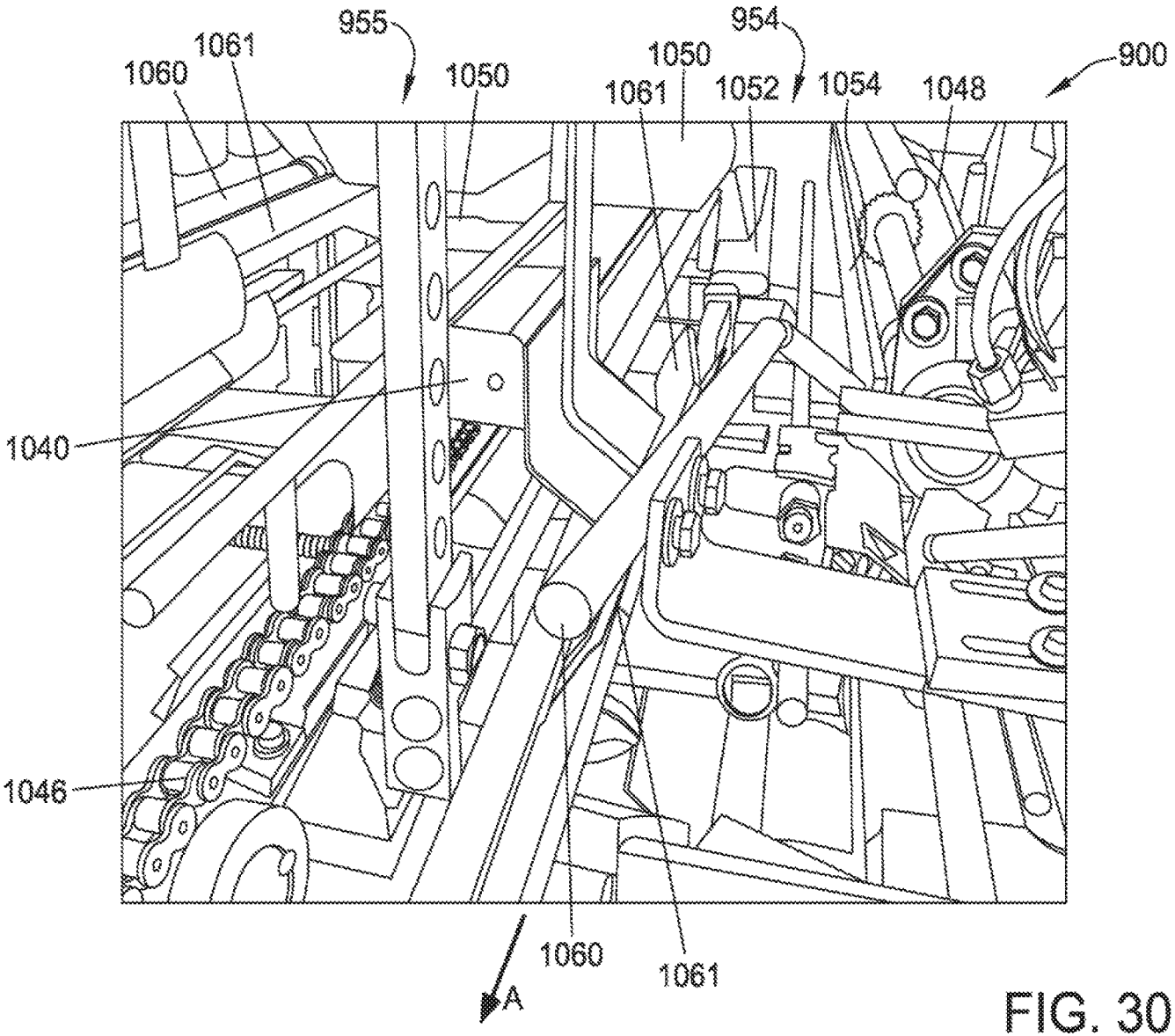
FIG. 30 is a perspective view of a breaking station of the forming station shown in FIG. 25.
Figure 31:
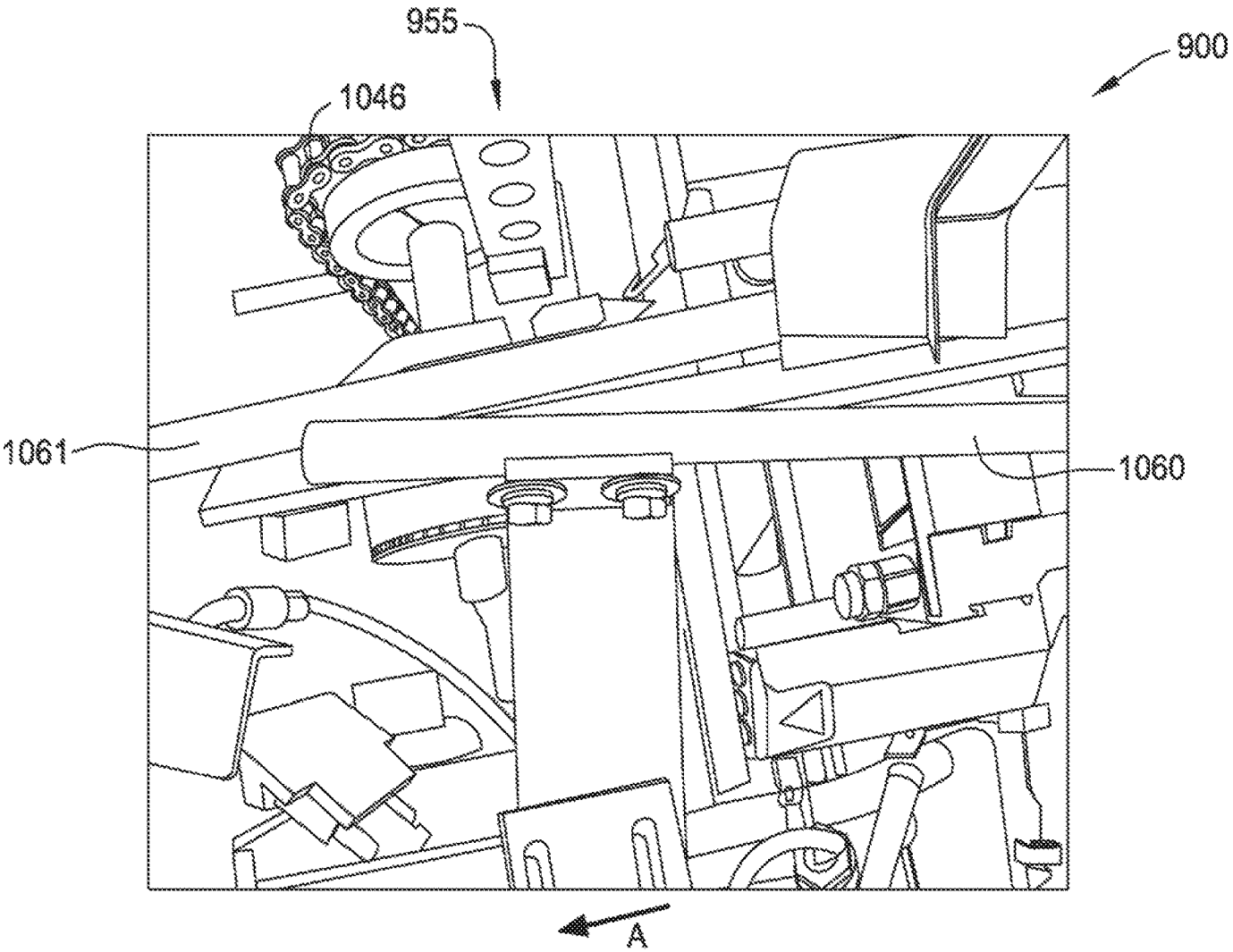
FIG. 31 is a top perspective view of the breaking station shown in FIG. 30.

FIG. 25 is a perspective view of the secondary forming station of forming station 908. FIG. 26 shows a perspective view of blank 10 being further formed within the secondary forming station of forming station 908. FIG. 27 shows a perspective view of blank 10 having reinforcing corner assemblies 202 formed within the secondary forming station of forming station 908. FIG. 28 shows a schematic cross-sectional view of blank 10 being formed into container 200 within the secondary forming station of forming station 908. FIG. 29 shows a perspective view of a downstream end of the secondary forming station. FIG. 30 is a perspective view of a breaking station of forming station 908. FIG. 31 is a top perspective view of the breaking station.

Figure 32:
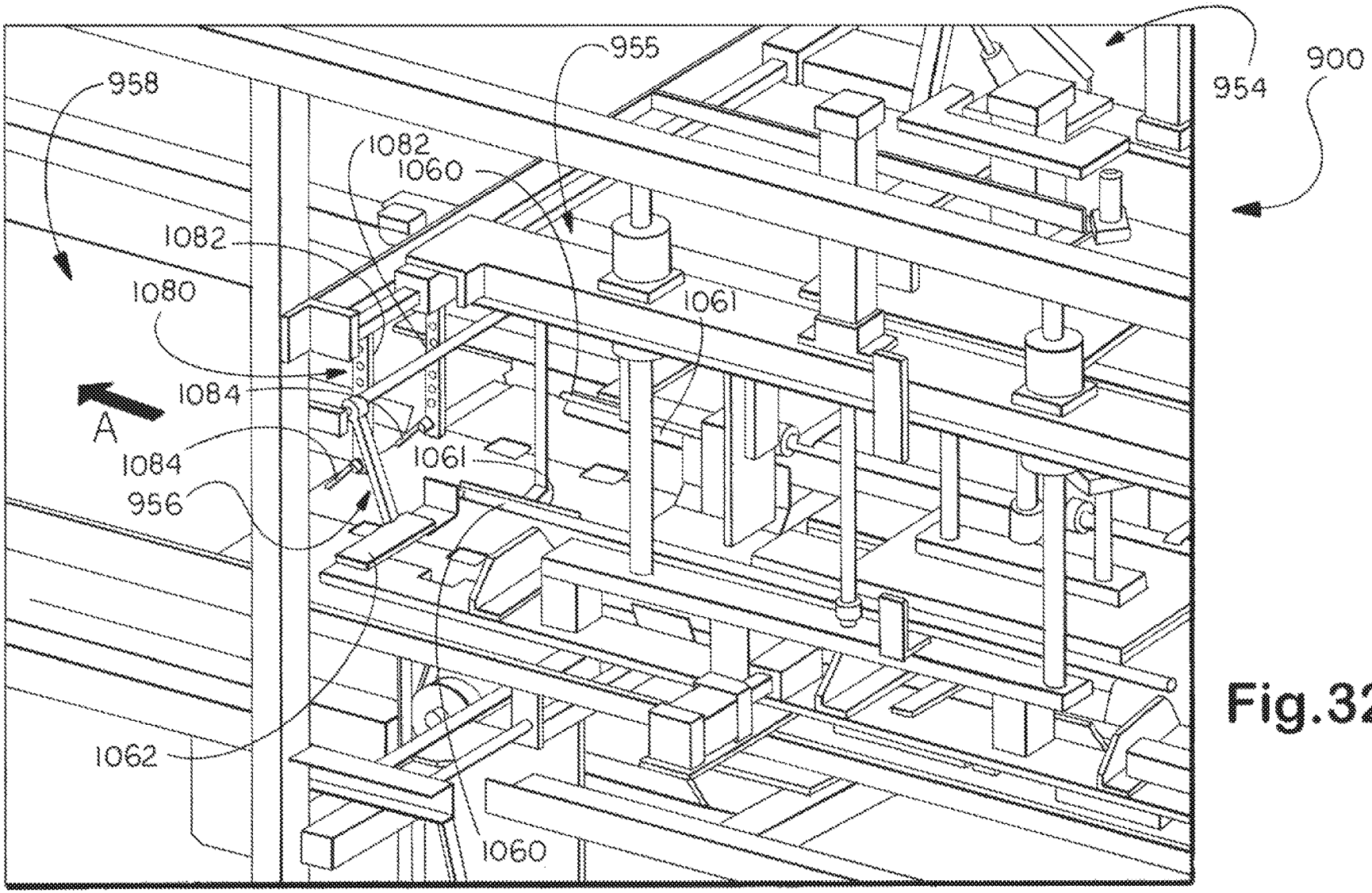
FIG. 32 is a perspective view of the forming station shown in FIG. 21.
Figure 33:
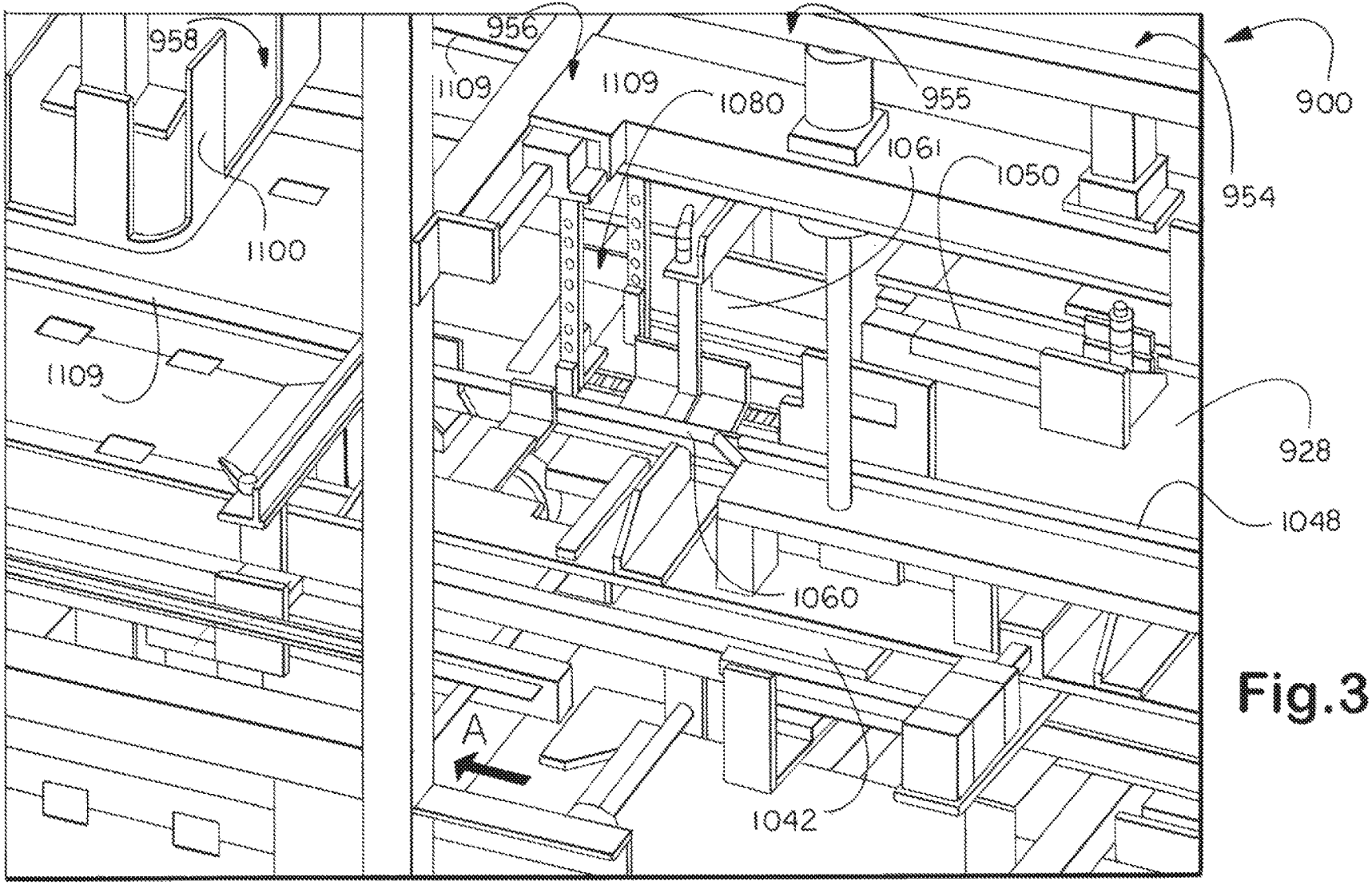
FIG. 33 is a perspective view of the secondary forming station and a compression station of the machine shown in FIGS. 17 and 18.
Figure 34:
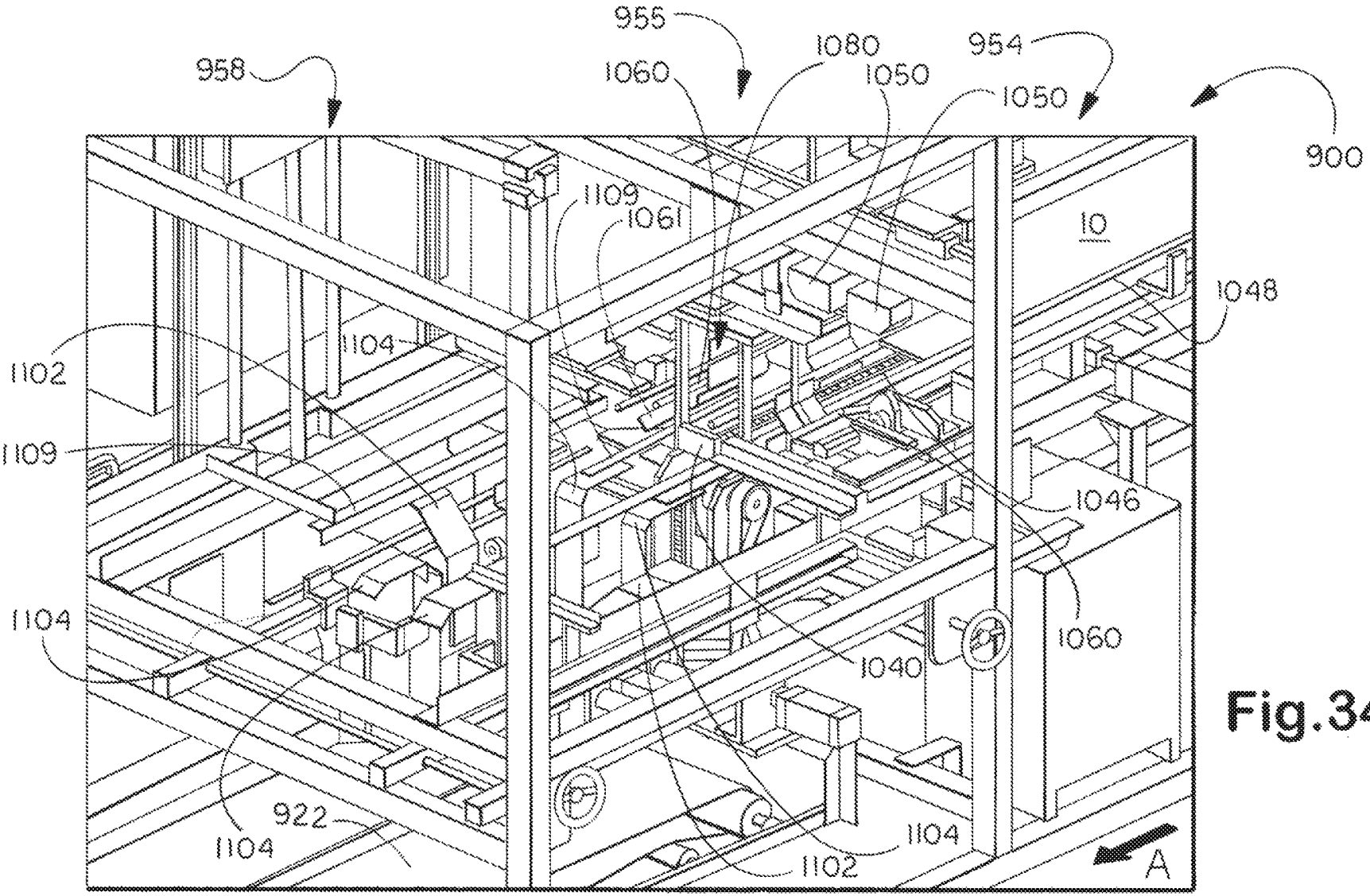
FIG. 34 is a perspective view of the compression station shown in FIG. 33 without a blank positioned therein.
Figure 35:
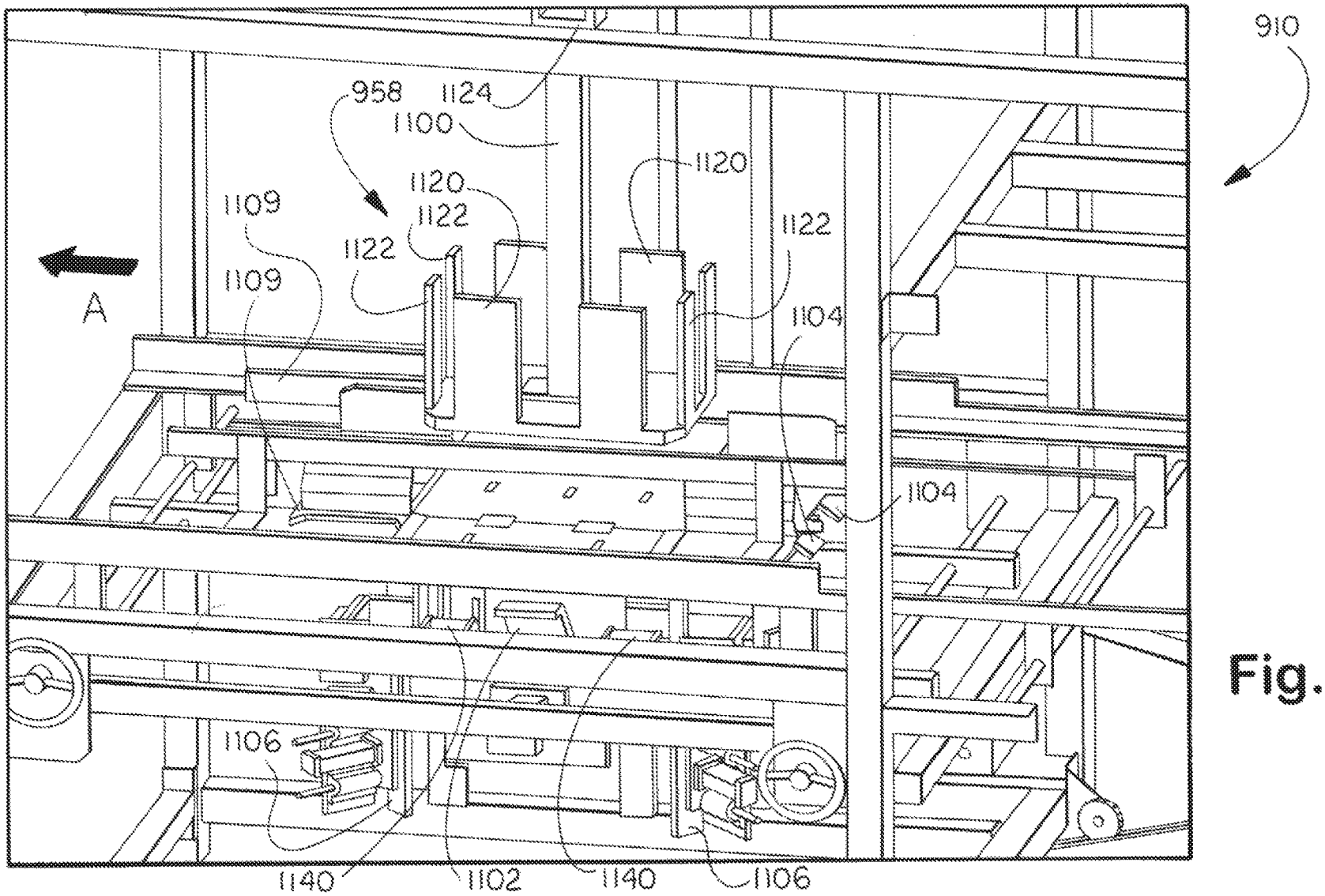
FIG. 35 is a perspective view of the compression station shown in FIG. 34 with a blank positioned therein.
Figure 36:
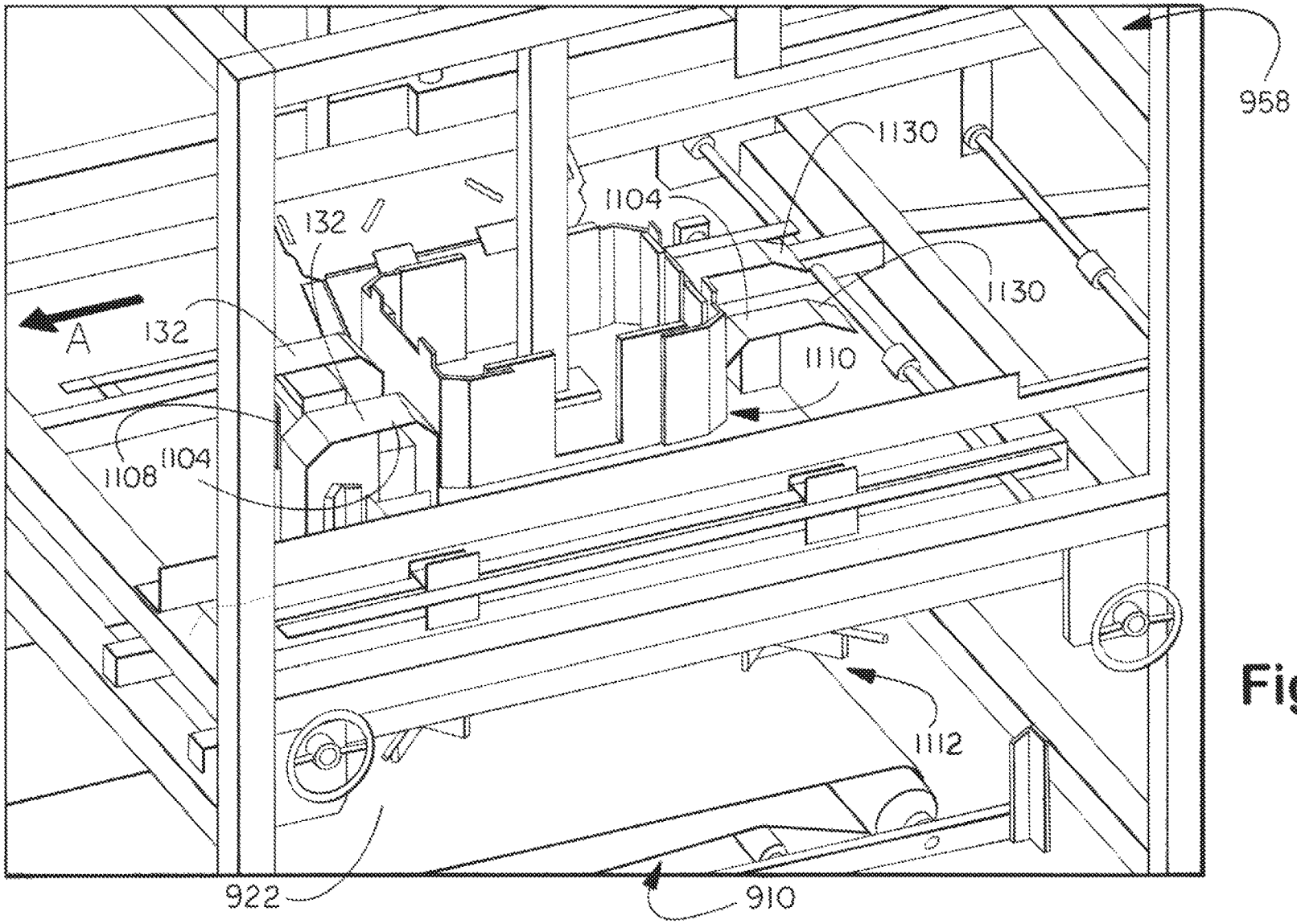
FIG. 36 is a perspective view of the compression station shown in FIG. 35.
Figure 37:
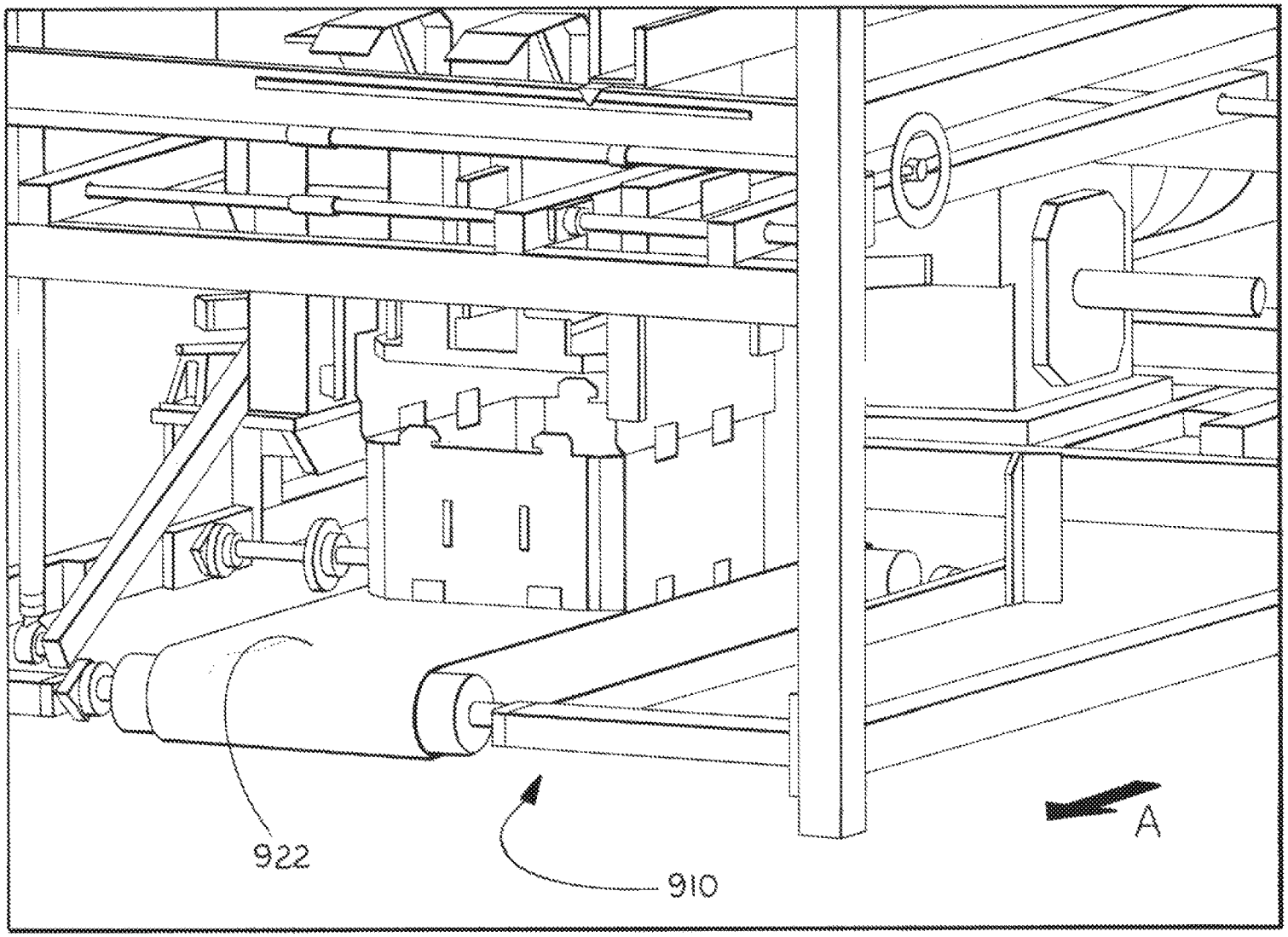
FIG. 37 is a perspective view of an ejection station of the machine shown in FIGS. 17 and 18.

FIG. 32 shows a perspective view of partially formed container 928 as it moves downstream from the secondary forming station of forming station 908. FIG. 33 shows a perspective view of the secondary forming station and a compression station of forming station 908. FIG. 34 shows a perspective view of the compression station without partially formed container 928 positioned therein. FIG. 35 shows a perspective view of partially formed container 928 within the compression station of forming station 908. FIG. 36 shows a perspective view of partially formed container 928 within the compression station of forming station 908. Side support rails, as described in more detail below, are not shown in FIG. 36. FIG. 37 shows a perspective view of formed container 200 on exit conveyor 922.

Referring to FIGS. 1, 2, and 17-37, machine 900 is substantially symmetrical about a longitudinal axis 934 that extends from a rear end 936 of machine 900 to a front end 938 of machine 900. As a container 200 is formed using machine 900, blank 10 moves along longitudinal axis 934 from rear end 936 to front end 938.

Referring to FIGS. 19-21, hopper station 906 includes a hopper 940, a feed mechanism 942, a transfer arm 944, and upper suction device 946. Hopper 940 is configured to support stack 914 of blanks 10 in a substantially vertical position on feed mechanism 942. Feed mechanism 942 is part of transport system 912, and includes, in the example embodiment, a conveyor belt mechanism for transporting blanks 10 downstream toward transfer arm 944. Blanks 10 within hopper 940 are in an unformed, substantially planar state. Hopper 940 is further configured to facilitate maintaining alignment of blanks 10 within machine 900 such that an individual blank 10 may be transported from hopper station 906 and precisely placed within forming station 908.

As shown in FIGS. 20-36, forming station 908 includes an initial forming station 950, a first gluing station 952, a secondary forming station 954, a second gluing station 956, and a compression station 958. Referring to FIGS. 20-24, initial forming station 950 includes a drive system 970, a lower suction device 972, a pusher plate 974, stationary folding plows 976, moveable folding plows 978, side plates 980, support rails 982, and outer side rails 984. Outer side rails 984 extend the length of machine 900 are used to help guide the outer side edges of blank 10 as blank 10 moves through machine 900.

As shown in FIGS. 21-24, first gluing station 952 includes drive rollers 1000 and a first gluer 1002. As explained below in detail, drive rollers 1000 are part of transport system 912 and are used to help transport blank 10 from initial forming station 950 past first gluer 1002. First gluer 1002 includes a plurality of glue sprayers that apply hot glue or any other type of adhesive to certain panels of blank 10. Specifically, first gluer 1002 applies glue to portions of each corner panel 154, each first reinforcing side panel 156, and first and second end panels 108 and 114. In an alternative embodiment, first gluer 1002 applies glue to a portion of at least some of these panels. First gluing station 952 also includes photo-eyes, sensors, proximity switches and other location detectors for detecting a location of blank 10 within gluing station 952. Location data is provided to control system 918, and control system 918 controls when glue sprayers are turned on and off to properly apply glue to blank 10. In the exemplary embodiment, first gluer 1002 includes a plurality of glue modules are each separately controllable by control system 918. As such, any suitable number of glue modules are activated depending on a size and/or placement of blank 10.

In FIGS. 25-33, secondary forming station 954 is downstream from initial forming station 950 and first gluing station 952. Secondary forming station 954 helps form reinforcing corner assemblies 202 on each blank 10 that passes through machine 900. Secondary forming station 954 includes a push lug 1040, a stop lug 1042, a servo-mechanical system 1044 (also known as a servo drive), a servo chain 1046, rotating folder arms 1048, male forming members 1050, female forming members 1052, and inner side rails 1054. In the example embodiment, servo drive 1044 is controlled by control system 918. Servo drive 1044 drives servo chain 1046 which includes at least one push lug 1040 coupled to servo chain 1046. Accordingly, servo drive 1044 drives servo chain 1046 around a first and second sprocket such that each push lug 1040 attached to servo chain 1046 rotates from an upstream location within secondary forming station 954 to a downstream location within secondary forming station 954. Push lug 1040 is configured to engage blank 10 at trailing top edge 112 or 118 of blank 10. Push lug 1040 pushes blank 10 into a forming position by pushing blank 10 until the opposing leading top edge 118 or 112 of blank 10 contacts stop lug 1042.

Stop lug 1042 is positioned downstream of push lug 1040. Stop lug 1042 is configured to precisely stop blank 10 so that blank 10 can be further formed within secondary forming station 954, and move downwardly out of the path of blank 10 so that, after secondary forming, blank 10 is able to move further downstream within machine 900. More specifically, in the exemplary embodiment, a stop lug 1042 is positioned on each side of servo chain 1046, and stop lugs 1042 move upward from below servo chain 1046 to above servo chain 1046 to stop blank 10 at an appropriate position. Stop lugs 1042 can be movably coupled to inner side rails 1054 and width-wise adjustable through adjustment of a width of inner side rails 1054. Stop lugs 1042 are moveable upstream and downstream with respect to inner side rails 1054 for length-wise adjustment. As such, positions of stop lugs 1042 are adjustable depending on a size of blank 10.

Rotating folder arm 1048 is mounted on each side of secondary forming station 954 proximate to inner side rails 1054. Folder arm 1048 is configured to rotate inwardly toward blank 10 from a starting position to a folding position, and then outwardly to return to the starting position. In rotating between the starting position and the folding position, folder arm 1048 contacts a portion of inner reinforcing panel assemblies 150 to fold inner reinforcing panel assemblies 150 from the substantially perpendicular position to a nearly flat position wherein inner reinforcing panel assemblies 150 overlie respective outer reinforcing panel assemblies 148 and end panels 108 and 114. As folder arm 1048 folds inner reinforcing panel assemblies 150, a portion of inner reinforcing panel assemblies 150 contacts a respective male forming member 1050 causing reinforcing panel assemblies 150 to bend along fold lines 168 and 170. The pre-bending of fold lines 168 and 170, sometimes referred to as "pre-breaking," facilitates forming reinforcing corner assemblies 202, as explained below in greater detail.

After folder arm 1048 folds inner reinforcing panel assemblies 150, folder arm 1048 rotates back to the starting position so that male forming members 1050 and female forming members 1052 are able to move together and form reinforcing corner assemblies 202, as shown in FIG. 28. More specifically, each male forming member 1050 has an outer surface that is shaped like an inside surface of one of reinforcing corner assemblies 202, and each female forming member 1052 has an outer surface that is shaped like an outside surface of one of the reinforcing corner assemblies 202. Thus, when male forming members 1050 and female forming members 1052 move toward each other, each female forming member 1052 interfaces with the outside of blank 10 and each male forming member 1050 interfaces with the inside of blank 10 such that outer reinforcing panel assemblies 148 and end panels 108 and 114 are glued to a respective inner reinforcing panel assembly 150. In addition, the outer profiles of male forming members 1050 and female forming members 1052 form corner walls 210, 212, 214, and/or 216 of each corner assembly 202.

After forming reinforcing corner assemblies 202, male forming members 1050 and female forming members 1052 move away from each other. Inner side rails 1054 are positioned to contact first reinforcing side panel 156 on each reinforcing corner assembly 202 to maintain the overall angle of reinforcing corner assembly 202 at substantially 90 degrees. In other words, inner side rails 1054 help prevent the formed reinforcing corner assemblies 202 from springing back out of a perpendicular position. Further, stop lug 1042 moves out of the travel path of partially formed container 928 such that partially formed container 928 can be further moved downstream within machine 900.

As shown in FIGS. 29-34, machine 900 includes a breaking station 955 positioned between forming members 1050 and 1052 and compression station 958. Breaking station 955 is configured to rotate reinforcing side panels 156 and 160, after reinforcing side panels 156 and 160 are joined together by forming members 1050 and 1052, to be at an acute angle (an angle of less than approximately 90 degrees) with respect to interior surface 12 of end panels 108 and/or 114. Breaking station 955 includes a miter plate 1061 and a guide bar 1060. In the exemplary embodiment, miter plate 1061 is substantially parallel to longitudinal axis 934 and oriented at an angle corresponding to an angle between corner panels 154 and 158 and end panels 108 and/or 114. Guide bar 1060 tapers inward toward miter plate 1061 and over a top edge of miter plate 1061 at a downstream end of breaking station 955. Guide bar 1060 is configured to force reinforcing side panels 156 and 160 to rotate with respect to corner panels 154 and 158 and break at least fold lines 166 and 168. In the exemplary embodiment, reinforcing corner assembly 202 is positioned between miter plate 1061 and guide bar 1060 as partially formed container 928 is transported downstream from secondary forming station 954 past second gluing station 956. As such, breaking station 955 facilitates preventing reinforcing corner assembly 202 from un-forming as partially formed container 928 is transferred into compression station 958.

Referring to FIG. 32, second gluing station 956 includes a second gluer 1062 positioned adjacent each guide bar 1060. Push lug 1040 pushes partially formed container 928 through second gluing station 956 to compression station 958. Second gluer 1062 includes a plurality of glue sprayers that apply hot glue or any other type of adhesive to certain panels of blank 10. Specifically, second gluer 1062 applies glue to portions of exterior surface 14 of first reinforcing side panels 156. Second gluing station 956 also includes photo-eyes, sensors, proximity switches and other location detectors for detecting a location of partially formed container 928 within gluing station 956. Location data is provided to control system 918, and control system 918 controls when glue sprayers are turned on and off to properly apply glue to partially formed container 928. In the exemplary embodiment, second gluer 1062 includes a plurality of glue modules are each separately controllable by control system 918. As such, any suitable number of glue modules are activated depending on a size and/or placement of blank 10. In the exemplary embodiment, guide bars 1060 are positioned to direct each reinforcing corner assembly 202 away from second gluers 1062 as partially formed container 928 passes through machine 900 such that an appropriate distance is maintained between second gluers 1062 and exterior surface 14 of the respective first reinforcing side panel 156 to ensure a proper amount and placement of glue on the panel.

As shown in FIGS. 33-36, compression station 958, also referred to as a plunger station, includes a pusher arm 1080 positioned just downstream of second gluing station 956. In the exemplary embodiment, pusher arm 1080 includes a pair of vertically-oriented bars 1082 coupled to a pair of vertically-oriented rotatable bars 1084 that are rotatable in the downstream direction but not in the upstream direction. In other words, rotatable bars 1084 allow partially formed container 928 to move downstream, but act as pusher arms after partially formed container 928 passes downstream of rotatable bars 1084. Rotatable bars 1084 are configured to engage a rear edge of partially formed container 928 as partially formed container 928 is ejected from second gluing station 956. When rotatable bars 1084 engage the rear edge, pusher arm 1080 transfers partially formed container 928 from second gluing station 956 into compression station 958. Pusher arm 1080 is a component of transport system 912.

Further, in the exemplary embodiment, compression station 958 includes a plunger 1100, two side panel plows 1102, two pairs of end panel plow assemblies 1104, a plurality of corner pushers 1106, a stop plate 1108, and support bars 1109. Stop plate 1108 is adjustable upstream and downstream with respect to a frame of machine 900. As such a position of stop plate 1108 is selectable based on the size of blank 10. In the exemplary embodiment, support bars 1109 are substantially parallel to longitudinal axis 934 and facilitate preventing glue from being removed and/or displaced with respect to first reinforcing side panels 156. More specifically, support bars 1109 are positioned to contact glued first reinforcing side panels 156 to push reinforcing side panels 156 and 160 to be at a substantially right angle with respect to a respective side panel 22 or 26. Support bars 1109 are adjustable depending on a size of blank 10 and/or partially formed container 928. In a particular embodiment, support bars 1109 are positioned to contact a first reinforcing side panels 156 near fold line 152, above glue. Because support bars 1109 retain a position of reinforcing corner assemblies 202 within compression station 958, support bars 1109 prevent the glue from being removed from and/or displaced from exterior surface 14 of first reinforcing side panels 156 as reinforcing corner assemblies 202 are rotated into position with end panels 108 and 114.

Compression station 958 can include an adjustable stop (not shown) positioned at a downstream end of compression station 958 for stopping movement of partially formed container 928 through compression station 958. End panel plows 1104 and side panel plows 1102 define a plunger opening 1110 that extends from top ends of side panel plows 1102 and end panel plows 1104 to exit conveyor 922. More specifically, plunger 1100 has a shape that corresponds to a cross sectional shape of container 200. In the exemplary embodiment, plunger 1100 corresponds to end walls 206 and 208 and side walls 218 and 220 of container 200. Plunger 1100 is open at corner walls 210, 212, 214, and 216. Alternatively, plunger 1100 may also include walls at corner walls 210, 212, 214, and/or 216.

In the exemplary embodiment, plunger 1100 includes at least four upright plates 1120 and 1122 coupled to a vertical actuator 1124. More specifically, side wall upright plates 1120 extend substantially parallel to longitudinal axis 934 and are oriented substantially vertically, and end wall upright plates 1122 are substantially perpendicular to side wall upright plates 1120 and longitudinal axis 934 and are oriented substantially vertically. Upright plates 1120 and 1122 are configured to prevent over-rotation of side panels 22 and 26 and end panels 108 and 114 into cavity 224 (shown in FIG. 2) of container 200. Vertical actuator 1124, which is driven by drive system 970, is configured to move plunger 1100 between a first position, also referred to as a top position, and a second position, also referred to as a bottom position. Control system 918 is in operational control communication with vertical actuator 1124 for controlling movement of plunger 1100 between the first position and the second position.

Compression station 958 includes a rear pair 1130 of end panel plows 1104 and a front pair 1132 of end panel plows 1104. Each end panel plow 1104 is moveable with respect to machine 900 and is configured to upwardly rotate an end panel 108 or 114 to be substantially perpendicular to bottom panel 24. More specifically, front pair 1132 is configured to fold a front end panel 108 or 114, and rear pair 1130 is configured to fold a rear end panel 108 or 114. Each end panel plow 1104 includes an angled outer surface, a top surface, an angled inner surface, and a vertical plate. As used with respect to end panel plows 1104 and side panel plows 1102, the term "inner" refers to a direction toward plunger opening 1110, and the term "outer" refers to a direction away from plunger opening 1110. In the exemplary embodiment, the top surface of plow 1104 is substantially parallel to longitudinal axis 934 and extends between the angled outer surface and the angled inner surface. The vertical plate extends into plunger opening 1110 to at least partially define plunger opening 1110.

Each end panel plow assembly 1104 includes a frame having a pair of end panel plows coupled thereto. Front pair 1132 of end plows 1104 is configured to rotate inwardly toward plunger opening 1110 and outwardly away from plunger opening 1110. As such, front pair 1132 of end plows 1104 move between a first position, also referred to as an outer position, and a second position, also referred to as a forming position. Rear pair 1130 of end plows 1104 are also configured to rotate, but could be stationary if so desired. Control system 918 is in operational control communication with each end panel plow assembly 1104 for controlling rotation between the outer position and the forming position. In the exemplary embodiment, a sensor determines when partially formed container 928 is positioned over plunger opening 1110. End panel plow assemblies 1104 are moved to the forming position when the sensor determines partially formed container 928 is positioned over and/or within plunger opening 1110, and end panel plow assemblies 1104 are moved to the outer position after plunger 1100 has been retracted from plunger opening 1110. As such, container 200 is secured within plunger opening 1110 by end panel plow assemblies 1104 in the forming position, and container 200 is released from plunger opening 1110 onto exit conveyor 922 when end panel plow assemblies 1104 are in the outer position. Although two end panel plows 1104 are described in the example embodiment, it should be understood that any suitable number of end panel plows may be used to fold end panels 108 or 114.

In the exemplary embodiment, each side panel plow 1102 includes a substantially horizontal upper surface, an angled inner surface, and a substantially vertical inner wall. Angled inner surfaces are configured to rotate side panels 22 and/or 26 inwardly toward plunger opening 1110 and/or plunger 1100. The vertical inner walls at least partially define plunger opening 1110. Side panel plows 1102 also include glue rollers 1140 that are positioned on both sides of each side panel plow 1102. Glue rollers 1140 facilitate attaching and adhering side panels 22 and 26 to adjacent first reinforcing side panel 156 as plunger 1100 moves partially formed container 928 through plunger opening 1110.

A corner pusher 1106 is positioned at each corner of plunger opening 1110. Each corner pusher 1106 is coupled to an actuator that moves one of the corner pushers 1106 between a first position, also referred to as an outer position, and a second position, also referred to as an inner position. As such, horizontal actuator moves corner pusher 1106 toward and away from plunger opening 1110. Control system 918 is in operational control communication with each actuator for controlling corner pushers 1106. In the exemplary embodiment, a sensor determines when partially formed container 928 is positioned over plunger opening 1110, and corner pushers 1106 are moved to the second position when the sensor determines partially formed container 928 is positioned over and/or within plunger opening 1110. In one embodiment, corner pushers 1106 are only moved to the inner position when a blank having outer reinforcing corner panels, such as blank 300 and/or 500, is being formed into a container using machine 900.

Referring to FIGS. 36 and 37, exit conveyor 922 extends through a bottom 1112 of compression station 958 to receive containers 200 from forming station 908. More specifically, exit conveyor 922 continuously runs while machine 900 is being operated to form containers 200. Alternatively, exit conveyor 922 is operated intermittently when a container 200 is positioned within bottom 1112 of compression station 958. In the exemplary embodiment, container 200 is secured within plunger opening 1110 by end panel plow assemblies 1104 and/or corner pushers 1106 over exit conveyor 922. As such, when end panel plow assemblies 1104 are rotated to outer position and/or corner pushers 1106 are moved to outer positions, container 200 is released from plunger opening 1110 onto exit conveyor 922. Control system 918 is in operational control communication with exit conveyor 922 for control thereof. Top panels 20 and 28 remain unfolded with respect to a respective side panel 22 or 26, and container 200 is ejected from machine 900 in the open configuration.

During operation of machine 900, a method for forming a container 200 from blank 10 is performed. It should be understood that the method may be used to form any suitable container, such as containers 350, 450, 550, 650, 750, and/or 850 (shown in FIGS. 6, 8, 10, 12, 14, and 16), using machine 900. In the exemplary embodiment, the method is performed by control system 918 sending commands and/or instructions to components of machine 900. Processor 920 within control system 918 is programmed with code segments configured to perform the method. Alternatively, the method is encoded on a computer-readable medium that is readable by control system 918. In such an embodiment, control system 918 and/or processor 920 is configured to read computer-readable medium for performing the method.

Referring to FIGS. 17-37, drive system 970 includes a motor, gears, a chain and sprockets that cause much of transport system 912 to move. For example, drive system 970 causes transfer arm 944 to rotate to a position where upper suction device 946 comes into contact with a first blank 10 stored within hopper 940. First blank 10 being the most downstream blank housed within hopper 940. More specifically, upper suction device 946 comes into contact with interior surface 12 of first blank 10 such that upper suction device 946 becomes releasably coupled to first blank 10. Transfer arm 944, still being driven by drive system 970, rotates with blank 10 coupled thereto such that blank 10 is placed in a substantially horizontal position with exterior surface 14 of blank 10 facing downwardly toward support rails 982. Thus, transfer arm 944 moves blank 10 from hopper 940 to initial forming station 950.

While transfer arm 944 moves blank 10 into a substantially horizontal position within initial forming station 950, lower suction device 972 moves upwardly from below support rails 982 to engage exterior surface 14 of blank 10. Thus, blank 10 is essentially transferred with a "handshake" from upper suction device 946 to lower suction device 972. Lower suction device 972 then pulls blank 10 downwardly onto support rails 982. As blank 10 is placed on support rails 982, stationary folding plows 976 and moveable folding plows 978 engage inner reinforcing panel assemblies 150 at each corner of blank 10, causing each inner reinforcing panel assembly 150 to rotate about 90 degrees with respect to outer reinforcing panel assembly 148 such that each inner reinforcing panel assembly 150 is substantially perpendicular to bottom panel 24 of blank 10. Feed mechanism 942 pushes stack 914 forward to position the next blank 10 to be removed from hopper 940 by transfer arm 944.

Blank 10 is moved from initial forming station 950 to secondary forming station 954 through first gluing station 952. More specifically, blank 10 is transported forward into secondary forming station 954 using pusher plate 974 and/or drive rollers 1000. For example, pusher plate 974 is moved in a substantially horizontal direction from a rear position to a forward position and blank 10 is slid forward into forming station 954 along support rails 982. Moveable folding plows 978 follow the motion of blank 10 to retain the position of rear inner reinforcing panel assemblies 150. As blank 10 is transported forward, rear inner reinforcing panel assemblies 150 are transferred from moveable folding plows 978 to stationary folding plows 976 to retain the position of inner reinforcing panel assemblies 150. Further, drive rollers 1000 contact a leading end panel 108 or 114 and/or bottom panel 24 as blank 10 is transferred from initial forming station 950 to first gluing station 952. Once drive rollers 1000 engage blank 10, pusher plate 974 retracts to the rear position.

As blank 10 is transported through first gluing station 952, adhesive is applied to interior surface 12 of corner panels 154, first reinforcing side panels 156, and/or end panels 108 and/or 114 using first gluer 1002. More specifically, sensors within first gluing station 952 detect a position of blank 10 with respect to first gluer 1002 to control first gluer 1002 to properly apply the adhesive. As the trailing top edge 112 or 118 of blank 10 exits first gluing station 952, push lug 1040 engages trailing top edge 112 or 118 to move blank 10 through secondary forming station 954. More specifically, using sensors and/or other devices, control system 918 controls servo drive 1044 to position push lug 1040 adjacent trailing top edge 112 or 118. Servo drive 1044 then controls movement of blank 10 through secondary forming station 954 using push lug 1040. In the exemplary embodiment, push lug 1040 moves blank 10 through secondary forming station 954 until leading top edge 112 or 118 is adjacent to, or in contact with, stop lug 1042. Push lug 1040 and stop lug 1042 are configured to properly position blank 10 within secondary forming station 954.

Within secondary forming station 954, reinforcing corner assemblies 202 are formed using male forming member 1050 and female forming member 1052. More specifically, in the exemplary embodiment, folder arm 1048 rotates from the starting position to the folding position to fold interior surface 12 of inner reinforcing panel assemblies 150 into face-to-face relationship with interior surface 12 of a respective outer reinforcing panel assembly 148. When folder arms 1048 are at the folding position, inner reinforcing panel assemblies 150 are not in contact with outer reinforcing panel assemblies 148; however, in some embodiments, inner reinforcing panel assemblies 150 can be rotated into contact with outer reinforcing panel assemblies 148 by folder arms 1048. In the exemplary embodiment, as inner reinforcing panel assemblies 150 are rotated by folder arms 1048, inner end panels 162 and inner reinforcing corner panels 158 are slightly rotated about fold lines 168 and/or 170 by coming into contact with male forming member 1050. As such, folder arms 1048 and male forming members 1050 pre-break inner reinforcing panel assemblies 150 along fold lines 168 and 170. Once inner reinforcing panel assemblies 150 are positioned with respect to outer reinforcing panel assemblies 148 and/or end panels 108 and/or 114, folder arms 1048 retract to the starting position.

When folder arms 1048 have retracted, male forming members 1050 move downward toward blank 10 and female forming members 1052 move upward toward blank 10. Male forming members 1050 contact the inner, or upper, surface of blank 10 and female forming members 1052 contact the outer, or lower, surface of blank 10. When male and female forming members 1050 and 1052 compress toward each other with blank 10 therebetween, corner panels 154 and 158 are rotated about fold lines 170 and 140, 142, 144, or 146 and reinforcing side panels 156 and 160 are rotated about fold lines 166 and 168. Further, when male and female forming members 1050 and 1052 move together, at least inner end panel 162 is adhered to a respective end panel 108 and 114. Alternatively or additionally, reinforcing side panels 156 and 160 are adhered together and/or corner panels 154 and 158 are adhered together by male and female forming members 1050 and 1052. When reinforcing corner assemblies 202 are formed by male and female forming members 1050 and 1052, partially formed container 928 is formed from blank 10. Male forming members 1050 move upward and female forming members 1052 move downward to release partially formed container 928. As partially formed container 928 is released, inner side rails 1054 contact first reinforcing side panel 156 to maintain a position of reinforcing corner assembly 202 with respect to the remainder of blank 10.

Stop lug 1042 moves out of the path of partially formed container 928, and push lug 1040 moves partially formed container 928 into compression station 958 through breaking station 955 and second gluing station 956. As partially formed container 928 is moved through breaking station 955, reinforcing side panels 156 and 160 are rotated to be at an acute angle to end panel 108 and/or 114 by guide bars 1060 and miter plates 1061. While partially formed container 928 is transported through breaking station 955 and second gluing station 956, second gluer 1062 applies adhesive to first reinforcing side panels 156, as described above. Pusher arm 1080 engages trailing top edge 112 or 118 of blank 10 to move partially formed container 928 into compression station 958 and over plunger opening 1110. Because reinforcing corner assemblies 202 have been overbroken, reinforcing corner assemblies 202 do not un-form during transport to and/or through compression station 958. Further, as partially formed container 928 is transported to compression station 958, support bars 1109 maintain positions of reinforcing corner assemblies 202 to prevent glue on first reinforcing side panels 156 from being removed and/or displaced.

Plunger 1100 moves downward from the upper position toward the lower position to contact interior surface 12 of bottom panel 24 using vertical actuator 1124. Plunger 1100 pushes bottom panel 24 into and through plunger opening

1110. End panel plows 1104 and side panel plows 1102 are in the forming position as partially formed container 928 is pushed through plunger opening 1110. End panel plows 1104 fold end panels 108 and 114 to be perpendicular to bottom panel 24 and side panel plows 1102 fold side panels 22 and 26 to be perpendicular to bottom panel 24 as bottom panel 24 is forced downward. As end panels 108 and 114 are rotated, reinforcing corner assemblies 202 are also rotated into position. In a particular embodiment, support bars 1109 contact exterior surface 14 of first reinforcing side panels 156 to prevent the glue from being removed from first reinforcing side panels 156 as reinforcing corner assemblies 202 are moved into position.

Further, glue rollers 1140 press interior surface 12 of side panels 22 and 26 into contact with adhesive on first reinforcing side panels 156 as partially formed container 928 is moved downward. Glue rollers 1140 apply a force to side panels 22 and/or 26 adjacent to first reinforcing side panels 156 as plunger 1100 forces bottom panel 24 downward. Side panels 22 and 26 are forced into contact with the adhesive on first reinforcing side panels 156 by glue roller 1140 and plunger 1100.

Corner pushers 1106 are actuated to contact corner walls 210, 212, 214, and/or 216 when bottom panel 24 reaches the bottom of plunger opening 1110. When machine 900 forms a container from blank 300 and/or 500, corner pushers 1106 move toward each outer reinforcing corner panel 302, 304, 306, and 308 (shown in FIGS. 5 and 9) and apply a force to exterior surface 14 thereof. The applied force secures outer reinforcing corner panels 302, 304, 306, and 308 to respective corner panels 154, which has adhesive applied thereto in second gluing station 956. In the exemplary embodiment, adhesive is applied to interior surface 12 of at least one outer reinforcing corner panel 302, 304, 306, and/or 308 and/or exterior surface 14 of corner panel 154. Corner pushers 1106 are controlled to rotate interior surface 12 of outer reinforcing corner panel 302, 304, 306, and/or 308 toward exterior surface 14 of corner panel 154 and to press outer reinforcing corner panel 302, 304, 306, and/or 308 into contact with corner panel 154 to secure outer reinforcing corner panel 302, 304, 306, and/or 308 to a respective corner panel 154 using the adhesive.

Container 200 is then formed from blank 10. At any suitable time during formation of container 200 from blank 10, a second blank 10 may be removed from hopper 940 to form a second container 200. As such, the method may be performed to continuously form containers 200 using machine 900. After container 200 is formed, end panel plows 1104, side panel plows 1102, and/or corner pushers 1106 secure container 200 within plunger opening 1110. Plunger 1100 retracts upwardly out of cavity 224 of container 200 to the upper position, end panel plows 1104, side panel plows 1102, and/or corner pushers 1106 move to outer positions. As such, container 200 is released from plunger opening 1110 to fall downward to exit conveyor 922. Exit conveyor 922 transports container 200 from plunger opening 1110 and/or forming station 908. More specifically, exit conveyor 922 extends from ejection station 910 into the bottom of compression station 958 for receiving container 200 from plunger 1100 and transferring container 200 from forming station 908 to ejection station 910. When machine 900 forms a container having top panels, the container is ejected from machine 900 without the top panels rotated into position such that the container is configured to have a product placed therein. Container 200 can then be filled with a product and transported to a machine that folds top panels 20 and 28 and secures container 200 in the closed position. The machine can also tape container 200 in the closed position.

The above-described blanks and containers provide a reinforcing polygonal container. More specifically, the embodiments described herein provide an octagonal container having reinforced corner walls, side walls, and end walls for storing and/or transporting a product therein. Further, the embodiments described herein provide a polygonal container having a top wall. More specifically, the top wall may be formed from top panels emanating from the side walls of the container or the end walls of the container. The top wall may be a full top wall covering substantially the entire cavity of the container or may be a partial top wall, such as top shoulders, that allows access to the cavity of the container when the top wall is formed. Moreover, the embodiments described herein include an outer reinforcing panel to provide further support to the containers. Embodiments not including the outer reinforcing panel may be preferable when printing is to be applied to the exterior of the container. Additionally, the blanks and containers described herein may include a support wall for additional support of the container when, for example, the containers are stacked. The support wall may also act as a partition or divider for the cavity of the container.

The containers described herein include stacking tabs that limit movement between stacked containers and secure the top panels to the end walls. More specifically, the stacking tabs extend through locking slots defined through the top panels and fit within stacking slot defined in end walls of an upper container. The stacking tabs are formed with a double thickness of material to provide strength to the stacking tabs.

The machine described herein facilitates forming containers from the above-described blanks. More specifically, the machine more quickly and easily forms the containers, as compared to a person manually forming the containers from the blanks. As such, the machine facilitates producing many containers in a shorter time period, as compared to manual construction of the containers. Further, the above-described machine facilitates automating the method for forming a container from a blank such that cost and time for producing a container is reduced as compared to manually forming the containers.

Exemplary embodiments of a machine for forming a container from a blank are described above in detail. The machine is not limited to the specific embodiments described herein, but rather, components of the machine may be utilized independently and separately from other components described herein. For example, the machine may also be used in combination with other types of blanks, and is not limited to practice with only the blanks for forming a polygonal container, as described herein. Rather, the exemplary embodiment can be implemented and utilized in connection with many other container forming applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a container from a blank of sheet material using a machine, the blank including a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines, the reinforcing panel assembly extending from a first side edge of a first end panel of the two end panels, the machine including a forming station, said method comprising:

forming a reinforcing corner assembly from the reinforcing panel assembly by folding the plurality of reinforcing panels about the plurality of fold lines by compressing the plurality of reinforcing panels into face-to-face relationship using a male forming member and a female forming member within the forming station;

rotating a first portion of the reinforcing panel assembly with respect to a second portion of the reinforcing panel assembly by forcing the first portion towards a miter plate using a guide bar, wherein the miter plate and the guide bar are positioned downstream from the male and female forming members; and coupling reinforcing side panels of the reinforcing panel assembly to one of the side panels to form the containers;

wherein the machine includes a folder arm positioned adjacent to the male and female forming members, the method further comprising: rotating an inner end panel of the reinforcing panel assembly into face-to-face relationship with the first end panel, the reinforcing side panels into face-to-face relationship, and corner panels of the reinforcing panel assembly into face-to-face relationship by rotating the folder arm from a starting position to a folding position.

2. A method in accordance with claim 1 further comprising rotating the side panels and the end panels to be substantially perpendicular to the bottom panel by directing the blank through a compression station within the forming station.

3. A method in accordance with claim 2 further comprising maintaining an alignment of the reinforcing corner assembly as the end panels are rotated using support bars within the compression station.

4. A method in accordance with claim 2, wherein the blank further includes an outer reinforcing corner panel extending from an end edge of a side panel, the method further comprising attaching the outer reinforcing corner panel to an exterior surface of the reinforcing corner assembly using a corner pusher within the compression station.

5. A method in accordance with claim 1, further comprising: contacting at least one of the inner end panel and reinforcing side panels with the male member as the inner end panel and reinforcing side panels are rotated by the folder arm; and folding the at least one inner end panel and reinforcing side panel about an interconnecting fold line with the male member.

6. A method in accordance with claim 1, wherein forming a reinforcing corner assembly further comprises rotating corner panels of the reinforcing panel assembly with respect to the first end panel and an inner end panel of the reinforcing panel assembly and with respect to the reinforcing side panels to form the reinforcing corner assembly by compressing the male and female forming members together.

* * * * *